US011998816B2

(12) United States Patent
Milleman et al.

(10) Patent No.: US 11,998,816 B2
(45) Date of Patent: Jun. 4, 2024

(54) GOLF CLUB HEAD WITH VIBRATIONAL DAMPING SYSTEM

(71) Applicant: KARSTEN MANUFACTURING CORPORATION, Phoenix, AZ (US)

(72) Inventors: Travis D. Milleman, Portland, OR (US); Matthew T. Schier, Phoenix, AZ (US); Murphy R. Alexander, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 76 days.

(21) Appl. No.: 17/653,279

(22) Filed: Mar. 2, 2022

(65) Prior Publication Data

US 2022/0280848 A1 Sep. 8, 2022

Related U.S. Application Data

(60) Provisional application No. 63/187,800, filed on May 12, 2021, provisional application No. 63/200,348, filed on Mar. 2, 2021.

(51) Int. Cl.
*A63B 53/04* (2015.01)
*A63B 60/54* (2015.01)

(52) U.S. Cl.
CPC ..... *A63B 60/54* (2015.10); *A63B 53/0408* (2020.08); *A63B 53/0445* (2020.08); *A63B 53/047* (2013.01)

(58) Field of Classification Search
CPC . A63B 60/54; A63B 53/0408; A63B 53/0445; A63B 53/047
See application file for complete search history.

(56) References Cited

U.S. PATENT DOCUMENTS 2,846,228 A * 8/1958 Reach ..... A63B 53/047 473/332
4,928,972 A * 5/1990 Nakanishi ..... A63B 53/047 473/332
5,290,036 A * 3/1994 Fenton ..... A63B 53/04 273/DIG. 8
5,348,302 A 9/1994 Sasamoto et al.
5,409,229 A * 4/1995 Schmidt ..... A63B 53/04 473/332
5,591,092 A * 1/1997 Gilbert ..... A63B 60/00 473/331
5,766,092 A 6/1998 Mimeur et al.
(Continued)

FOREIGN PATENT DOCUMENTS

JP 2012213455 11/2012

OTHER PUBLICATIONS

International Search Report/Written Opinion for Int'l Patent Application No. PCT/US2022/018573, published on Aug. May 18, 2022.
(Continued)

*Primary Examiner* — William M Pierce

(57) ABSTRACT

Embodiments of an iron-type golf club head comprising a high moment of inertia and a damping system. The damping system includes an insert covering a lower portion of the back face and a badge covering an upper portion of the back face. The damping system covers a large proportion of the back face and provides a club head with desirable sound and feel characteristics.

20 Claims, 23 Drawing Sheets

(56) References Cited

U.S. PATENT DOCUMENTS 5,921,869 A * 7/1999 Blough ..... A63B 60/00 473/291
6,030,293 A 2/2000 Takeda
6,592,469 B2 * 7/2003 Gilbert ..... A63B 60/02 473/291
6,835,144 B2 * 12/2004 Best ..... A63B 53/047 473/332
6,855,066 B2 * 2/2005 Best ..... A63B 60/54 473/332
6,857,973 B2 * 2/2005 Wieland ..... A63B 53/047 473/349
6,887,164 B2 * 5/2005 Dewanjee ..... A63B 53/047 473/349
7,004,853 B2 * 2/2006 Deshmukh ..... A63B 60/00 473/332
7,220,189 B2 * 5/2007 Wieland ..... A63B 53/0466 473/349
7,399,238 B2 * 7/2008 Hocknell ..... A63B 53/047 473/349
D621,893 S * 8/2010 Nicolette ..... D21/759
7,815,523 B2 10/2010 Knutson et al.
7,819,757 B2 * 10/2010 Soracco ..... A63B 53/04 473/332
7,862,450 B2 * 1/2011 Gilbert ..... A63B 53/04 473/331
7,942,760 B2 5/2011 Best et al.
8,088,025 B2 1/2012 Wahl et al.
8,118,688 B2 * 2/2012 Nakamura ..... B21K 23/00 473/331
8,187,117 B2 * 5/2012 Blumenkrantz ..... A63B 60/02 473/332
8,267,807 B2 * 9/2012 Takechi ..... A63B 53/047 473/335
8,302,658 B2 11/2012 Gilbert et al.
8,632,421 B2 1/2014 Park et al.
8,647,218 B2 2/2014 Gilbert et al.
8,864,603 B2 * 10/2014 Kumamoto ..... A63B 53/06 473/332
8,876,630 B2 * 11/2014 Takechi ..... A63B 53/04 473/335
8,920,261 B2 * 12/2014 Taylor ..... B23P 11/02 473/350
9,005,048 B2 * 4/2015 Jertson ..... A63B 60/54 473/409
9,039,543 B2 * 5/2015 Mizutani ..... A63B 60/54 473/332
9,199,141 B2 * 12/2015 Cardani ..... A63B 53/047
9,421,436 B2 8/2016 Soracco et al.
9,545,548 B2 1/2017 Petersen et al.
9,662,549 B2 * 5/2017 Vrska, Jr. ..... A63B 53/047
9,808,685 B1 11/2017 Westrum et al.
10,112,084 B2 * 10/2018 Stokke ..... A63B 60/52
10,420,991 B2 * 9/2019 Petersen ..... A63B 53/0475
10,427,018 B2 * 10/2019 Taylor ..... A63B 60/54
10,561,910 B2 * 2/2020 Daraskavich ..... A63B 53/0475
10,668,338 B2 6/2020 Morales
10,918,919 B2 * 2/2021 Morales ..... A63B 53/06
11,202,946 B2 * 12/2021 Golden ..... A63B 53/047
11,565,158 B1 * 1/2023 Parsons ..... A63B 60/02
2003/0092502 A1 5/2003 Pergande et al.
2004/0092331 A1 * 5/2004 Best ..... A63B 53/047 473/332
2005/0096151 A1 5/2005 Hou et al.
2007/0129162 A1 6/2007 Pan et al.
2010/0267463 A1 * 10/2010 Stites ..... A63B 53/047 473/409
2011/0028240 A1 * 2/2011 Wahl ..... B23P 17/04 473/346
2011/0124432 A1 * 5/2011 Oldknow ..... A63B 53/047 473/282
2011/0207551 A1 * 8/2011 Breier ..... A63B 60/54 473/332
2012/0028727 A1 * 2/2012 Roach ..... A63B 53/047 473/291
2016/0332043 A1 * 11/2016 Cardani ..... A63B 53/0475
2016/0332044 A1 * 11/2016 Daraskavich ..... A63B 53/0475
2017/0157474 A1 * 6/2017 Sander ..... A63B 53/0466
2018/0111028 A1 * 4/2018 Gonzalez ..... A63B 53/0475
2020/0001149 A1 1/2020 Parsons et al.
2020/0289902 A1 9/2020 Morales et al.
2020/0338399 A1 10/2020 Takahashi et al.
2020/0338401 A1 10/2020 Huang et al.

OTHER PUBLICATIONS

Tomo Bystedt, "Taylormade P790", Taylormade Golf Company, Inc., (2017) at http://www.taylormadegolf.com/on/demandware.static/-/Sites-TMaG-Library/default/docs/productspecs/2017/P790%20Irons.pdf.

John Barba, "First Look: Callaway Rouge Irons", Mygolfspy, Inc., (Jan. 18, 2018), at https://mygolfspy.com/first-look-callaway-rogue-irons.

* cited by examiner

GOLF CLUB HEAD WITH VIBRATIONAL DAMPING SYSTEM

CROSS REFERENCE PRIORITIES

This claims the benefit of U.S. Provisional Application No. 63/200,348, filed Mar. 2, 2021; and U.S. Provisional Application No. 63/187,800, filed May 12, 2021.

TECHNICAL FIELD

This disclosure relates generally to golf club heads and, more particularly, relates to golf club heads comprising a high moment of inertia and damping systems configured to damp club head vibrations at impact.

BACKGROUND

Golf club design takes into account several performance factors including ball flight characteristics, sound characteristics, and feel characteristics. Ball flight characteristics (such as ball speed, launch angle, spin rate, forgiveness, etc.) generally depend on the mass properties of the club head, including the center of gravity (CG) position and the club head moment of inertia (MOI). The sound characteristics (e.g. the acoustic response of the club head at impact) and the feel characteristics (e.g. the vibrations of the club head felt in the hands of the golfer at impact) of the club head generally depend on the vibrational response of the club head at impact.

The sound and feel of the club head are determined by the vibrational response of the club head at impact. At impact, the club head vibrates at a variety of natural frequencies (also known as "modes" of vibration) comprising a variety of different amplitudes. The club head design and construction determine the variety of different amplitudes that occur at the variety of natural frequencies. Natural frequencies with high amplitudes are considered "dominant" and contribute most significantly to the sound of the club head. If the amplitude of the dominant frequencies is too high, the club head can sound loud and displeasing to the golfer. Natural frequencies with amplitudes lower than that of the dominant frequency are considered "residual" and contribute to a "ringing" sensation in the club head, wherein the sound of impact and the vibrational sensation felt in the golfer's hands are undesirably sustained.

By reducing the amplitude of said natural frequencies, the overall volume, harshness, and ringing of the club head can be minimized, providing a muted, pleasing sound and feel at impact. The process of reducing said amplitudes is hereafter referred to as "damping." Mass damping refers to the damping of vibrations by increasing mass at or near the location where the vibration occurs. "Viscoelastic damping" refers to the damping of vibrations by applying a material with viscoelastic properties at or near the location where the vibration occurs. The sound and feel characteristics can be improved by damping dominant vibrations in the club head via the allocation of mass in certain areas or the inclusion of vibration-damping material into the club head.

Ideally, a golf club head achieves a combination of desirable ball flight, sound, and feel characteristics. However, design features that improve certain club head ball flight characteristics may have a negative effect on the sound and feel of the club head, and vice versa. Certain types of golf club heads, particularly iron-type golf club heads, are desirable with respect to certain characteristics above, but undesirable with respect to others. For example, a cavity-back iron may be very forgiving, but sound and feel harsh and "clacky." In contrast, a forged or muscle-back iron may comprise desirable sound and feel characteristics but lack a high level of forgiveness. There is a need in the art for an iron-type club head that comprises a combination of the forgiveness of a cavity-back type iron and the desirable sound and feel of a muscle-back iron.

BRIEF DESCRIPTION OF THE DRAWINGS

To facilitate further description of the embodiments, the following drawings are provided in which.

DEFINITIONS

I. Introduction

Figure 1:
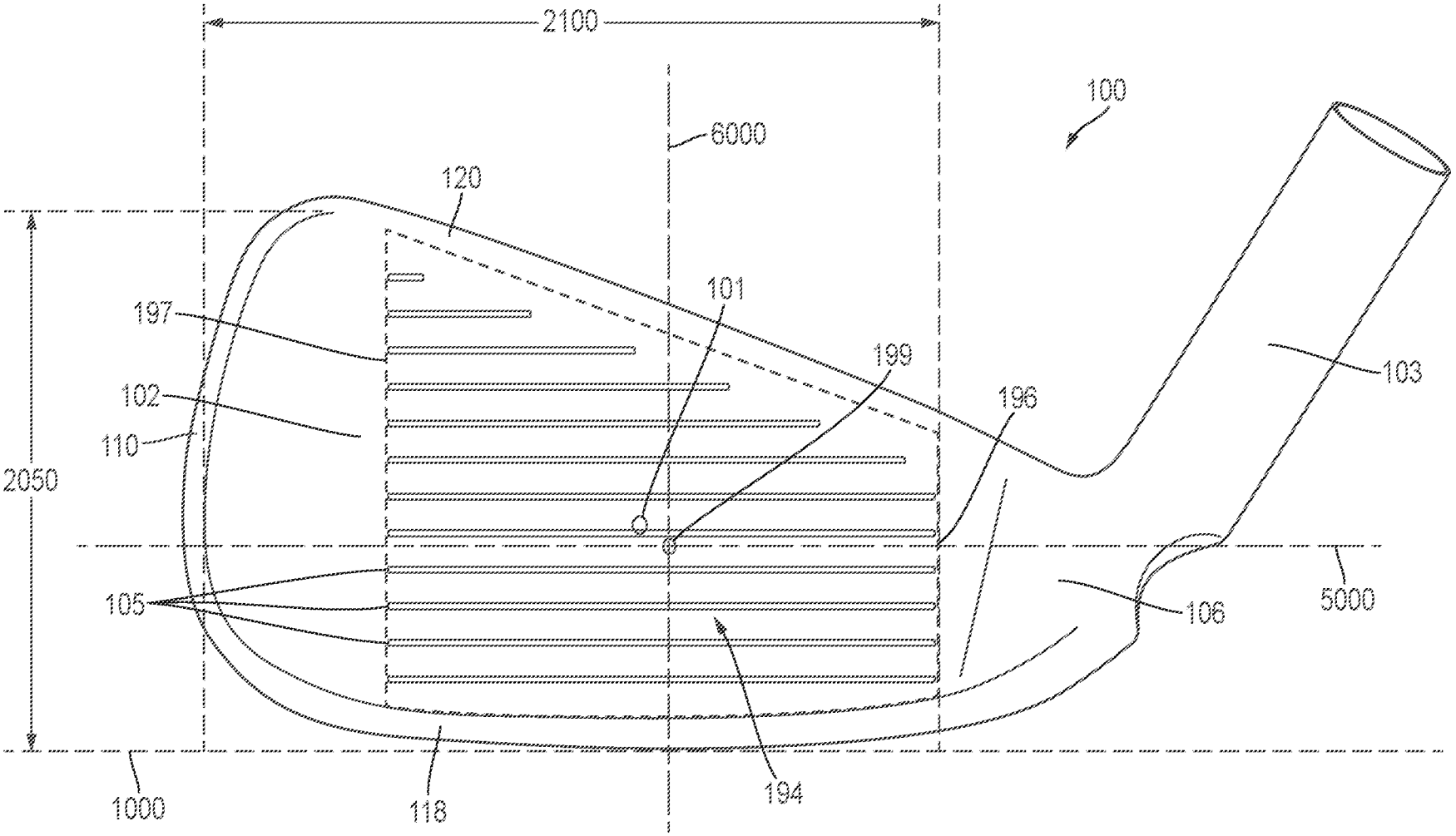
FIG. 1 illustrates a front view of a golf club head according to a first embodiment.

Described herein are embodiments of an iron-type golf club head with high forgiveness further having a desirable sound and feel. The club head comprises a cavity-back construction comprising a rear cavity and significant perimeter weighting that provides a high moment of inertia and increases forgiveness. The club head further comprises a damping system including an insert and a badge each made of a material suitable to damp vibrations. The damping system covers a large percentage of the back of the strike face with said damping material to damp vibrations at impact and provide a desirable sound and feel to the club head. The damping system can comprise a coverage area greater than 85% of an available surface area of the back face, greater than 75% of a surface area of the scoring area, and greater than 60% of the total surface area of the strike face. The high damping system coverage area leads to reducing the amplitude of certain vibrations by over 40%. The badge can also serve to visually fill the rear cavity to provide the appearance of a muscle-back club head. The club head comprises the forgiveness of a cavity-back iron with the sound, feel, and appearance of a muscle-back iron.

II. Definitions

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

The term "strike face," as used herein, refers to a club head front surface that is configured to strike a golf ball. The term strike face can be used interchangeably with the "face."

The term "strike face perimeter," as used herein, can refer to an edge of the strike face. The strike face perimeter can be located along an outer edge of the strike face where the curvature deviates from a bulge and/or roll of the strike face.

The term "geometric centerpoint," as used herein, can refer to a geometric centerpoint of the strike face perimeter, and at a midpoint of the face height of the strike face. In the same or other examples, the geometric centerpoint also can be centered with respect to an engineered impact zone, which can be defined by a region of grooves on the strike face. As another approach, the geometric centerpoint of the strike face can be located in accordance with the definition of a golf governing body such as the United States Golf Association (USGA). For example, the geometric centerpoint of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "ground plane," as used herein, can refer to a reference plane associated with the surface on which a golf ball is placed. The ground plane can be a horizontal plane tangent to the sole at an address position.

The term "loft plane," as used herein, can refer to a reference plane that is tangent to the geometric centerpoint of the strike face.

The term "loft angle," as used herein, can refer to an angle measured between the ground plane and the loft plane.

The term "face height," as used herein, can refer to a distance measured parallel to loft plane between a top end of the strike face perimeter and a bottom end of the strike face perimeter.

The term "blade length," as used herein, can refer to a heel-to-toe distance measured between the scoring area heel boundary 196 and the heel-most extent of the strike face.

The term "lie angle," as used herein, can refer to an angle between a hosel axis, extending through the hosel, and the ground plane. The lie angle is measured from a front view.

The term "iron," as used herein, can, in some embodiments, refer to an iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, such as for "game improvement irons", the volume of the club head is less than approximately 65 cc, less than approximately 60 cc, less than approximately 55 cc, or less than approximately 50 cc. In some embodiments, the volume of the club head can be approximately 50 cc to 60 cc, approximately 51 cc-53 cc, approximately 53 cc-55 cc, approximately 55 cc-57 cc, or approximately 57 cc-59 cc.

In many embodiments, such as for "player's irons", the volume of the club head is less than approximately 45 cc, less than approximately 40 cc, less than approximately 35 cc, or less than approximately 30 cc. In some embodiments, the volume of the club head can be approximately 31 cc-38 cc (1.9 cubic inches to 2.3 cubic inches), approximately 31 cc-33 cc, approximately 33 cc-35 cc, approximately 35 cc-37 cc, or approximately 37 cc-39 cc.

The term or phrase "cavity-back" as used herein, can refer to a perimeter weighted iron-type golf club head comprising a rear cavity exposed to the rear exterior of the club head.

The term or phrase "muscle-back" as used herein, can refer to an iron-type golf club head comprising a substantially solid construction wherein the club head does not comprise a rear cavity, but instead comprises a full back or rear of the club head.

The term or phrase "moment of inertia" (hereafter "MOI") can refer to values measured about the CG. The term "MOIxx" or "Ixx" can refer to the MOI measured in the heel-to-toe direction, parallel to the X-axis 5000. The term "MOIyy" or "Iyy" can refer to the MOI measured in the sole-to-top rail direction, parallel to the Y-axis 6000. The MOI values MOIxx and MOIyy determine how forgiving the club head is for off-center impacts with a golf ball.

III. General Description—Golf Club Head

Figure 2:
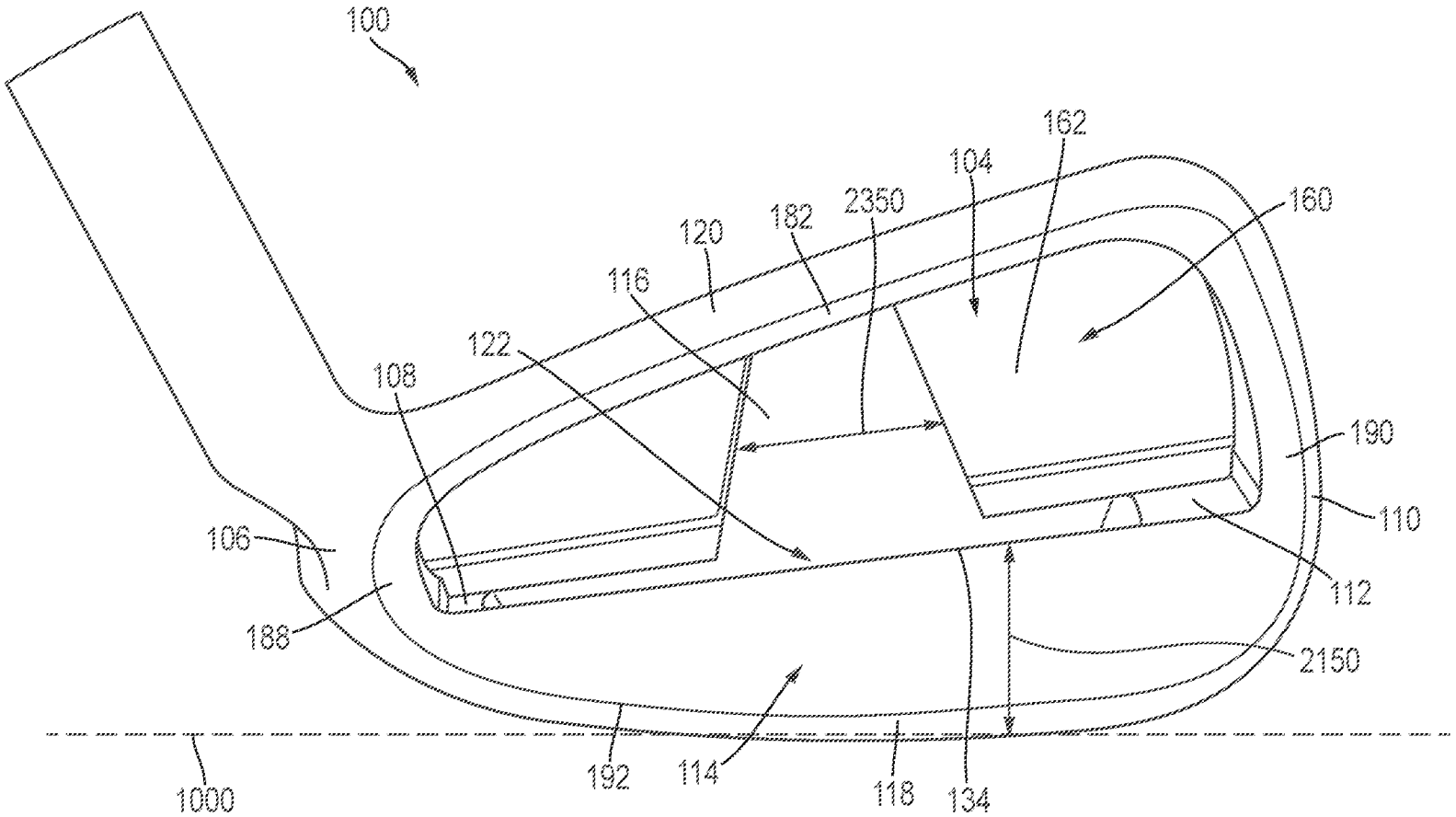
FIG. 2 illustrates a rear view of the golf club head of FIG. 1 comprising an insert cavity and a rear cavity.

Referring to FIGS. 1 and 2, the club head comprises a strike face 102, a back face 104 opposite the strike face 102, a top rail 120, a sole 118 opposite the top rail 120, a toe portion 110, and a heel portion 106 opposite the toe portion 110. The top rail 120, sole 118, toe portion 110, and heel portion 106 each extend rearwardly from the perimeter of the strike face 102. The club head 100 further comprises a rear wall 114 extending upward from the sole 118, at least partially between the sole 118 and the top rail 120. The club head 100 further comprises a hosel 103 located proximate the heel portion 106 and configured to receive a golf club shaft (not shown). The strike face 102 further defines a plurality of score lines 105 extending in a heel-toe toe direction parallel to the ground plane 1000.

Referring to FIG. 1, the club head 100 further comprises a scoring area 194 defined as the area of the strike face 102 occupied the plurality of score lines 105. The scoring area 194 comprises a scoring area heel boundary 196 defined by a line connecting the heel-most extent of the plurality of score lines 105 and a scoring area toe boundary 197 defined by a line connecting the toe-most extent of the plurality of score lines 105. The scoring area 194 can extend from the strike face perimeter near the top rail 120 to the strike face perimeter near the sole 118.

As illustrated in FIG. 1, the golf club head comprises a coordinate system centered about the center of gravity 199. The coordinate system comprises an X-axis 5000 and a Y-axis 6000. The X-axis 5000 extends in a heel-to-toe direction. The X-axis 5000 is positive towards the heel and negative towards the toe. The Y-axis 6000 extends in a sole-to-top rail direction and is orthogonal to the X-axis 5000. The Y-axis 6000 is positive towards the top rail and negative towards the sole.

Description

IV. Club Head with Damping System

Described herein are various embodiments of an iron-type golf club head with high forgiveness further having a desirable sound and feel. The iron-type golf club comprises a damping system including an insert and a badge. The insert and badge are made from a damping material. The damping system covers a large percentage of the back of the strike face with said damping material to damp vibrations at impact and provide a desirable sound and feel to the club head. The damping system can comprise a coverage area greater than 85% of an available surface area of the back face, greater than 75% of a surface area of the scoring area, and greater than 60% of the total surface area of the strike face. The high damping system coverage area leads to reducing the amplitude of certain vibrations by over 40%. The badge can also serve to visually fill the rear cavity to provide the appearance of a muscle-back club head. The club head comprises the forgiveness of a cavity-back iron with the sound, feel, and appearance of a muscle-back iron. The damping system combined with the high forgiveness makes an appealing iron-type golf club head.

a) Insert Cavity and Rear Wall

Figure 4:
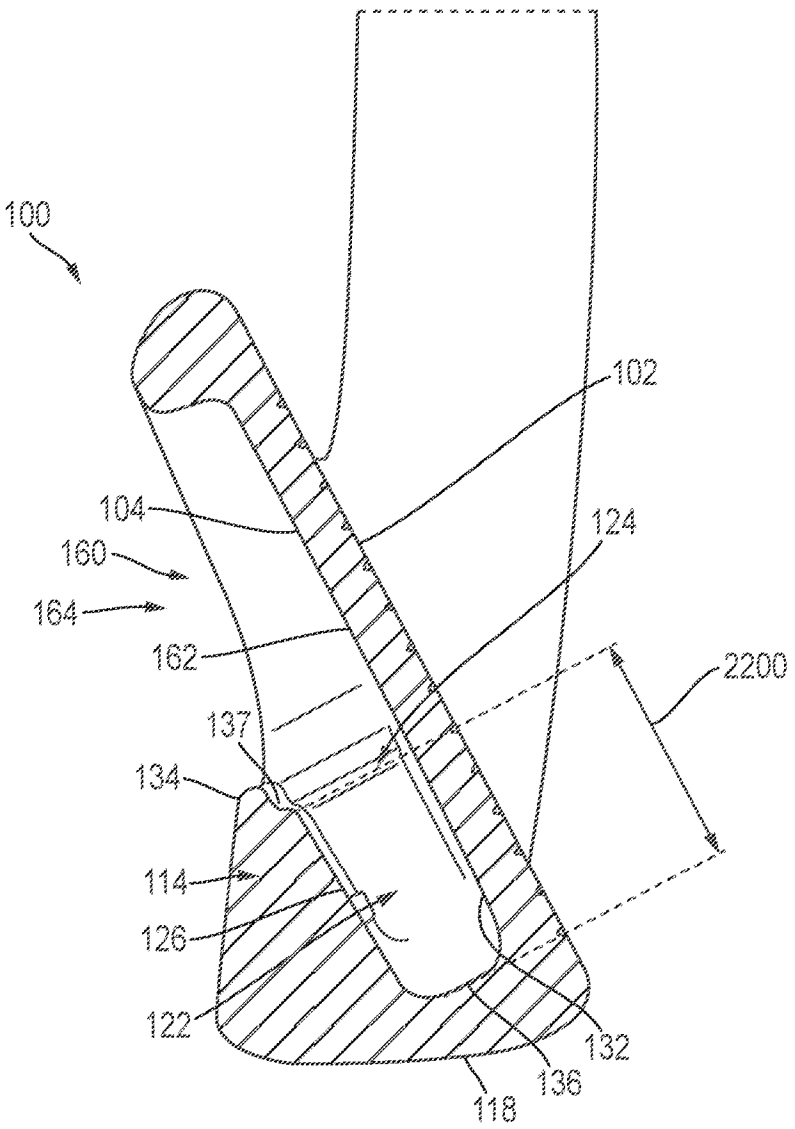
FIG. 4 illustrates a cross section view from the toe side of the golf club head of FIG. 1 comprising an insert cavity and a rear cavity.

Referring to FIGS. 2 and 4, the club head 100 defines an insert cavity 122 formed between the rear wall 114 and the back face 104. The insert cavity 122 can extend generally soleward from a rear wall top edge 134, between the rear wall inner surface 126 and a back face lower portion 132. In many embodiments, the insert cavity 122 is bounded by the rear wall inner surface 126, the back face lower portion 132, a toe portion inner surface 130, a heel portion inner surface 128, an inner surface of the sole 118, or a combination thereof. As illustrated in FIG. 4, the insert cavity 122 comprises an insert cavity opening 124 proximate the rear wall top edge 134. The insert cavity opening 124 provides access to the insert cavity 122 from the exterior of the club head 100 to allow the insert cavity 122 to receive an insert 140, as discussed in further detail below. In many embodiments, as illustrated in FIG. 4, the inner surface of the sole 118 forms a cavity base 136 upon which the insert 140 can rest when secured within the insert cavity 122.

The size and shape of the insert cavity 122 is at least partially defined by the shape of the rear wall 114. As discussed above and illustrated in FIG. 2, the rear wall 114 extends upward from the sole 118 at least partially towards the top rail 120. The rear wall 114 does not extend all the way to the top rail 120 and does not contact the top rail 120. By only extending upward only a portion of the distance between the sole 118 and the top rail 120, the rear wall 114 creates a club head 100 with a cavity-back construction wherein a rear cavity 160 is formed and at least a portion of the back face 104 is exposed.

Referring to FIG. 2, the rear wall 114 defines a rear wall height 2150 measured vertically between the ground plane 1000 and the rear wall top edge 134. In some embodiments, rear wall height 2150 can be substantially constant in a heel-to-toe direction. In other embodiments, the rear wall height 2150 can vary between the heel portion 106 and the toe portion 110. In some embodiments, referring to FIG. 2, the rear wall height 2150 can increase from the heel portion 106 to the toe portion 110 in a substantially linear fashion. In many embodiments, the rear wall height 2150 can vary linearly or non-linearly. The rear wall height 2150 can be greater near the heel portion 106 than near the toe portion 110 or greater near the toe portion 110 than near the heel portion 106. In some embodiments, discussed in further detail below, the rear wall height 2150 can comprise a maximum or a minimum approximately halfway between the heel portion 106 and the toe portion 110 such that the rear wall 114 forms an apex or a nadir.

As illustrated in FIG. 4, the rear wall 114 can form a rear wall lip 137 on an inner side of the rear wall top edge 134. As discussed in further detail below, the rear wall lip 137 serves to create a gap 168 between the rear wall top edge 134 and the badge 170 and/or the insert 140. In many embodiments, the insert cavity opening 124 can be located at the transition between the rear wall lip 137 and the rear wall inner surface 126.

As discussed above, the insert cavity 122 extends soleward from the insert cavity opening 124 located near the rear wall top edge 134 to the insert cavity base 136. As such, the size and shape of the insert cavity 122 depend on the geometry of the rear wall 114 and the rear wall height 2150. For example, providing a greater rear wall height 2150 can increase the cavity depth 2200.

As illustrated by FIG. 4, The insert cavity 122 comprises an insert cavity depth 2200 measured parallel to the strike face 102 between the insert cavity base 136 and insert cavity opening 124. In many embodiments, the insert cavity depth 2200 can range between 0.25 inch and 0.75 inch. In some embodiments, the insert cavity depth 2200 can range inclusively between 0.25 inch and 0.35 inch, between 0.35 inch and 0.45 inch, between 0.45 inch and 0.55 inch, between 0.55 inch and 0.65 inch, or between 0.65 inch and 0.75 inch. In some embodiments, the insert cavity depth 2200 can be greater than 0.25 inch. In some embodiments, the insert cavity depth 2200 can be greater than 0.35 inch. In some embodiments, the insert cavity depth 2200 can be greater than 0.45 inch. In some embodiments, the insert cavity depth 2200 can be greater than 0.55 inch. In some embodiments, the insert cavity depth 2200 can be greater than 0.65 inch. In some embodiments, the insert cavity depth 2200 can be greater than 0.75 inch.

In many embodiments, the insert cavity 122 comprises a volume greater than 0.15 $in^3$. In many embodiments, the insert cavity 122 comprises a volume greater than 0.175 $in^3$. In many embodiments, the insert cavity 122 comprises a volume greater than 0.20 $in^3$. In many embodiments, the insert cavity 122 comprises a volume greater than 0.225 $in^3$. In many embodiments, the insert cavity 122 comprises a volume greater than 0.25 $in^3$.

b) Heel and Toe Masses

Figure 7:
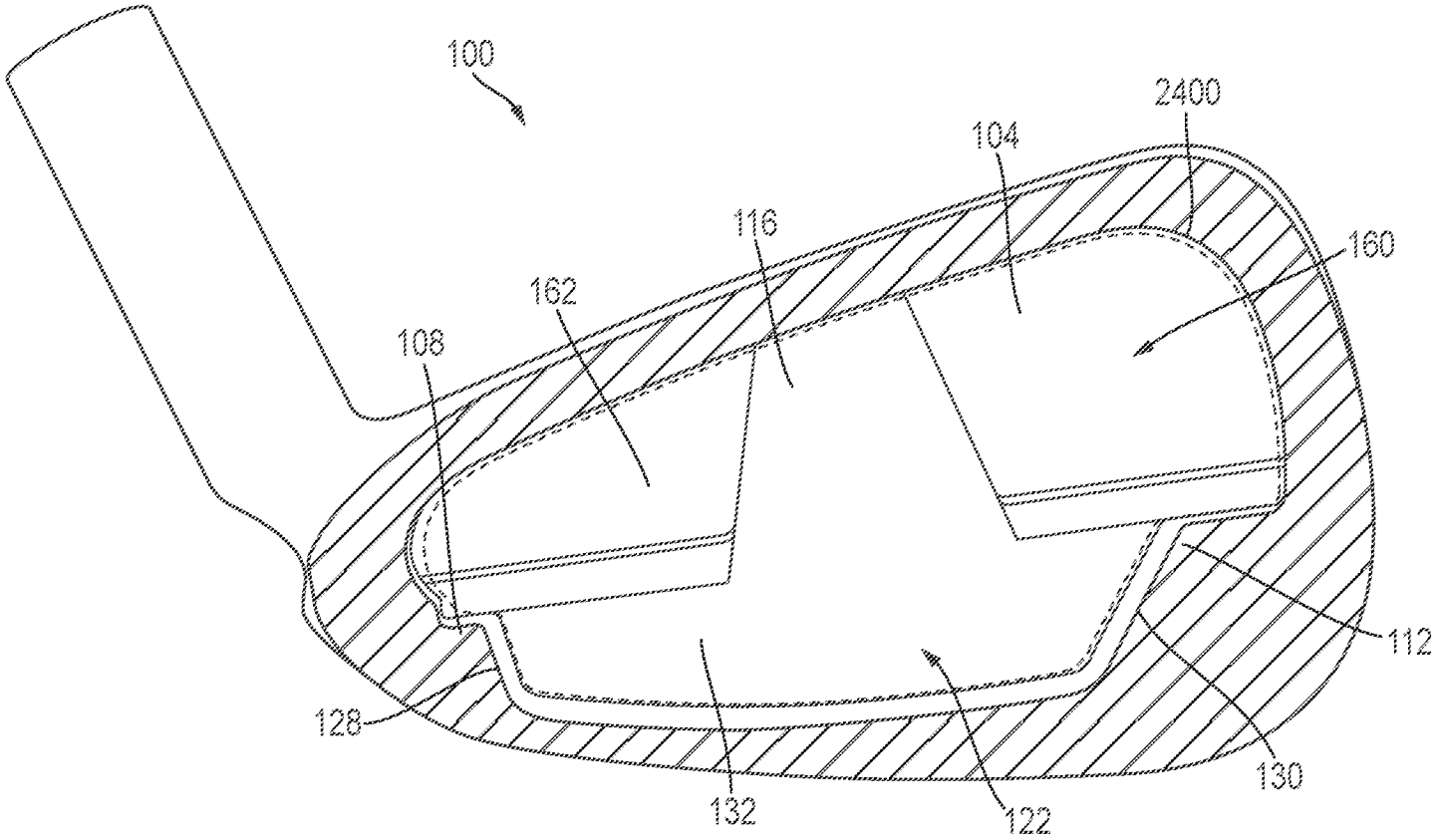
FIG. 7 illustrates a cross section view of from the rear of the golf club head of FIG. 1.

As illustrated by FIG. 2, the heel portion 106 and the toe portion 110 form a heel mass 108 and a toe mass 112, respectively. The heel mass 108 and the toe mass 112 comprise concentrations of mass configured to increase the perimeter weighting of the club head 100 and increase MOI. In many embodiments, the heel mass 108 and the toe mass 112 are integral with the club head and can be integrally formed with the club head 100, such as through a casting process. Referring to FIG. 7, the heel mass 108 forms the heel portion inner surface 128 and the toe mass 112 forms the toe portion inner surface 130. The heel mass 108 and the toe mass 112 can be situated at the heel and toe ends of the insert cavity 122, such that the insert cavity 122 is situated directly between the heel mass 108 and the toe mass 112. The heel portion inner surface 128 and the toe portion inner surface 130 can therefore define the heel side and toe side boundaries of the insert cavity 122.

c) Insert

Figure 5A:
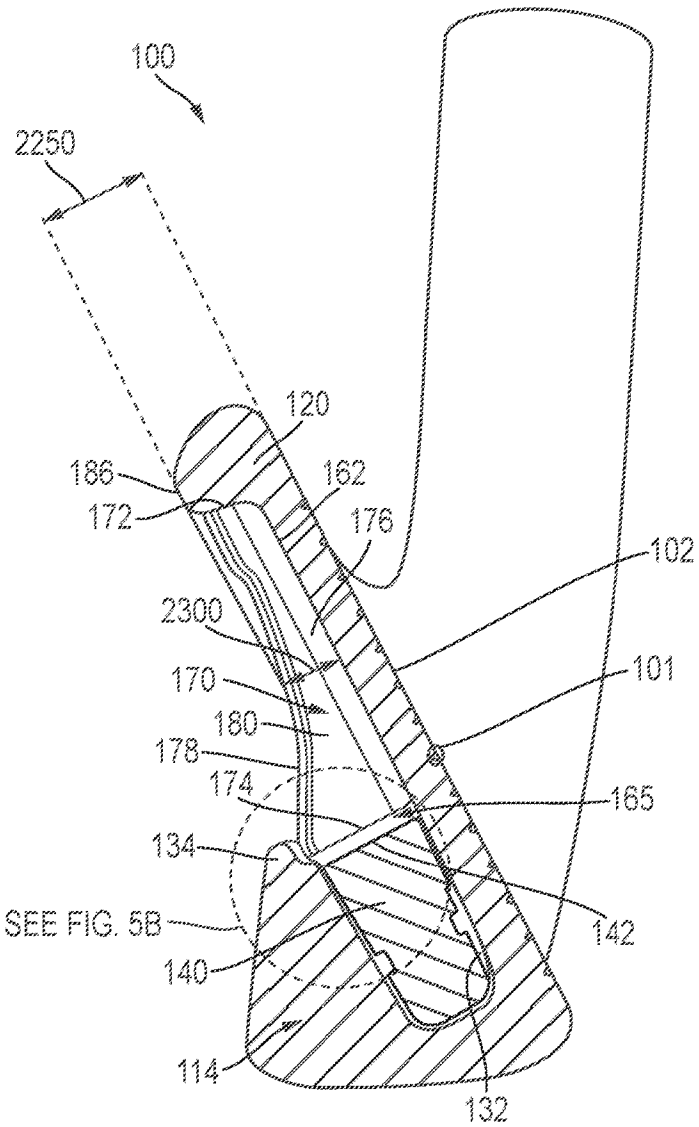
FIG. 5*a* illustrates a cross section view from the toe side of the golf club head of FIG. 1 comprising an insert cavity, an insert, a rear cavity, and a badge.

As illustrated in FIG. 5A, the club head 100 comprises an insert 140 configured to be secured within the insert cavity 122. The insert 140 can be inserted through the insert cavity opening 124 and mechanically and/or adhesively secured within the insert cavity 122. In the embodiment illustrated by FIG. 5A, when inserted into the insert cavity 122, a front surface 150 of the insert 140 abuts the back face lower portion 132, a toe surface 144 of the insert 140 abuts the toe portion inner surface 130, a heel surface 148 of the insert 140 abuts the heel portion inner surface 128, and a rear surface 152 of the insert 140 abuts the rear wall inner surface 126, and a bottom surface 146 of the insert 140 abuts the insert cavity base 136. The insert 140 can further comprise a top surface 142 opposite the bottom surface 146 and proximate the insert cavity opening 124.

The insert 140 can be made of a material comprising viscoelastic properties. In this way, the insert 140 provides viscoelastic vibration damping benefits to the club head by placing the insert 140 material in contact with the back face lower portion 132, the rear wall inner surface 126, the toe portion inner surface 130, the heel portion inner surface 128, and/or the insert cavity base 136. The contact between these areas of the club head 100 and the viscoelastic insert 140 damps vibrations occurring in and around said areas. In this way, the inclusion of the insert 140 within the insert cavity 122 provides a more desirable sound and feel to the club head 100.

The insert 140 at least partially fills the insert cavity 122. In many embodiments, such as the embodiment illustrated in FIG. 5A, the insert 140 substantially fills the entire volume of the insert cavity 122. In such embodiments, the insert 140 is complementarily shaped to the geometry of the insert cavity 122 and a top surface 142 of the insert 140 is flush with the insert cavity opening 124. In other embodiments (not shown), the insert 140 may only partially fill the volume of the insert cavity 122, such that the insert top surface 142 is recessed within the cavity. In other embodiments, the insert 140 may overfill the insert cavity 122 such that at least a portion of the insert 140 including the insert top surface 142 extends above the insert cavity opening 124. In many embodiments, the insert 140 can fill between 75% and 100% of the volume of the insert cavity 122. In many embodiments, the insert 140 can fill a range varying inclusively between 75% and 80%, 80% and 85%, 85% and 90%, 90% and 95%, or between 95% and 100% of the volume of the insert cavity 122. In some embodiments, the insert 140 can fill approximately 75%, 80%, 85%, 90%, 95%, or 100% of the volume of the insert cavity. In some embodiments, the insert 140 can fill between 75% and 85%, 85% and 95%, 80% and 90%, 75% and 90%, or between 85% and 100% of the volume of the insert cavity 122.

In many embodiments, the insert 140 comprises a contact area defined between the insert front surface 150 and the back face lower portion 132. In many embodiments, the contact area between the insert front surface 150 and the back face lower portion 132 can range between 0.70 $in^2$ and 1.5 $in^2$. In some embodiments, the contact area between the insert front surface 150 and the back face lower portion 132 can be between 0.70 $in^2$ and 0.80 $in^2$, between 0.80 $in^2$ and 0.90 $in^2$, between 0.90 $in^2$ and 1.0 $in^2$, between 1.0 $in^2$ and 1.1 $in^2$, between 1.1 $in^2$ and 1.2 $in^2$, between 1.2 $in^2$ and 1.3 $in^2$, between 1.3 $in^2$ and 1.4 $in^2$, or between 1.4 $in^2$ and 1.5 $in^2$. In some embodiments, the contact area between the insert front surface 150 and the back face lower portion 132 is greater than 0.70 $in^2$, greater than 0.80 $in^2$, greater than 0.90 $in^2$, greater than 1.0 $in^2$, greater than 1.1 $in^2$, greater than 1.2 $in^2$, greater than 1.3 $in^2$, greater than 1.4 $in^2$, or greater than 1.5 $in^2$.

In many embodiments, referring to FIG. 5A, the insert 140 can be located substantially low with respect to the strike face 102. For example, the insert 140 can be located entirely below the geometric center 101 of the strike face 102. As illustrated by FIG. 5A, the insert top surface 142 is below the geometric center 101 of the strike face 102. If any portion of the insert 140 is located too high with respect to the strike face 102 (e.g. if a portion of the insert 140 is located at or above the geometric center 101), the insert 140 itself may vibrate or rattle and contribute to an undesirable sound and feel at impact. Positioning the insert 140 below the geometric center 101 of the strike face 102 minimizes any vibration of the insert 140, thus providing an improved sound and feel at impact.

As discussed above, the insert 140 can be formed of a material comprising viscoelastic and/or damping properties. In many embodiments, the material of the insert 140 can comprise a polymer, a urethane material, a urethane-based material, an elastomer material, a thermoplastic material, other suitable types of material, a composite, or a combination thereof. In some embodiments, the material of the insert 140 can comprise a thermoplastic elastomer, thermoplastic polyurethane, resin, or resin mixed with powdered metals. In some embodiments, the resin can comprise a thermoplastic elastomer, or thermoplastic polyurethane.

In embodiments wherein the insert 140 comprises a resin mixed with powdered metal, the powdered metal can comprise steel, stainless steel, tungsten, or another suitable metal. In some embodiments, the insert 140 can comprise one powdered metal. In other embodiments, the insert 140 can comprise multiple types of powdered metals. For example, the insert 140 can comprise the resin and the stainless steel powdered metal, the resin and the tungsten powdered metal, or the resin, the stainless steel powdered metal, and the tungsten powdered metal. The insert 140 can further comprise a percentage of powdered metal by volume. The insert 140 can comprise 0% to 50% powdered metal by volume. In some embodiments, the insert 140 can comprise 0% to 10%, 10% to 20%, 20% to 30%, 30% to 40%, or 40% to 50% powdered metal by volume. For example, the insert 140 can comprise 0%, 1%, 10%, 20%, 30%, 40%, or 50% powdered metal by volume. The powdered metal percentage varies approximately linearly with the mass of the insert 140. As the mass of the insert 140 increases, the powdered metal percentage increases.

In many embodiments, the insert 140 comprises a hardness that can range from Shore A 10 to Shore A 55. In some embodiments, the hardness of the insert 140 can range from Shore A 10 to Shore A 25, Shore A 15 to Shore A 25, Shore A 20 to Shore A 30, Shore A 25 to Shore A 35, Shore A 25 to Shore A 40, or Shore A 40 to Shore A 55. For example, the hardness of the insert 140 can have a Shore A value of 10, 15, 25, 30, 35, 40, 45, 50, or 50. The hardness of the insert 140 is designed to allow the insert 140 damp vibrations while still allowing the strike face 102 to flex.

Because the insert 140 is located in a central portion of the club head 100 (i.e. in a position near the club head center of gravity 199), it is desirable for the insert 140 to be substantially lightweight. Providing a lightweight insert 140 allows a greater amount of mass to be distributed to the periphery of the club head 100, increasing MOI. In many embodiments, the insert 140 comprises a density or specific gravity less than the material of the body of the club head 100. In many embodiments, the insert 140 can comprise a specific gravity between 0.5 and 5.0. In many embodiments, the insert 140 can comprise a specific gravity between 0.5 and 1.0, 1.0 and 1.5, 1.5 and 2.0, 2.0 and 2.5, 2.5 and 3.0, 3.0 and 3.5, 3.5 and 4.0, 4.0 and 4.5, or between 4.5 and 5.0. In some embodiments, the insert 140 can comprise a specific gravity of approximately 0.5, 1.0, 1.5, 2.0, 2.5, 3.0, 3.5, 4.0, 4.5, or 5.0. In some embodiments, the insert 140 can comprise a specific gravity ranging inclusively between 0.5 and 1.5, 1.5 and 3.0, 3.0 and 4.0, or between 4.0 and 5.0.

In many embodiments, the insert 140 can comprise a mass between 1 g and 10 g. In many embodiments, the insert 140 can comprise a mass ranging inclusively between 1 g and 2 g, 2 g and 3 g, 3 g and 4 g, 4 g and 5 g, 5 g and 6 g, 6 g and 7 g, 7 g and 8 g, 8 g and 9 g, or between 9 g and 10 g. In some embodiments, the insert 140 can comprise a mass ranging inclusively between 1 g and 4 g, 4 g and 7 g, or between 7 g and 10 g. In some embodiments, the insert 140 can comprise a mass of approximately 1 g, 2 g, 3 g, 4 g, 5 g, 6 g, 7 g, 8 g, 9 g, or 10 g.

Figure 6:
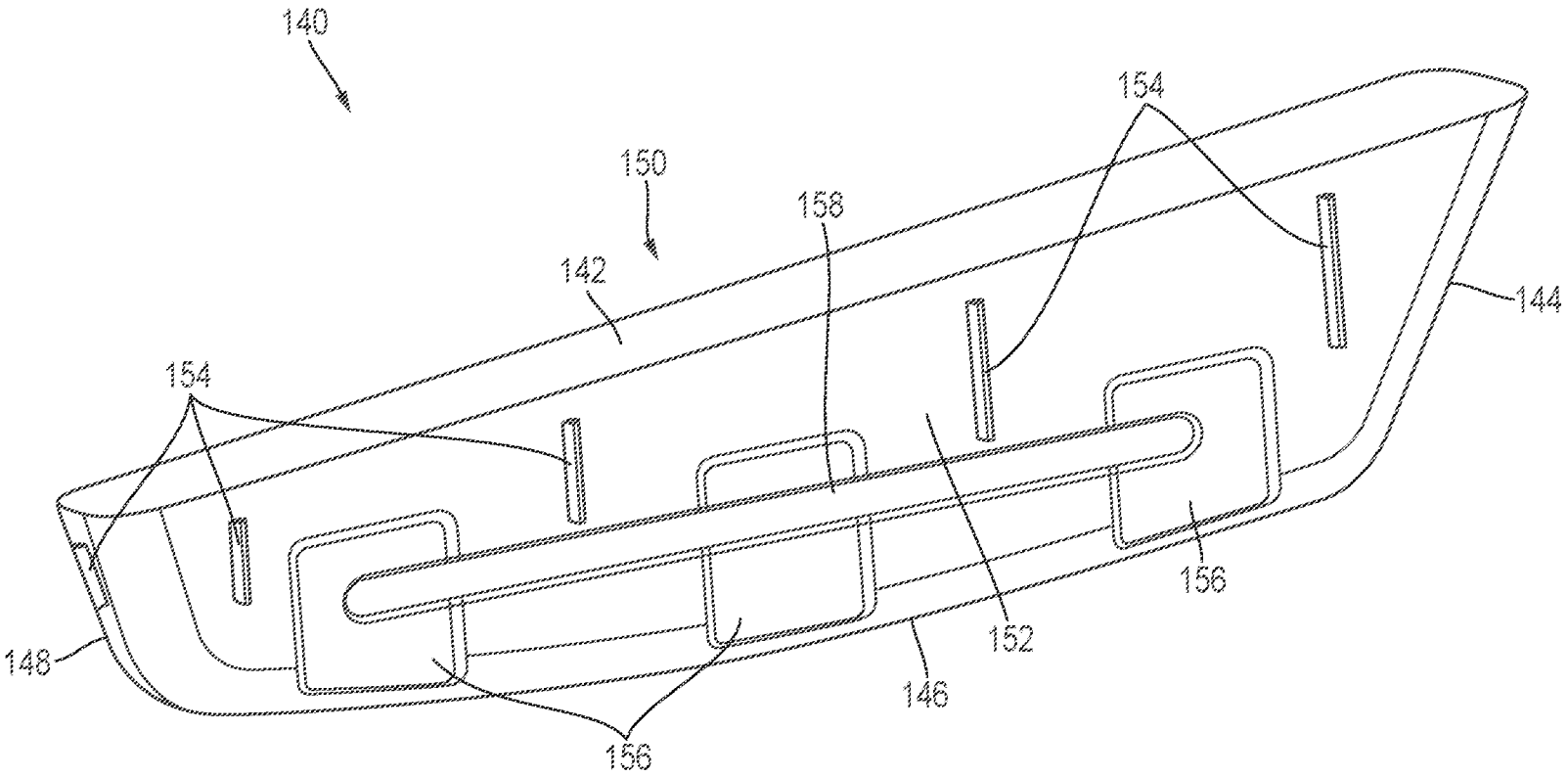
FIG. 6 illustrates a rear view of an insert.

Referring now to FIG. 6, the insert 140 comprises a top surface 142, a bottom surface 146 opposite the top surface 142, a front surface 150, a rear surface 152 opposite the front surface 150, a heel surface 148, and a toe surface 144 opposite the heel surface 148.

In many embodiments, such as the embodiment illustrated in FIG. 6, the insert can be asymmetric. The insert 140 can define a height measured between the bottom surface 146 and the top surface 142. In many embodiments, the height of the insert 140 can vary in a heel-toe-toe direction. For example, in the embodiment of FIG. 6, the height of the insert 140 can increase from the insert heel surface 148 to the insert toe surface 144. In other embodiments, the height of the insert can increase from the insert toe surface 144 to the insert heel surface 148. In other embodiments, discussed in further detail below, the insert 140 can comprise a maximum or minimum height between the insert heel surface 148 and the insert toe surface 144, such that the insert forms either an apex or a nadir. In some embodiments, the height of the insert 140 can remain constant in a heel-to-toe direction.

The insert 140 can also define a thickness measured between the insert front surface 150 and the insert rear surface 152. In some embodiments, the thickness of the insert 140 is substantially constant. In some embodiments, the thickness of the insert 140 can vary in a heel-to-toe direction and/or between the top surface 142 and the bottom surface 146. In many embodiments, such as the embodiment illustrated in FIG. 6, the thickness of the insert 140 can be greater near the insert toe surface 144 than near the insert heel surface 148.

As illustrated by way of example in FIG. 6, the insert 140 can further comprise one or more recesses 156 on the front surface 150. In some embodiments the one or more recesses 156 can be positioned on the front surface 150. In other embodiments, the one or more recesses 156 can be positioned on a combination of the front surface 150 of the insert 140 and the rear surface 152 of the insert 140. In some embodiments, the one or more recesses 156 can be positioned centrally on the front surface 150 and/or the rear surface 152 in between the heel surface 148 and the toe surface 144 of the insert 140. In other embodiments, the one or more recesses 156 can be positioned near the heel surface 148 or near the toe surface 144 of the insert 140. In some embodiments, the insert 140 can comprise one, two, three, four, five, or six recesses 156. In these embodiments, the one or more recesses 156 can be spaced equidistant from one another; while in other embodiments, the one or more recesses 156 can be spaced any distance from one another. In these embodiments, the one or more recesses 156 allows for a greater flow of an adhesive (such as epoxy) into the insert cavity 122 and more adhesive to be positioned between the insert cavity 122 and the insert 140. The greater amount of adhesive positioned between the insert cavity 122 and the insert 140 allows for more surface area of the insert 140 to couple with back face lower portion 132. The greater adhesive surface area secures the insert 140 within the insert cavity 122 and prevents the insert 140 from dislodging during use. The one or more grooves 158 (as described below), the one or more recesses 156, and one or more ribs 154 (as described below) together provide an optimal coupling of the surfaces of the insert 140 within the insert cavity 122. In an exemplary embodiment, as illustrated in FIG. 6, the one or more recesses 156 can comprise three recesses positioned centrally on the front surface 150 of the insert 140 that are spaced equidistant from one another.

The insert 140 can further comprise one or more grooves 158. The one or more grooves 158 can be positioned on the rear surface 152 of the insert 140. In some embodiments the one or more grooves 158 can be positioned on the front surface 150. In other embodiments, the one or more grooves 158 can be positioned on a combination of the front surface 150 of the insert 140 and the rear surface 152 of the insert 140. The one or more grooves 158 can receive one or more protrusions (not shown) from the insert cavity 122 to secure the insert 140. The one or more protrusions of the insert cavity 122 and the one or more grooves 158 of the insert 140 have complementary geometries to allow for a mechanical interlock. In addition to the mechanical interlock between the one or more protrusions, and the one or more grooves 158, the insert 140 can be secured within the insert cavity 122 with a press-fit, a friction fit, an adhesive, or any combination thereof. In some embodiments, the insert 140 can be secured within the insert cavity 122 without the use of threads. The structural interlock between the one or more protrusions and the one or more grooves 158 secures the insert 140 within the insert cavity 122, lowering the likelihood of the insert 140 dislodging during use.

The insert 140 can further comprise one or more ribs 154. The one or more ribs 154 can be positioned on the rear surface 152 of the insert 140. In some embodiments, the one or more ribs 154 can be positioned on the front surface 150. In other embodiments, the one or more ribs 154 can be positioned on the front surface 150, the rear surface 152, the heel surface 148, the toe surface 144, or any combination thereof. In some embodiments, the one or more ribs 154 can be positioned near the heel surface 148 or near the toe surface 144 on the insert 140. Furthermore, the one or more ribs 154 can be orientated perpendicular (straight up and down) relative to the top surface 142 of the insert 140. In other embodiments, the one or more ribs 154 can be orientated at various angles relative to top surface 142. In some embodiments, the insert 140 can comprise one, two, three, four, five, six, seven, eight, nine, ten, eleven, or twelve ribs 154. In some embodiments, the one or more ribs 154 are oriented in the same direction. In other embodiments, the one or more ribs 154 are oriented in different directions than the other one or more ribs 154. In embodiments with more than one rib 154, the ribs 154 can be spaced equidistant from one another, or spaced any distance from one another. In some embodiments, an adhesive is applied within the insert cavity 122 to help secure the insert 140. The combination of the adhesive and the one or more ribs 154 prevents the insert 140 from shifting within the insert cavity 122. In many embodiments, the one or more ribs 154 allow for the insert 140 to compress as it is being positioned within the insert cavity 122.

d) Rear Cavity

Referring to FIGS. 2 and 4, the club head 100 is a perimeter-weighted club head 100 comprising a rear cavity 160. In the present embodiment, the rear cavity 160 is bounded, at least partially, by the top rail 120, the heel portion 106, the toe portion 110, and the rear wall 114. In the present embodiment, a top rail rear edge 186, a heel rear edge 188, a toe rear edge 190, and the rear wall top edge 134 form a rear perimeter 182 circumscribing the rear cavity 160. As such, in the present embodiment, the rear cavity 160 is positioned above both the rear wall 114 and the insert cavity 122. Referring to FIG. 4, the rear cavity 160 forms a rear cavity opening 164 located above the rear wall 114 and formed between the top rail rear edge 186 and the rear wall top edge 134. The rear cavity 160 extends inward from the exterior of the club head, from the rear cavity opening 164 to a back face upper portion 162.

In many embodiments, the volume of the rear cavity 160 can range between 0.4 $in^3$ and 0.8 $in^3$. In other embodiments, the volume of the rear cavity 160 can range inclusively between 0.4 $in^3$ and 0.5 $in^3$, 0.5 $in^3$ and 0.6 $in^3$, 0.6 $in^3$ and 0.7 $in^3$, or between 0.7 $in^3$ and 0.8 $in^3$. In some embodiments, the volume of the rear cavity can be approximately 0.4 $in^3$, 0.5 $in^3$, 0.6 $in^3$, 0.7 $in^3$, or 0.8 $in^3$. In some embodiments, the volume of the rear cavity 160 can be greater than 0.4 $in^3$. In some embodiments, the volume of the rear cavity 160 can be greater than 0.5 $in^3$. In some embodiments, the volume of the rear cavity 160 can be greater than 0.6 $in^3$. In some embodiments, the volume of the rear cavity 160 can be greater than 0.7 $in^3$. In some embodiments, the volume of the rear cavity 160 can be greater than 0.8 $in^3$.

The inclusion of the rear cavity 160 provides the club head 100 with a perimeter-weighted, cavity-back construction. The rear cavity 160 shifts mass away from the center of gravity 199 and towards the periphery of the club head 100. This peripheral shift of mass increases the MOI and forgiveness of the club head 100. As a result, the club head 100 can be more forgiving than a muscle-back style iron or another iron devoid of a rear cavity.

e) Moment of Inertia

The club head 100 has a moment of inertia about the X-axis 5000 (herein referred to as Ixx). Wherein the moment of inertia about the X-axis 5000, Ixx, can range from 80 $g{\cdot}in^2$ to 160 $g{\cdot}in^2$. The X-axis 5000 extends through the head center of gravity 199 from the heel portion 106 to the toe portion 110 of the club head 100. In other embodiments, the club head 100 can have a moment of inertia about the X-axis 5000, Ixx, ranging from 80 $g{\cdot}in^2$ to 120 $g{\cdot}in^2$, 120 $g{\cdot}in^2$ to 140 $g{\cdot}in^2$, or 140 $g{\cdot}in^2$ to 160 $g{\cdot}in^2$. For example, the moment of inertia about the X-axis 5000 can be 80 $g{\cdot}in^2$, 100 $g{\cdot}in^2$, 120 $g{\cdot}in^2$, 140 $g{\cdot}in^2$, or 160 $g{\cdot}in^2$. In some embodiments, the club head 100 can have a moment of inertia about the X-axis 5000, Ixx, greater than 80 $g{\cdot}in^2$. In some embodiments, the club head 100 can have a moment of inertia about the X-axis 5000, Ixx, greater than 90 $g{\cdot}in^2$. In some embodiments, the club head 100 can have a moment of inertia about the X-axis 5000, Ixx, greater than 100 $g{\cdot}in^2$. In some embodiments, the club head 100 can have a moment of inertia about the X-axis 5000, Ixx, greater than 110 $g{\cdot}in^2$. In some embodiments, the club head 100 can have a moment of inertia about the X-axis 5000, Ixx, greater than 120 $g{\cdot}in^2$. In some embodiments, the club head 100 can have a moment of inertia about the X-axis 5000, Ixx, greater than 130 $g{\cdot}in^2$. In some embodiments, the club head 100 can have a moment of inertia about the X-axis 5000, Ixx, greater than 140 $g{\cdot}in^2$. In some embodiments, the club head 100 can have a moment of inertia about the X-axis 5000, Ixx, greater than 150 $g{\cdot}in^2$.

In some embodiments, the club head 100 can have a moment of inertia about the X-axis 5000, Ixx, greater than 160 g·in$^2$.

The club head 100 has a moment of inertia about the Y-axis 6000 (herein referred to as Iyy). Wherein the moment of inertia about the Y-axis 6000, Iyy, can range from 390 g·in$^2$ to 500 g·in$^2$. The Y-axis 6000 extends through the head center of gravity 199 from the top rail 120 to the sole 118 of the club head 100. In other embodiments, the club head 100 can have a moment of inertia about the Y-axis 6000 ranging from 390 g·in$^2$ to 420 g·in$^2$, 420 g·in$^2$ to 460 g·in$^2$, or 460 g·in$^2$ to 500 g·in$^2$. For example, the moment of inertia about the Y-axis 6000 can be 390 g·in$^2$, 410 g·in$^2$, 420 g·in$^2$, 430 g·in$^2$, 440 g·in$^2$, 450 g·in$^2$, 460 g·in$^2$, 470 g·in$^2$, 480 g·in$^2$, 490 g·in$^2$, or 500 g·in$^2$. In some embodiments, the club head 100 can have a moment of inertia about the Y-axis 6000, Iyy, greater than 390 g·in$^2$. In some embodiments, the club head 100 can have a moment of inertia about the Y-axis 6000, Iyy, greater than 390 g·in$^2$. In some embodiments, the club head 100 can have a moment of inertia about the Y-axis 6000, Iyy, greater than 400 g·in$^2$. In some embodiments, the club head 100 can have a moment of inertia about the Y-axis 6000, Iyy, greater than 410 g·in$^2$. In some embodiments, the club head 100 can have a moment of inertia about the Y-axis 6000, Iyy, greater than 420 g·in$^2$. In some embodiments, the club head 100 can have a moment of inertia about the Y-axis 6000, Iyy, greater than 430 g·in$^2$. In some embodiments, the club head 100 can have a moment of inertia about the Y-axis 6000, Iyy, greater than 440 g·in$^2$. In some embodiments, the club head 100 can have a moment of inertia about the Y-axis 6000, Iyy, greater than 450 g·in$^2$. In some embodiments, the club head 100 can have a moment of inertia about the Y-axis 6000, Iyy, greater than 460 g·in$^2$. In some embodiments, the club head 100 can have a moment of inertia about the Y-axis 6000, Iyy, greater than 470 g·in$^2$. In some embodiments, the club head 100 can have a moment of inertia about the Y-axis 6000, Iyy, greater than 480 g·in$^2$. In some embodiments, the club head 100 can have a moment of inertia about the Y-axis 6000, Iyy, greater than 490 g·in$^2$. In some embodiments, the club head 100 can have a moment of inertia about the Y-axis 6000, Iyy, greater than 500 g·in$^2$.

In many embodiments, the club head 100 comprises a blade length 2100. Wherein the blade length 2100 ranges between 2.5 inches and 3.0 inches. The blade length 2100 can be between 2.5 inches to 2.6 inches, 2.6 inches, to 2.7 inches, 2.8 inches to 2.9 inches, or 2.9 inches to 3.0 inches. The blade length 2100 can be less than 3.0 inches, less than 2.9 inches, less than 2.8 inches, less than 2.7 inches, less than 2.6 inches, or less than 2.5 inches. The blade length 2100 can be greater than 2.5 inches, greater than 2.6 inches, greater than 2.7 inches, greater than 2.8 inches, greater than 2.9 inches, or greater than 3.0 inches. In many embodiments, the blade length 2100 of the club head 100 can be less than the blade length of a typical prior art cavity-back iron.

The club head 100 can comprise a ratio of Iyy moment of inertia about the Y-axis 6000 to blade length 2100. Wherein the ratio is calculated by taking Iyy the moment of inertia about the Y-axis 6000 by the blade length 2100 of the club head 100. The ratio of Iyy to blade length 2100 characterizes the forgiveness of the club head 100 with respect to the size of the club head 100. Wherein the ratio of Iyy to blade length 2100 ranges between 100 grams·inches (g·in) and 200 g·in. In some embodiments, the ratio of Iyy to blade length 2100 ranges between 120 g·in to 180 g·in. In some embodiments, the ratio ranges between 130 g·in to 180 g·in. In some embodiments, the ratio of Iyy to blade length 2100 ranges between 130 g·in to 200 g·in. In some embodiments, the ratio of Iyy to blade length 2100 is greater than 100 g·in, greater than 110 g·in, greater than 120 g·in, greater than 130 g·in, greater than 140 g·in, greater than 150 g·in, greater than 160 g·in, greater than 170 g·in, greater than 180 g·in, greater than 190 g·in, or greater than 200 g·in.

f) Central Support Bar

Referring to FIG. 2, the club head 100 comprises a central support bar 116 located on the back face 104. The central support bar 116 comprises an area of increased thickness extending from the back face 104 and into the rear cavity 160. The central support bar 116 provides structural reinforcement to certain areas of the strike face 102 and allows other areas of the strike face 102 to be thinned. In many embodiments, such as the embodiment of FIG. 2, the central support bar 116 is formed on the back face upper portion 162. In other embodiments (not shown), the central support bar 116 can additionally form at least a portion of the back face lower portion 132.

The central support bar 116 comprises a thickness characterized by the distance that the central support bar 116 extends into the rear cavity 160 relative to the back face 104. In many embodiments, the thickness of the central support bar 116 can range between 0.01 inch and 0.10 inch. In many embodiments, the thickness of the central support bar 116 can range inclusively between 0.01 inch and 0.025 inch, 0.025 inch and 0.05 inch, 0.05 inch and 0.075 inch, or between 0.075 inch and 0.10 inch. In some embodiments, the thickness of the central support bar 116 can be approximately 0.01 inch, 0.02 inch, 0.03 inch, 0.04 inch, 0.05 inch, 0.06 inch, 0.07 inch, 0.08 inch, 0.09 inch, or approximately 0.10 inch.

Referring to FIG. 7, In some embodiments, the central support bar 116 comprises a central support bar width 2350 extending in a heel-to-toe direction. In many embodiments, the central support bar width 2350 can increase in a top rail-to-sole direction. In other embodiments, the central support bar width 2350 can be substantially constant or the central support bar width 2350 can decrease in a top rail-to-sole direction.

In many embodiments, the central support bar 116 is centrally located on the back face 104 to provide structural reinforcement areas of the strike face 102 where impact forces are the greatest. Providing structural reinforcement in a central area of the strike face 102 allows other areas of the strike face 102 to be thinned, thus increasing ball speed without sacrificing structural integrity.

g) Badge

Figure 3:
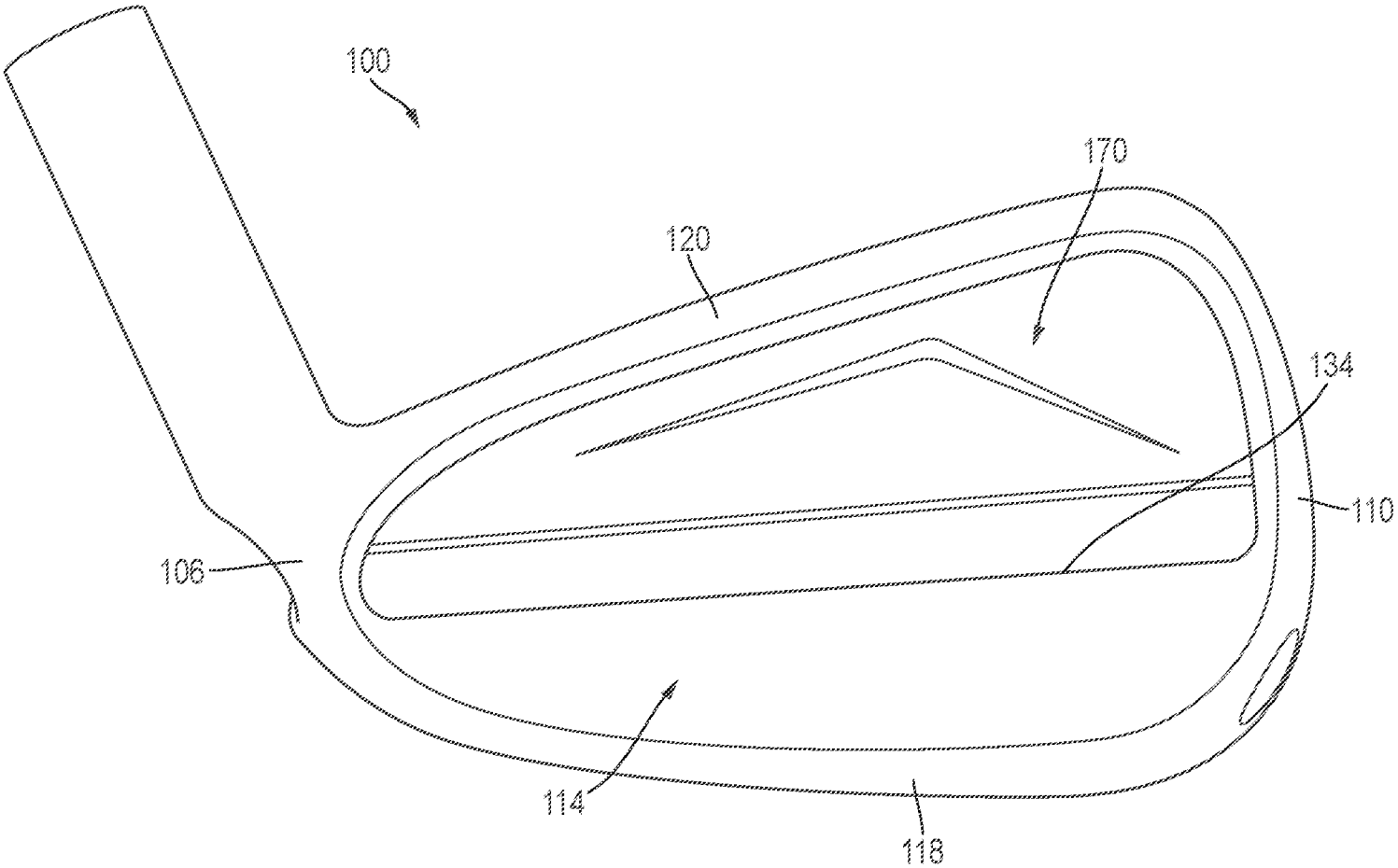
FIG. 3 illustrates a rear view of the golf club head of FIG. 1 comprising a badge.

As illustrated by FIGS. 3 and 5A, the rear cavity 160 is configured to receive a badge 170 to damp vibrations within the club head 100. The badge 170 comprises viscoelastic properties and a relatively high mass (compared to prior art badges or medallions), both of which contribute to the ability of the badge 170 to damp vibrations and produce a club head 100 with desirable sound and feel. The badge 170 can be housed within the rear cavity 160 and coupled to the back face upper portion 162. The badge 170 can serve to damp vibrations occurring at or near the back face upper portion 162 including vibrations occurring in the strike face 102 and/or the top rail 120.

In many embodiments, the badge 170 comprises a contact area defined between badge 170 and the back face upper portion 162. In many embodiments, the contact area between the badge 170 and the back face upper portion 162 can range between 2.0 in$^2$ and 3.0 in$^2$. In some embodiments, the contact area between the badge 170 and the back face upper portion 162 can be between 2.0 in$^2$ and 2.1 in$^2$, between 2.1 in$^2$ and 2.2 in$^2$, between 2.2 in$^2$ and 2.3 in$^2$, between 2.3 in$^2$ and 2.4 in$^2$, between 2.4 in$^2$ and 2.5 in$^2$, between 2.5 $in^2$ and 2.6 $in^2$, between 2.6 $in^2$ and 2.7 $in^2$, between 2.7 $in^2$ and 2.8 $in^2$, between 2.8 $in^2$ and 2.9 $in^2$, or between 2.9 $in^2$ and 3.0 $in^2$. In some embodiments, the contact area between the insert front surface 150 and the back face lower portion 132 is greater than 2.0 $in^2$, greater than 2.1 $in^2$, greater than 2.2 $in^2$, greater than 2.3 $in^2$, greater than 2.4 $in^2$, greater than 2.5 $in^2$, greater than 2.6 $in^2$, greater than 2.7 $in^2$, greater than 2.8 $in^2$, greater than 2.9 $in^2$, or greater than 3.0 $in^2$.

Referring to FIG. 3, the badge 170 is configured to visually fill the rear cavity 160 to provide the club head 100 with the appearance of a solidly constructed iron, such as a forged or muscle-back iron. In many embodiments, the badge 170 can fill between 75% and 99% of the volume of the rear cavity 160. In many embodiments, the badge 170 can fill between 75% and 80%, 80% and 85%, 85% and 90%, 90% and 95%, or between 95% and 99% of the volume of the rear cavity 160. In some embodiments, the badge 170 can fill greater than 75%, greater than 80%, greater than 85%, greater than 90%, greater than 95%, or greater than 99% of the volume of the rear cavity 160.

Referring to FIG. 5A, the badge 170 comprises a badge thickness 2300 measured from the inner-most surface of the badge 170 to an outer-most surface. In many embodiments, the badge thickness 2300 can increase from the badge top edge 172 to the badge bottom edge 174. The increase in badge thickness 2300 can roughly correspond to the contour of the club head 100, wherein the thickness of the club head 100 generally increases from the top rail 120 to the sole 118. In many embodiments, the badge thickness 2300 at or near the badge top edge 172 can be substantially similar to the distance between the back face 104 and the top rail rear edge 186. In many embodiments, the badge thickness 2300 at or near the badge bottom edge 174 can be substantially similar to the distance between the back face 104 and the rear wall top edge 134. Matching the badge thickness 2300 to the geometry of the club head 100 allows the badge 170 to visually fill the rear cavity 160 and provide the club head 100 with the appearance of a muscle-back iron.

In many embodiments, the badge thickness 2300 can range between 0.05 inch and 0.80 inch. In many embodiments, the badge thickness 2300 can range inclusively between 0.05 inch and 0.15 inch, 0.15 inch and 0.30 inch, 0.30 inch and 0.45 inch, 0.45 inch and 0.60 inch, 0.60 inch 0.70 inch, or between 0.70 inch and 0.80 inch. In some embodiments, the badge thickness 2300 can be approximately 0.05 inch, 0.10 inch, 0.15 inch, 0.20 inch, 0.25 inch, 0.30 inch, 0.35 inch, 0.40 inch, 0.45 inch, 0.50 inch, 0.55 inch, 0.60 inch, 0.65 inch, 0.70 inch, 0.75 inch, or approximately 0.80 inch.

In some embodiments, the badge 170 may be slightly recessed with respect to the rear perimeter 182. For example, the badge thickness 2300 near the badge top edge 172 can be slightly less than the distance between the back face 104 and the top rail rear edge 186, and the badge thickness 2300 near the badge bottom edge 174 can be slightly less than the distance between the back face 104 and the rear wall top edge 134. As such, the outer-most surface of the badge 170 can be slightly recessed within the rear cavity 160. Recessing the badge 170 within the rear cavity 160 protects the surface of the badge 170 from damage while still allowing the badge to visually fill the rear cavity 160.

In many embodiments, the badge 170 can comprise one or more layers. In some embodiments, the badge 170 can comprise one or more adhesive layers 176, one or more filler layers 180, one or more rigid layers 178, or any combination thereof. In the embodiment of FIG. 5A, the badge 170 includes an adhesive layer 176 in contact with the back face upper portion 162, a rigid layer 178 opposite the adhesive layer 176 and exposed to the rear exterior of the club head 100, and a filler layer 180 disposed between the adhesive layer 176 and the rigid layer 178. The adhesive layer 176 forms the inner-most surface of the badge 170 and serves to secure the badge 170 to the back face 104 as well as assist in the damping of vibrations. The filler layer 180 can serve to increase the thickness of the badge 170 to allow the badge 170 to visually fill the rear cavity 160 without significantly contributing to the mass of the badge 170 and compromising the mass properties of the club head 100. The rigid layer 178 forms the outer-most surface of the badge 170 and serves to protect the badge 170 from damage, such as scratching or denting.

In many embodiments, the adhesive layer 176 comprises both adhesive and damping properties. In many embodiments, the adhesive layer 176 can comprise a viscoelastic material. In many embodiments, the adhesive layer 176 can be a foam-based very high bond tape (e.g. VHB tape). In many embodiments, the adhesive layer 176 can be a tape or other adhesive material with viscoelastic properties. In many embodiments, the adhesive layer 176 can comprise a polymeric material, a resin material, an elastomeric material, or any other material suitable of both adhering the badge 170 to the back face 104 and damping vibrations.

In many embodiments, the adhesive layer 176 can comprise a thickness ranging between 0.02 inch and 0.08 inch. In many embodiments, the adhesive layer 176 can comprise a thickness ranging inclusively between 0.02 inch and 0.03 inch, 0.03 inch and 0.04 inch, 0.04 inch and 0.05 inch, 0.05 inch and 0.06 inch, 0.06 inch and 0.07 inch, or 0.07 inch and 0.08 inch. In some embodiments, the adhesive layer can comprise a thickness of approximately 0.02 inch, 0.03 inch, 0.04 inch, 0.05 inch, 0.06 inch, 0.07 inch, or 0.08 inch.

If the adhesive layer 176 is not sufficiently thick, the connection between the badge 170 and the back face 104 may not be durable, and the badge 170 may become decoupled from the back face 104 during impact. If the adhesive layer 176 is too thick, flexure of the strike face 102 may be restricted and ball speed may be reduced. The thickness of the adhesive layer 176 is designed to provide a secure connection between the badge 170 and the back face 104 without negatively impacting ball speed.

In many embodiments, the adhesive layer 176 can be the only portion of the badge 170 in contact with the back face 104. In such embodiments, the adhesive layer 176 comprises the entire contact area between the badge 170 and the back face upper portion 162. In such embodiments, the adhesive layer 176 is the primary contributor to the damping properties of the badge 170. Providing the greatest possible contact area between the adhesive layer 176 and the back face upper portion 162 can provide the greatest vibration damping benefit and the strongest connection between the badge 170 and the back face 104. In other embodiments, one or more other layers (such as the filler layer 180 and/or the rigid layer 178) can form a portion of the contact area between the badge 170 and the back face 104.

In many embodiments, the adhesive layer 176 can be the only portion of the badge 170 that contacts any portion of the club head 100. In such embodiments, the adhesive layer 176 is solely responsible for securing the badge 170 to the club head 100. In such embodiments, neither the club head 100 nor the badge 170 comprise any additional retaining features to secure the badge 170 to the club head 100.

In many embodiments, the filler layer 180 can comprise a lightweight material that allows the thickness of the badge 170 to be increased without adding a significant amount of mass. In some embodiments, the filler layer 180 can comprise viscoelastic or other damping properties to assist in the damping of vibrations in the club head 100. In many embodiments, the filler layer 180 can be a viscoelastic polymer configured to dissipate vibrations by converting kinetic energy into heat. The filler layer 180 can comprise any viscoelastic polymer or material such as an elastomer, butyl rubber, silicone rubber, a thermoplastic elastomer (TPE), thermoplastic polyurethane (TPU), or other suitable material with viscoelastic properties. In other embodiments, the filler layer 180 can comprise a foam material, a composite material, a plastic material or any other suitable, lightweight material.

In many embodiments, the rigid layer 178 is formed of a relatively hard, protective material. In many embodiments, the rigid layer 178 can be a metallic material such as steel, a steel alloy, aluminum, an aluminum alloy, titanium, a titanium alloy, or any other suitable material or alloy. In some embodiments, the rigid layer 178 can be 304 stainless steel, 17-4 stainless steel, 606 aluminum, 7071 aluminum, 6061 aluminum, or any other suitable material.

In many embodiments, the rigid layer 178 can comprise a hardness between 80 HRB and 110 HRB. In some embodiments, the hardness of the rigid layer 178 can be between 80 HRB and 85 HRB, between 85 HRB and 90 HRB, between 90 HRB and 95 HRB, between 95 HRB and 100 HRB, between 100 HRB and 105 HRB, or between 105 HRB and 110 HRB. In many embodiments the hardness of the rigid layer 178 can be greater than 80 HRB, greater than 85 HRB, greater than 90 HRB, greater than 95 HRB, greater than 100 HRB, greater than 105 HRB, or greater than 110 HRB. In many embodiments, the hardness of the rigid layer 178 can range between 5 HRC and 35 HRC. In some embodiments, the hardness of the rigid layer 178 can be between 5 HRC and 10 HRC, between 10 HRC and 15 HRC, between 15 HRC and 20 HRC, between 25 HRC and 30 HRC, or between 30 HRC and 35 HRC. In some embodiments, the hardness of the rigid layer 178 can be greater than 5 HRC, greater than 10 HRC, greater than 15 HRC, greater than 20 HRC, greater than 25 HRC, greater than 30 HRC, or greater than 35 HRC. Providing a sufficient hardness allows the rigid layer 178, which forms the visual exterior of the badge 170, to be resistant to superficial and/or structural damage, such as scratching or denting.

In many embodiments, the rigid layer 178 can comprise a density ranging between 6.0 g/cm$^3$ and 10.0 g/cm$^3$. In many embodiments, the rigid layer 178 can comprise a density ranging inclusively between 6.0 g/cm$^3$ and 7.0 g/cm$^3$, 7.0 g/cm$^3$ and 8.0 g/cm$^3$, 8.0 g/cm$^3$ and 9.0 g/cm$^3$, or between 9.0 g/cm$^3$ and 10.0 g/cm$^3$. In some embodiments, the rigid layer 178 can comprise a density greater than 6.0 g/cm$^3$. In some embodiments, the rigid layer 178 can comprise a density greater than 7.0 g/cm$^3$. In some embodiments, the rigid layer 178 can comprise a density greater than 8.0 g/cm$^3$. In some embodiments, the rigid layer 178 can comprise a density greater than 9.0 g/cm$^3$. In some embodiments, the rigid layer 178 can comprise a density greater than 10.0 g/cm$^3$.

Providing a sufficient density increases the effectiveness with which the badge 170 can dampen vibrations in the club head 100 by increasing the mass damping abilities of the badge 170. The density of the rigid layer 178 can be designed to provide the badge 170 with sufficient mass to effectively damp vibrations without negatively impacting the mass characteristics of the club head 100.

Additionally, in some embodiments, a surface coating can be applied to the rigid layer 178 to further protect the badge 170. The surface coating can have scratch resistant properties that protect the exterior surface of the rigid layer 178. In many embodiments, the surface coating can can be a clear coating that protects the rigid layer 178 without affecting the aesthetic appearance of the badge 170.

The badge 170 further contributes to the club head 100 having the appearance of a muscle-back iron by concealing the insert 140 and the central support bar 116. Referring to FIG. 5A, the badge 170 can be configured to cover the insert cavity opening 124 and conceal the insert 140 within the insert cavity 122. The badge bottom edge 174 can be configured to extend over the insert cavity opening 124, covering the entire top surface 142 of the insert 140. Covering the insert cavity opening 124 and concealing the insert 140 within the insert cavity 122 allows the insert 140 to be hidden when viewing the exterior of the club head 100 (see FIG. 3). The badge 170 can be configured to substantially cover the entire back face upper portion 162, including the central support bar 116. As such, the central support bar 116 is hidden when viewing the exterior of the club head 100.

Figure 5B:
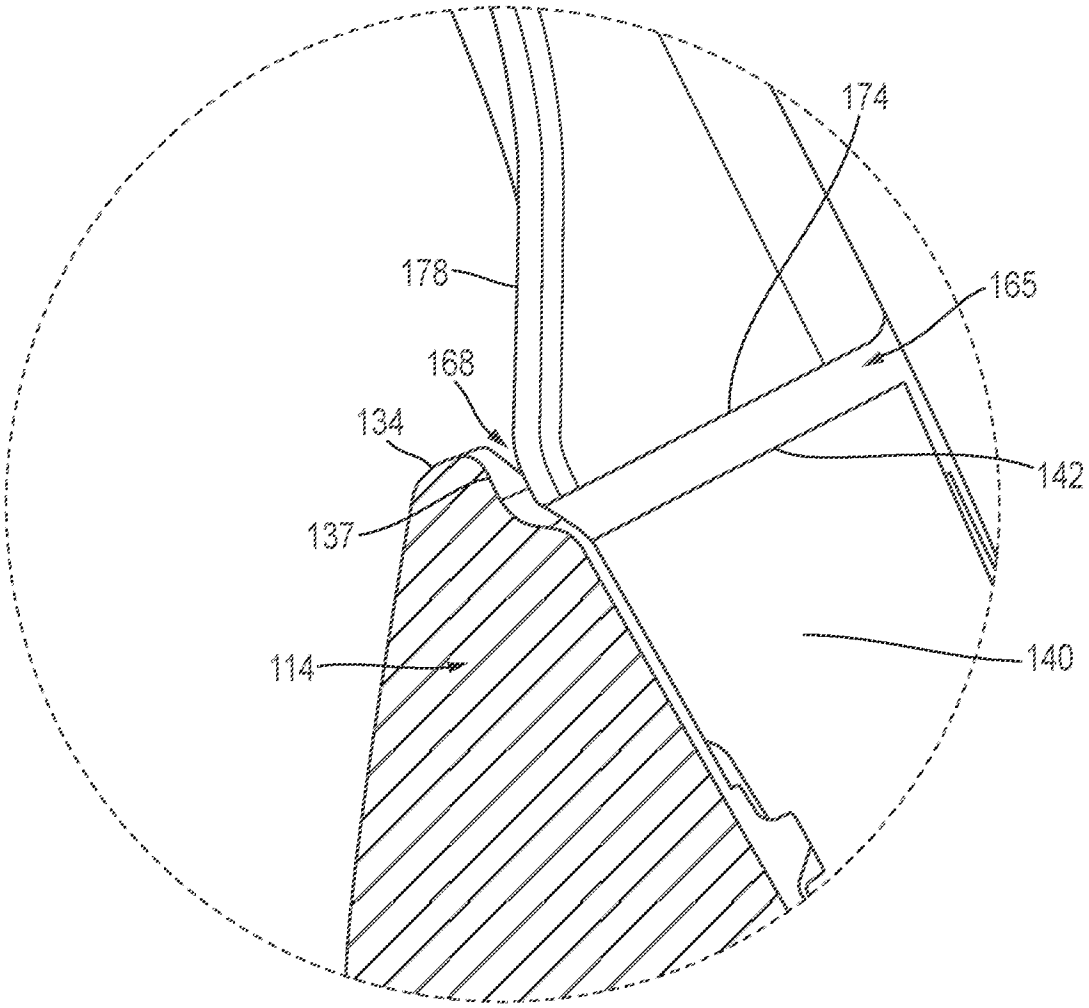
FIG. 5*b* illustrates a close-up cross section view from the toe side of the golf club head of FIG. 1 comprising an insert cavity, and insert, a rear cavity and a badge.

In many embodiments, the badge 170 does not contact the rear wall 114. As illustrated by FIG. 5B, a gap 168 can be formed between the rigid layer 178 and the rear wall lip 137. The gap 168 provides sufficient space between the badge 170 and the rear wall 114 so that as the club head 100 flexes at impact, the badge 170 does not collide with the rear wall 114. If a sufficient gap 168 were not provided, the collision between the badge 170 and the rear wall 114 at impact could damage the badge 170 or allow the badge 170 to separate entirely from the club head 100. The inclusion of the gap 168 increases the durability of the club head 100 by protecting the badge 170 and its connection to the back face 104. The inclusion of the gap 168 provides that the insert cavity 122 is not sealed off from the exterior of the club head 100.

Referring again to FIG. 5B, the insert 140 and the badge 170 can be spaced apart from one another, such that the insert 140 and the badge 170 do not contact one another. As such, a clearance gap 165 can be formed between the insert 140 and the badge 170. Specifically, the clearance gap 165 is formed between the badge bottom edge 174 and the insert top surface 142. The clearance gap 165 can provide a greater manufacturing tolerance for forming the insert 140 and/or the badge 170 so that the insert 140 and badge 170 do not contact and damage one another.

In many embodiments, the clearance gap 165 can range between 0.01 inch and 0.04 inch. In some embodiments, the clearance gap 165 can range inclusively between 0.01 inch and 0.02 inch, between 0.02 inch and 0.03 inch, or between 0.03 inch and 0.04 inch. In some embodiments, the clearance gap 165 can be approximately 0.01 inch, 0.015 inch, 0.02 inch, 0.025 inch, 0.03 inch, 0.035 inch, or approximately 0.04 inch.

h) Damping System

The insert 140 and the badge 170 combine to create a damping system that covers a large portion of back face 104 with material suitable for damping vibrations. Covering a large portion of the back face 104 with damping material provides a desirable sound and soft feel in the club head 100 at impact.

In many embodiments, the damping system can reduce the amplitude of undesirable vibrations by 40% or greater. In some embodiments, the damping system can reduce the amplitude of residual vibrations (which contribute to a ringing sound and reverberating feel) by greater than 10%, greater than 20%, greater than 30%, greater than 40%, greater than 50%, greater than 60%, or greater than 70%. In one example, the damping system can reduce the amplitude of a residual vibration from a magnitude of $1.3 \cdot 10^6$ to a magnitude of $7.8 \cdot 10^5$. In another example, the damping system can reduce the amplitude of a residual vibration from a magnitude of $6.0 \cdot 10^6$ to a magnitude of $2.5 \cdot 10^5$.

The interaction between the back face 104 and the damping system can be characterized by a damping system coverage area. The damping system coverage area is defined as the overall surface area of the back face 104 covered by the damping system. The damping system coverage area therefore can also be defined as the sum of the surface area of the insert 140 in contact with the back face 104 and the surface area of the badge 170 in contact with the back face 104.

In many embodiments, the damping system coverage area can be between 2.5 $in^2$ (1613 $mm^2$) and 5.0 $in^2$. In many embodiments, the damping system coverage area can range inclusively between 2.5 $in^2$ (1613 $mm^2$) and 3.0 $in^2$ (1935.5 $mm^2$), 3.0 $in^2$ (1935.5 $mm^2$) and 3.5 $in^2$ (2258 $mm^2$), 3.5 $in^2$ (2258 $mm^2$) and 4.0 $in^2$ (2580.6 $mm^2$), 4.0 $in^2$ (2580.6 $mm^2$) and 4.5 $in^2$ (2903.2 $mm^2$), or between 4.5 $in^2$ (2903.2 $mm^2$) and 5.0 $in^2$ (3225.8 $mm^2$). In many embodiments, the damping system coverage area can be greater than 2.5 $in^2$ (1613 $mm^2$). In some embodiments, the damping system coverage area can be greater than 3.0 $in^2$ (1935.5 $mm^2$). In some embodiments, the damping system coverage area can be greater than 3.5 $in^2$ (2258 $mm^2$). In some embodiments, the damping system coverage area can be greater than 4.0 $in^2$ (2580.6 $mm^2$). In some embodiments, the damping system coverage area can be greater than 4.5 $in^2$ (2903.2 $mm^2$). In some embodiments, the damping system coverage area can be greater than 5.0 $in^2$ (3225.8 $mm^2$).

In general, the damping system coverage area that can be provided is limited by the surface area of the back face 104 that is suitable to be contacted by the insert 140 and/or the badge 170. Referring to FIG. 7, the club head 100 comprises a back face available surface 2400 of the back face 104. The back face available surface 2400 is defined as any surface of the back face 104 that is exposed to the insert cavity 122 and/or the rear cavity 160. The back face available surface 2400 is formed by any surface of the back face 104 that is suitable to be contacted by the damping system. As illustrated by FIG. 7, portions of the sole 118, the heel portion 106, the toe portion 110, the heel mass 108, the toe mass 112, and the top rail 120 cover certain portions of the back face 104. The back face available surface 2400 occupies an area of the back face 104 that is not covered by any of the sole 118, the heel portion 106, the toe portion 110, the heel mass 108, the toe mass 112, or the top rail 120.

In many embodiments, the back face available surface 2400 comprises an area between 3.0 $in^2$ (19.4 $cm^2$) and 4.5 $in^2$ (29.0 $cm^2$). In many embodiments, the area of the back face available surface 2400 can be greater than 3.0 $in^2$ (19.4 $cm^2$). In some embodiments, the area of the back face available surface 2400 can be greater than 3.5 $in^2$ (22.6 $cm^2$). In some embodiments, the area of the back face available surface 2400 can be greater than 4.0 $in^2$ (25.8 $cm^2$). In some embodiments, the area of the back face available surface 2400 can be greater than 4.5 $in^2$ (29.0 $cm^2$). In many embodiments, the area of the back face available surface 2400 can be less than 4.5 $in^2$ (29.0 $cm^2$). In some embodiments, the area of the back face available surface 2400 can be less than 4.0 $in^2$ (25.8 $cm^2$). In some embodiments, the area of the back face available surface 2400 can be less than 3.5 $in^2$ (22.6 $cm^2$). In some embodiments, the area of the back face available surface 2400 can be less than 3.0 $in^2$ (19.4 $cm^2$).

The surface area of the back face available surface 2400 is dependent on the geometry and mass distribution of the club head 100. For example, the surface area of the back face available surface 2400 can depend on the face height 2050 and blade length 2100 of the club head 100. For example, a club head with a reduced face height and/or a reduced blade length may necessarily comprise a smaller back face available surface 2400 area due to the overall smaller size of the club head. The surface area of the back face available surface 2400 can also depend on the inclusion of certain perimeter weighting features, such as the heel mass 108 and/or the toe mass 112, as well as the shape and size of said features. In general, the further mass is allocated towards the perimeter of the club head 100, the greater the surface area of the back face available surface 2400 can be. In general, the larger the size of the heel mass 108 and/or the toe mass 112, the surface area of the back face available surface 2400 is reduced, as the heel mass 108 and the toe mass 112 each cover a portion of the back face 104.

As discussed above, the club head 100 can comprise a blade length 2100 less than the blade length of a typical cavity-back iron. The decreased blade length 2100 limits the size of the back face available surface 2400. However, the club head 100 also comprises a significant amount of perimeter weighting. The inclusion of the rear cavity 160 and the insert cavity 122 moves a significant amount of mass away from the center of gravity 199 and replaces said mass with the lightweight badge 170 and insert 140 housed within the rear cavity 160, and the insert cavity 122 respectively. The significant perimeter weighting of the club head 100 provides a large back face available surface 2400 area, despite the relatively short blade length 2100 and despite the fact that the club head 100 comprises a heel mass 108 and a toe mass 112 each covering a portion of the back face 104.

The amount of back face 104 coverage provided by the damping system can be characterized by the relationship between the area of the back face available surface 2400 and the damping system coverage area. In many embodiments, the damping system coverage area can be between 85% and 99% of the area of the back face available surface 2400. In some embodiments, the damping system coverage area can be between 85% and 87%, 87% and 89%, 89% and 91%, 91% and 93%, 93% and 95%, 95% and 97%, or between 97% and 99% of the area of the back face available surface 2400. In many embodiments, the damping system coverage area can be greater than 85% of the area of the back face available surface 2400. In some embodiments, the damping system coverage area can be greater than 90% of the area of the back face available surface 2400. In some embodiments, the damping system coverage area can be greater than 95% of the area of the back face available surface 2400. In some embodiments, the damping system coverage area can be greater than 99% of the area of the back face available surface 2400. In many embodiments, the damping system coverage area can be less than 99% of the area of the back face available surface 2400. In some embodiments, the damping system coverage area can be less than 95% of the area of the back face available surface 2400. In some embodiments, the damping system coverage area can be less than 90% of the area of the back face available surface 2400. In some embodiments, the damping system coverage area can be less than 85% of the area of the back face available surface 2400.

The amount of back face 104 coverage provided by the damping system can further be characterized by the relationship between the damping system coverage area and the scoring area. As discussed above, the region of the strike face 102 occupied by the plurality of score lines 105 defines a scoring area 194. In many embodiments, the scoring area 194 can range between 3.0 $in^2$ and 4.0 $in^2$. In many embodiments, the scoring area 194 can range inclusively between 3.0 $in^2$ and 3.2 $in^2$, 3.2 $in^2$ and 3.4 $in^2$, 3.4 $in^2$ and 3.6 $in^2$, 3.6 $in^2$ and 3.8 $in^2$, or between 3.8 $in^2$ and 4.0 $in^2$. In some embodiments, the scoring area 194 can be approximately 3.0 $in^2$, 3.2 $in^2$, 3.4 $in^2$, 3.6 $in^2$, 3.8 $in^2$, or approximately 4.0 $in^2$.

The club head 100 can define a projection (not shown) of the scoring area 194 on the back face 104. The projection corresponds to the location of the scoring area 194 such that the projection is the area of the back face 104 directly opposite the scoring area 194. In many embodiments, a portion of the damping system coverage area can overlap the projection. In many embodiments, the portion of the damping system coverage area that overlaps the projection can range between 2.0 $in^2$ and 3.5 $in^2$. In some embodiments, the portion of the damping system coverage area that overlaps the projection can be between 2.0 $in^2$ and 2.5 $in^2$, between 2.5 $in^2$ and 3.0 $in^2$, or between 3.0 $in^2$ and 3.5 $in^2$. In some embodiments, the portion of the damping system coverage area that overlaps the projection can be greater than 2.0 $in^2$, greater than 2.5 $in^2$, greater than 3.0 $in^2$, or greater than 3.5 $in^2$.

In many embodiments, the portion of the damping system coverage area that overlaps the projection can be between 75% and 99% of the surface area of the scoring area 194. In many embodiments, the portion of the damping system coverage area that overlaps the projection can range inclusively between 75% and 80%, 80% and 85%, 85% and 90%, 90% and 95%, or between 95% and 99% of the surface area of the scoring area 194. In further embodiments, the portion of the damping system coverage area that overlaps the projection can range inclusively between 75% and 85%, between 80% and 90%, between 85% and 95%, or between 75% and 95%. In many embodiments, the portion of the damping system coverage area that overlaps the projection can be greater than 75% of the surface area of the scoring area 194. In some embodiments, the portion of the damping system coverage area that overlaps the projection can be greater than 80% of the surface area of the scoring area 194. In some embodiments, the portion of the damping system coverage area that overlaps the projection can be greater than 85% of the surface area of the scoring area 194. In some embodiments, the portion of the damping system coverage area that overlaps the projection can be greater than 90% of the surface area of the scoring area 194. In some embodiments, the portion of the damping system coverage area that overlaps the projection can be greater than 95% of the surface area of the scoring area 194. In some embodiments, the portion of the damping system coverage area that overlaps the projection can be greater than 99% of the surface area of the scoring area 194. In many embodiments, the portion of the damping system coverage area that overlaps the projection can be less than 99% of the surface area of the scoring area 194. In some embodiments, the portion of the damping system coverage area that overlaps the projection can be less than 99% of the surface area of the scoring area 194. In some embodiments, the portion of the damping system coverage area that overlaps the projection can be less than 95% of the surface area of the scoring area 194. In some embodiments, the portion of the damping system coverage area that overlaps the projection can be less than 90% of the surface area of the scoring area 194. In some embodiments, the portion of the damping system coverage area that overlaps the projection can be less than 85% of the surface area of the scoring area 194. In some embodiments, the portion of the damping system coverage area that overlaps the projection can be less than 80% of the surface area of the scoring area 194. In some embodiments, the portion of the damping system coverage area that overlaps the projection can be less than 75% of the surface area of the scoring area 194.

The amount of back face 104 coverage provided by the damping system can further be characterized by the relationship between the damping system coverage area and the total surface area of the strike face 102. Referring to FIG. 1, the total surface area of the strike face 102 can be measured between the scoring area heel boundary 196 and the toe-most extent of the strike face 102. In many embodiments, the total surface area of the strike face 102 can range between 4.0 $in^2$ (2580.6 $mm^2$) and 5.5 $in^2$ (3548.4 $mm^2$). In many embodiments, the total surface area of the strike face 102 can range inclusively between 4.0 $in^2$ (2580.6 $mm^2$) and 4.5 $in^2$ (2903.2 $mm^2$), 4.5 $in^2$ (2903.2 $mm^2$) and 5.0 $in^2$ (3225.8 $mm^2$), or between 5.0 $in^2$ (3225.8 $mm^2$) and 5.5 $in^2$ (3548.4 $mm^2$). In some embodiments, the total surface area of the strike face 102 can be approximately 4.0 $in^2$ (2580.6 $mm^2$), 4.25 $in^2$ (2741.9 $mm^2$), 4.5 $in^2$ (2903.2 $mm^2$), 4.75 $in^2$ (3064.5 $mm^2$), 5.0 $in^2$ (3225.8 $mm^2$), 5.25 $in^2$ (3387.1 $mm^2$), or approximately 5.5 $in^2$ (3548.4 $mm^2$).

In many embodiments, the damping system coverage can be between 60% and 85% of the total surface area of the strike face. In many embodiments, the damping system coverage can range inclusively between 60% and 65%, 65% and 70%, 70% and 75%, 75% and 80%, or between 80% and 85% of the total surface area of the strike face. In some embodiments, the damping system coverage can range between 60% and 80%, 65% and 85%, 70% and 80%, or between 75% and 85% of the total surface area of the strike face. In some examples, the damping system coverage can be approximately 60%, 65%, 70%, 75%, 80%, or 85% of the total surface area of the strike face.

The club head 100 balances a high MOI with the ability to effectively damp vibrations. In general, the greater the damping system coverage area, the more effective the damping of club head vibrations. As discussed above, the damping system coverage area is limited by the back face available surface 2400 area. As discussed above, the club head 100 comprises a large back face available surface 2400 area, despite having a relatively short blade length 2100 and despite the fact that the club head 100 comprises a heel mass 108 and a toe mass 112 that cover a portion of the back face 104. To provide effective damping, the damping system covers the greatest amount of the back face available surface 2400 possible. Overall, the perimeter weighting of the club head 100 provides a high MOI while allowing for a significant damping system coverage area. The result is a club head with high forgiveness and the ability to damp vibrations by 40% or greater.

i) Top Rail Thickness

The damping system allows for the dissipation of unwanted vibrations at impact and provides the club head 100 with a desirable sound and feel. Additionally, the vibrational response of the club head 100 can be improved by increasing the mass in areas of the club head 100 where dominant vibrations occur. In many cavity-back irons, dominant vibrations occur in the top rail. Referring to FIG. 5A, the club head 100 can comprise a top rail 120 configured to damp dominant vibrations. The top rail 120 comprises a top rail thickness 2250 measured as a perpendicular distance between the strike face 102 and the top rail rear edge 186. In many embodiments, the top rail thickness 2250 can range between 0.15 inch and 0.30 inch. In some embodiments, the top rail thickness can range inclusively between 0.15 inch and 0.20 inch, 0.20 inch and 0.25 inch, or between 0.25 inch and 0.30 inch. In many embodiments, the top rail thickness 2250 can be greater than 0.15 inch. In some embodiments, the top rail thickness 2250 can be greater than 0.20 inch. In some embodiments, the top rail thickness 2250 can be greater than 0.25 inch. In some embodiments, the top rail thickness 2250 can be greater than 0.30 inch. The top rail thickness 2250 is designed to prevent dominant vibrations in the top rail 120 without compromising the mass properties of the club head 100 (e.g. MOI and/or CG position).

V. Club Head with Damping System and Recessed Rear Wall

Figure 8:
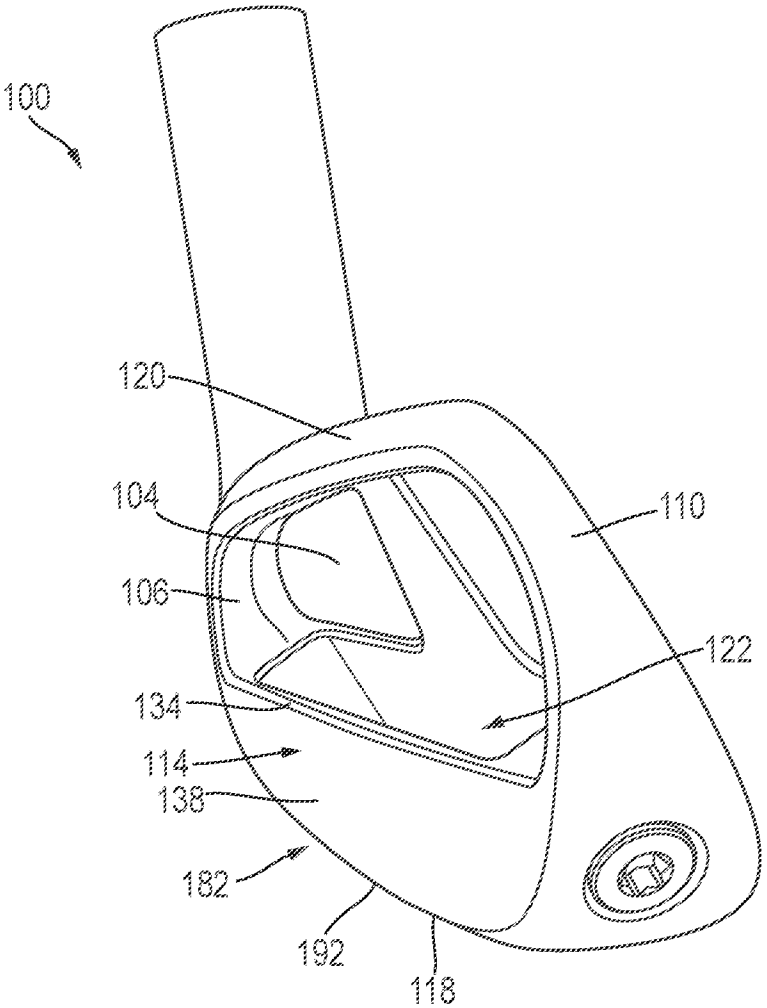
FIG. 8 illustrates a perspective view of the golf club head of FIG. 1.

In many embodiments, referring to FIG. 8, the rear wall 114 is located at the rear periphery of the club head 100. The rear wall 114 can be flush with a sole rear edge 192 of the sole 118. Providing the rear wall 114 flush with the sole rear edge 192 creates the appearance of the club head 100 as a muscle-back iron, despite the fact that the club head 100 comprises perimeter weighting, an insert cavity 122, and a rear cavity 160 (described in further detail below).

Figure 9:
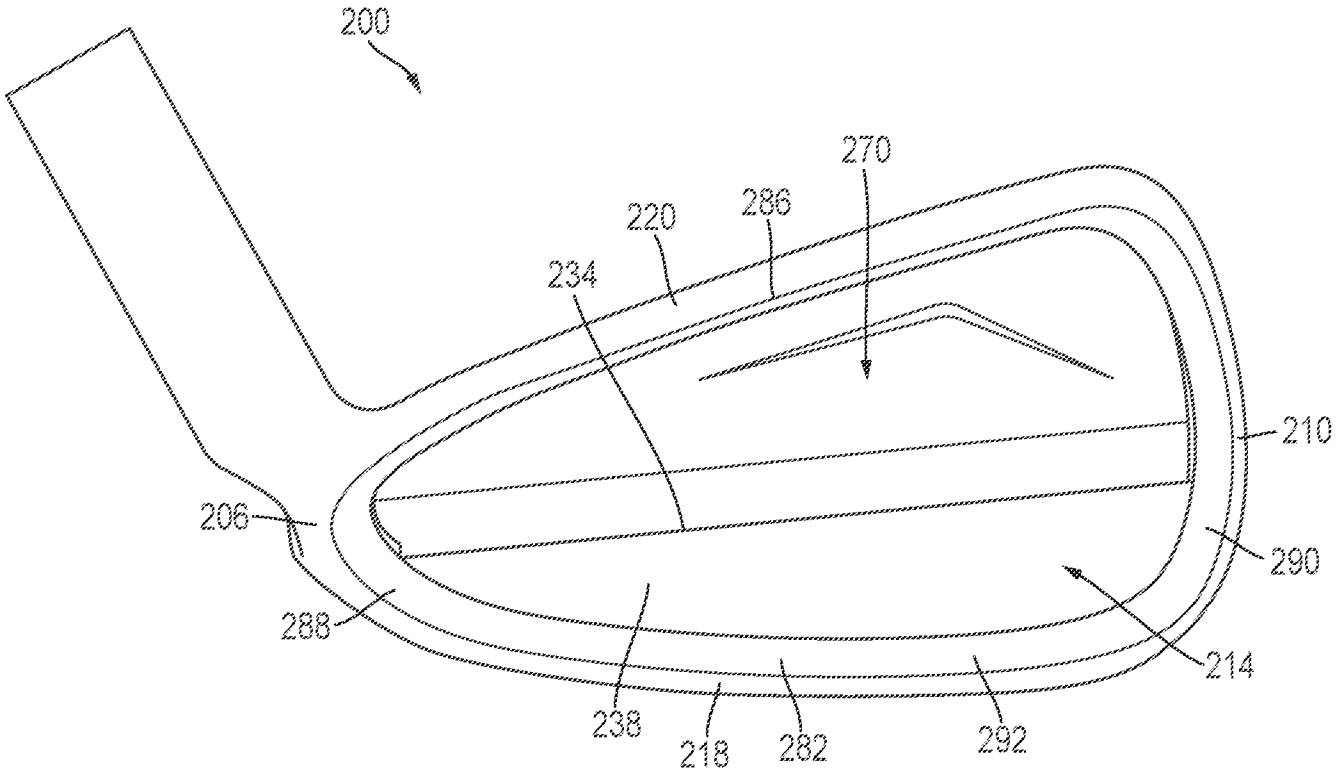
FIG. 9 illustrates a rear view of a golf club head according to a second embodiment.
Figure 10:
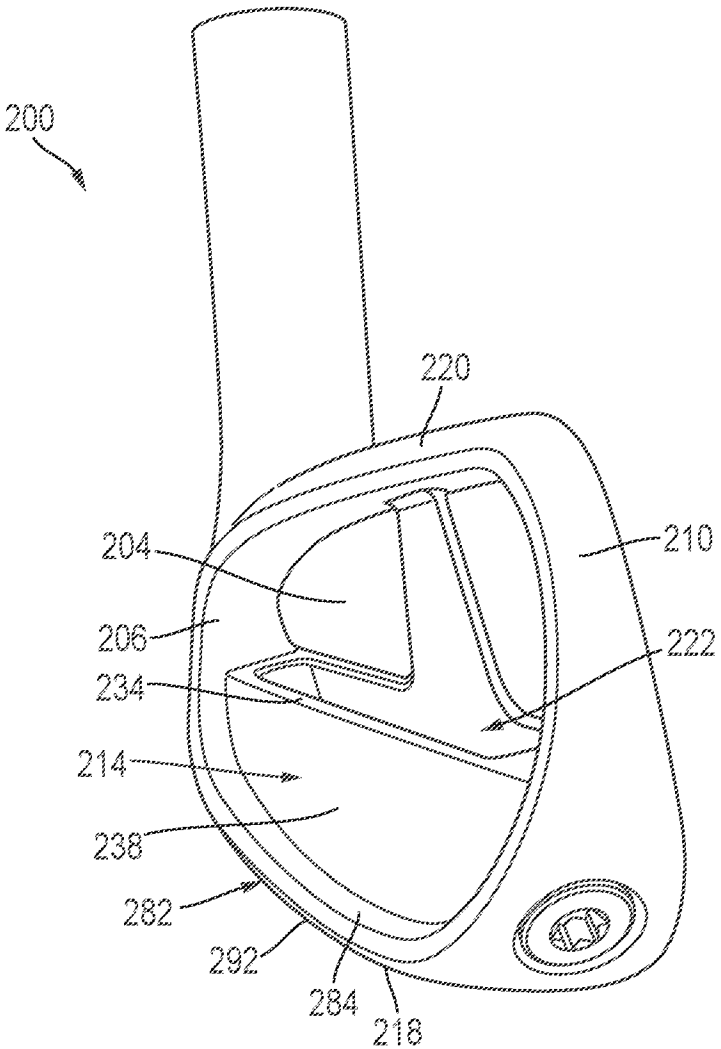
FIG. 10 illustrates a perspective view of the golf club head of FIG. 9.
Figure 11:
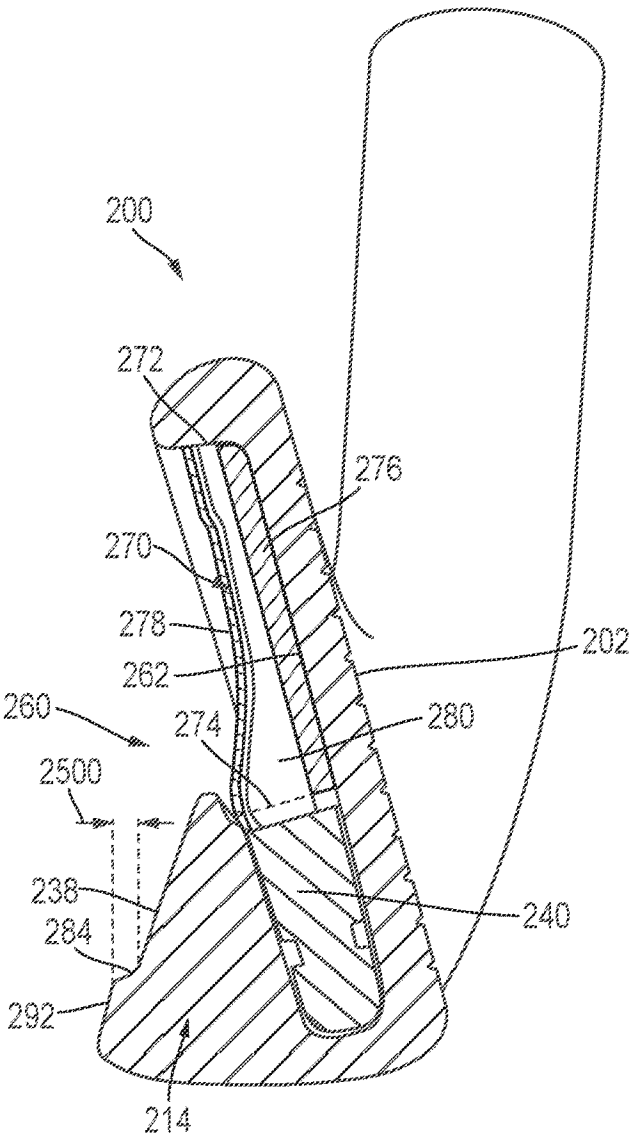
FIG. 11 illustrates a cross section view from the toe side of the golf club head of FIG. 9 comprising an insert cavity, an insert, a rear cavity, and a badge.

In alternative embodiments, the club head can comprise rear wall recessed with respect to the rear periphery, creating a club head with the appearance resembling a cavity-back iron. FIGS. 9-11 illustrate a second embodiment of a club head 200 according to the present invention with an alternative rear wall 214 design, wherein the rear wall 214 is recessed with respect to the rear periphery of the club head 200. Club head 200 can be substantially similar to club head 100, except for the differences described below, and like terms relating to club head 200 are numbered similar to those of club head 100, but with a 200 numbering scheme (e.g. club head 200 comprises a strike face 202, etc.)

In the present embodiment, the rear wall 214 can be recessed with respect to the rear periphery of the club head 200. As illustrated by FIG. 9, the rear perimeter 282 of the club head 200 is formed by the top rail rear edge 286, the heel rear edge 288, the toe rear edge 290, and the sole rear edge 292. As such, the rear perimeter 282 circumscribes the entire rear periphery of the club head 200. The rear perimeter 282 forms the boundary for the rear cavity 260. In contrast to rear cavity 160, which is bounded on the bottom by rear wall top edge 134 and sits above the rear wall 114 and the insert cavity 122, rear cavity 260 is bounded on the bottom by the sole rear edge 292 and extends over the entire rear periphery of the club head 200, from the top rail 220 to the sole 218.

Referring to FIG. 11, the offset of the rear wall 214 can be characterized by a rear wall offset distance 2500 measured between the sole rear edge 292 and the base of the rear wall 214. In many embodiments, the rear wall offset distance 2500 can range between 0.010 inch and 0.060 inch. In some embodiments, the rear wall offset distance 2500 can range between 0.010 inch and 0.020 inch, between 0.020 inch and 0.030 inch, between 0.030 inch and 0.040 inch, between 0.040 inch and 0.050 inch, or between 0.050 inch and 0.060 in. In some embodiments, the rear wall offset distance can be approximately 0.010 inch, 0.015 inch, 0.020 inch, 0.025 inch, 0.030 inch, 0.035 inch, 0.040 inch, 0.045 inch, 0.050 inch, 0.055 inch, or 0.060 inch.

Providing a rear perimeter 282 that circumscribes the entire periphery by recessing the rear wall 214 with respect to the sole rear edge 292 increases the perimeter weighting of the club head 200, therefore increasing MOI and producing a more forgiving club head 200. As mentioned above, recessing the rear wall 214 with respect to the sole rear edge 292 also increases the volume of the rear cavity 260. As illustrated by FIG. 9, the rear cavity 260 is more visually prominent than the rear cavity 160 of club head 100. In addition to providing a more forgiving club head by increasing the perimeter weighting of the club head 200, the visually enlarged rear cavity 260 provides the appearance of a more forgiving club head 200 in comparison to a club head with a less prominent rear cavity. This appearance of increased forgiveness increases the confidence of the golfer. The enlarged rear cavity 260 can be particularly beneficial in long irons (3-irons, 4-irons, 5-irons, etc.) with low loft angles, which are typically more difficult to hit straight.

VI. Club Head with Damping System and Apexed Rear Wall

Figure 12:
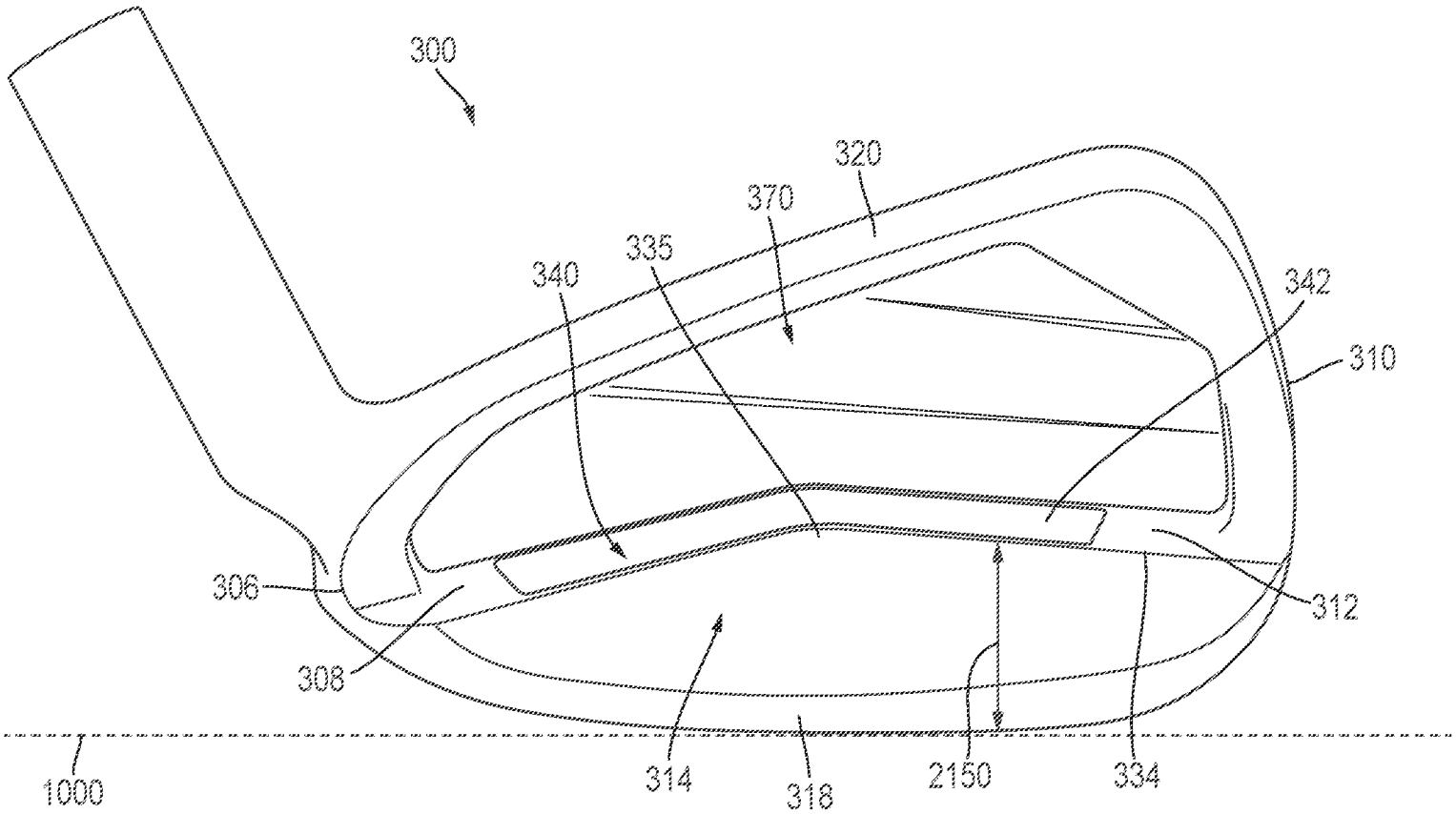
FIG. 12 illustrates a rear view of a golf club head according to a third embodiment.
Figure 13:
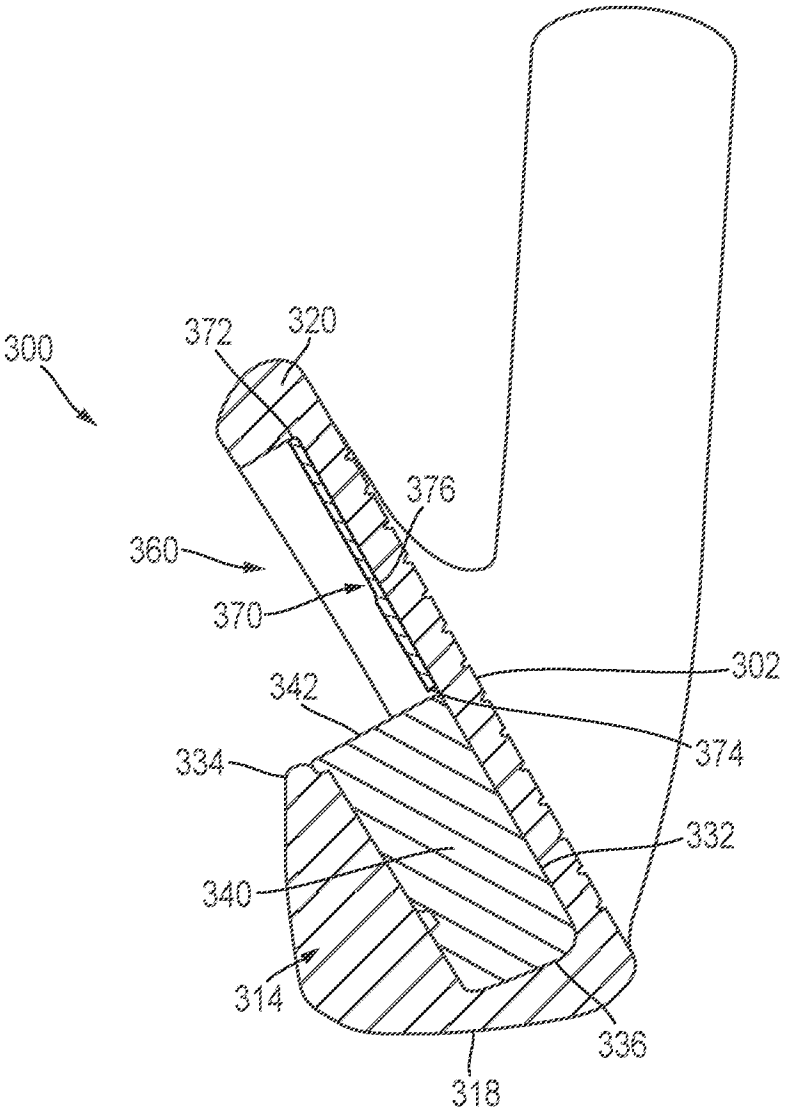
FIG. 13 illustrates a cross section view from the toe side of the golf club head of FIG. 12 comprising an insert cavity, an insert, a rear cavity, and a badge.

FIGS. 12 and 13 illustrate an embodiment of a club head 300 according to the present invention, wherein the rear wall 314 forms an apex 335. Referring to FIG. 12, the rear wall height 2150 varies in a heel to toe direction such that the rear wall height 2150 is greatest near the center of the club head 300 and smallest near the heel portion 306 and the toe portion 310. The rear wall top edge 334 forms the apex 335 at the point where the rear wall height 2150 is at a maximum. Club head 300 can be substantially similar to club head 100, except for the differences described below, and like terms relating to club head 300 are numbered similar to those of club head 100, but with a 300 numbering scheme (e.g. club head 300 comprises a strike face 302, etc.).

The shape of the insert cavity 322 can correspond to the shape of the apexed rear wall 314. The insert cavity 322 can be tallest and/or deepest near the apex 335 of the rear wall 314 and shortest and/or shallowest near the heel mass 308 and the toe mass 312. In many embodiments, the insert 340 can be shaped complementarily to the insert cavity 322 such that the insert 340 substantially fills the entire insert cavity 322 without overfilling the insert cavity 322. In such embodiments, as illustrated by FIG. 13, the top surface 342 of the insert 340 can be flush with the rear wall top edge 434. In such embodiments, the insert 340 can match the shape of the rear wall 314 in that the height of the insert 340 corresponds to the rear wall height 2150. The height of the insert 340 can be greatest near the center of the club head 300 and smallest near the heel mass 308 and the toe mass 312. In other embodiments (not shown), the insert 340 may not be shaped complementarily to the insert cavity 322. In such embodiments, the insert 340 can underfill the insert cavity 322 such that the insert top surface 342 is recessed within the insert cavity 322 or overfill the insert cavity 322 such that the insert 340 extends out of the insert cavity 322.

The apexed rear wall 314 and correspondingly shaped insert 340 illustrated in FIGS. 12 and 13 provides an increased contact area between the insert 340 and the back face lower portion 332. In some embodiments, the contact area between the insert 340 and the back face lower portion 332 can be greater than 0.8 $in^2$ (516.1 $mm^2$). In some embodiments, the contact area between the insert 340 and the back face lower portion 332 can be greater than 0.9 $in^2$ (580.6 $mm^2$). In some embodiments, the contact area between the insert 340 and the back face lower portion 332 can be greater than 1.0 $in^2$ (645.2 $mm^2$). In some embodiments, the contact area between the insert 340 and the back face lower portion 332 can be greater than 1.1 $in^2$ (709.7 $mm^2$). In some embodiments, the contact area between the insert 340 and the back face lower portion 332 can be greater than 1.2 $in^2$ (774.2 $mm^2$). Because the insert 340 is an effective vibration damper, increasing the contact area between the insert 340 and the back face lower portion 332 can more effectively damp vibrations in the club head 300, providing a club head 300 with a more desirable sound and feel.

In the embodiment illustrated in FIGS. 12 and 13, the badge 370 does not conceal the insert 340 within the insert cavity 322. The badge 370 can be disposed within the rear cavity 360, similar to the badges 170, 270 described in previous embodiments, except that the badge 370 does not substantially fill the rear cavity 360. In many embodiments, the badge thickness 2300 is reduced in comparison to the badges 170, 270 of previous embodiments. In such embodiments, the badge bottom edge 374 may cover only a portion of the insert top surface 342 or may not cover any portion of the insert top surface 342. Providing a badge 370 with a reduced badge thickness 2300 can create discretionary mass that can be allocated to other portions of the club head 300 to increase MOI, improve CG 399 position, or damp vibrations. Further, providing a badge 370 that does not visually fill the rear cavity 360 can create the appearance of a more forgiving club head 300 that increases the confidence of the golfer.

The apexed rear wall 314 can be combined with any insert or badge configuration described above or below, including a badge that substantially fills the rear cavity 360 and conceals the insert 340 within the insert cavity 322.

VII. Club Head with Damping System and Rear Wall Comprising a Nadir

Figure 14:
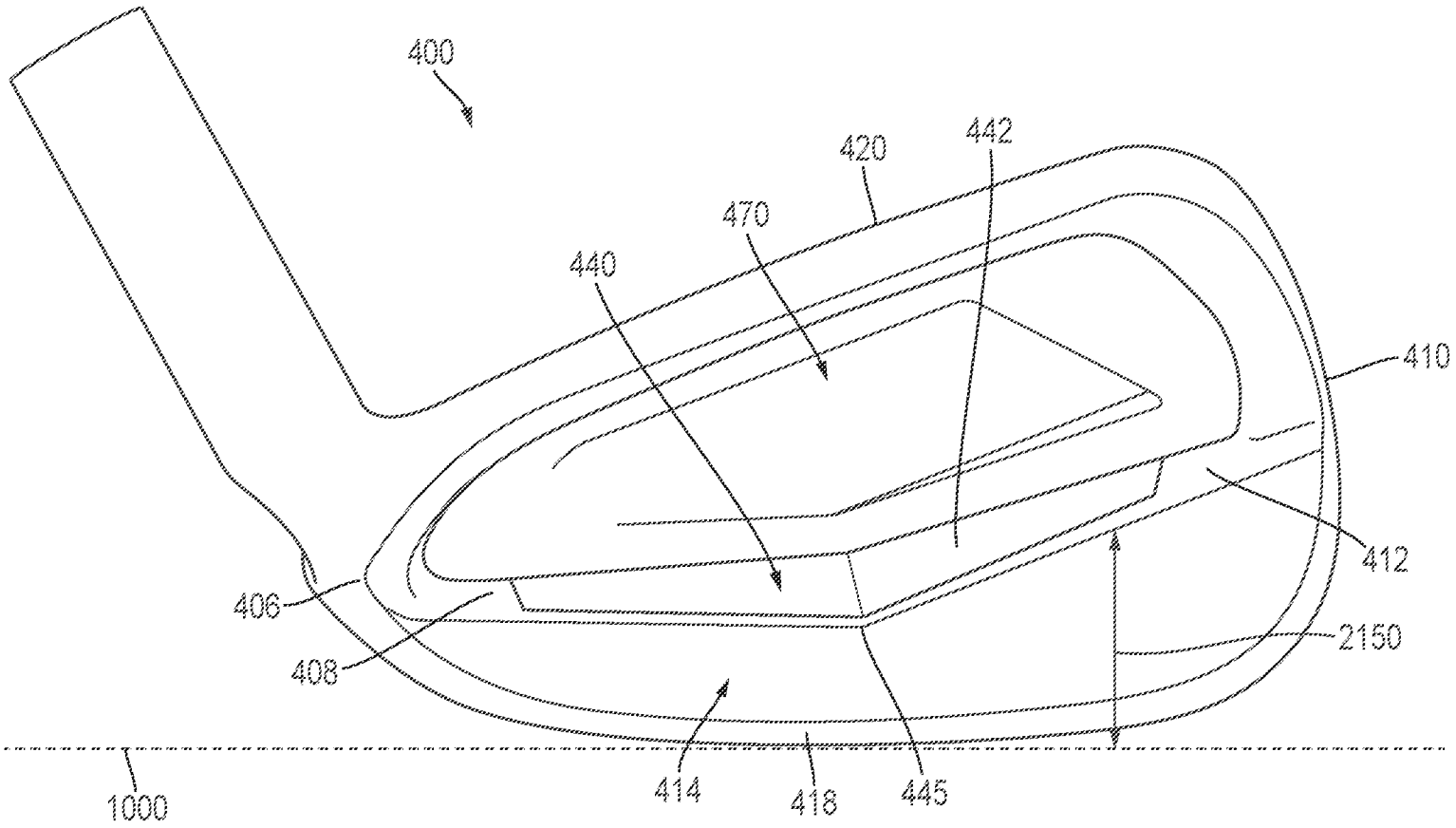
FIG. 14 illustrates a rear view of a golf club head according to a fourth embodiment.
Figure 15:
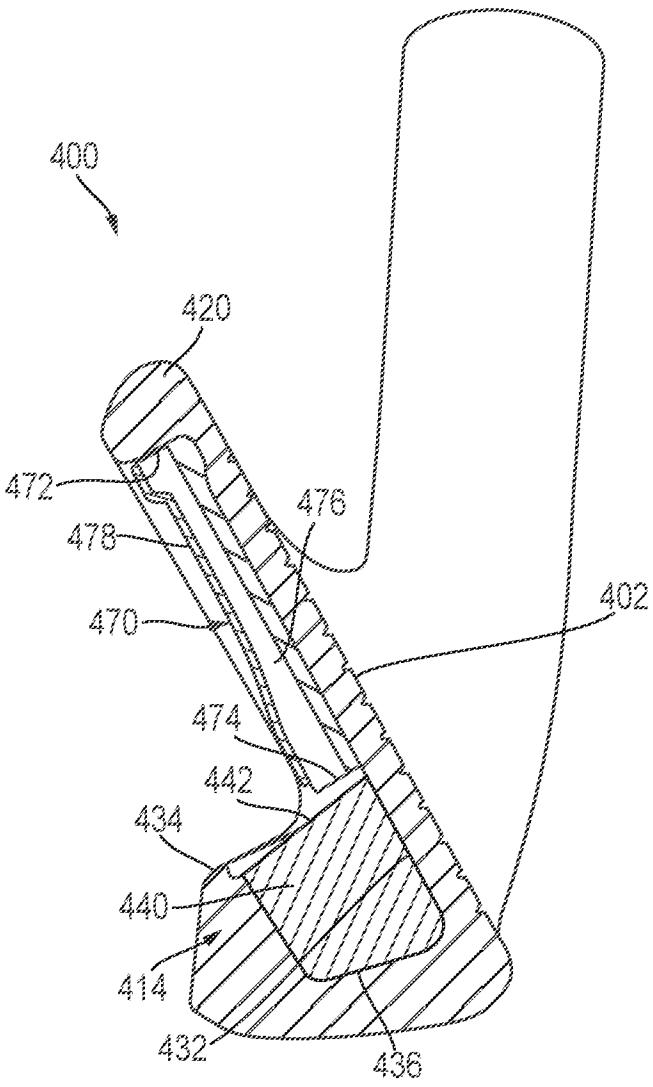
FIG. 15 illustrates a cross section view from the toe side of the golf club head of FIG. 14 comprising an insert cavity, an insert, a rear cavity, and a badge.

FIGS. 14 and 15 illustrate an embodiment of a club head 400 according to the present invention, wherein the rear wall 414 forms a nadir 435. Referring to FIG. 14, the rear wall height 2150 varies in a heel to toe direction such that the rear wall height 2150 is greatest near the heel portion 406 and the toe portion 310 and smallest near the center of the club head 400. The rear wall top edge 434 forms the nadir 445 at the point where the rear wall height 2150 is at a minimum. Club head 400 can be substantially similar to club head 100, except for the differences described below, and like terms relating to club head 400 are numbered similar to those of club head 100, but with a 400 numbering scheme (e.g. club head 400 comprises a strike face 402, etc.).

The shape of the insert cavity 422 can correspond to the shape of the rear wall 414 comprising the nadir 445. The insert cavity 422 can be shallowest near the nadir 445 and deepest near the heel mass 408 and the toe mass 412. In many embodiments, the insert 440 can be shaped complementarily to the insert cavity 422 such that the insert 440 substantially fills the entire insert cavity 422 without overfilling the insert cavity 422. In such embodiments, as illustrated by FIG. 15, the top surface 442 of the insert 440 can be flush with the rear wall top edge 434. In such embodiments, the insert 440 can match the shape of the rear wall 314 in that the height of the insert 440 corresponds to the rear wall height 2150. The height of the insert 440 can be smallest near the nadir 445 and greatest near the heel mass 408 and the toe mass 412. In other embodiments (not shown), the insert 440 may not be shaped complementarily to the insert cavity 422. In such embodiments, the insert 440 can underfill the insert cavity 422 such that the insert top surface 442 is recessed within the insert cavity 422 or overfill the insert cavity 422 such that the insert 440 extends out of the insert cavity 422.

The rear wall 414 comprising the nadir 445 and correspondingly shaped insert 440 illustrated in FIGS. 14 and 15 can reduce the mass of the rear wall 414. The reduction of the rear wall 414 mass creates discretionary mass that can be allocated to other portions of the club head 400 to increase MOI, improve CG 499 position, or damp vibrations.

The rear wall 414 comprising a nadir 445 can be combined with any insert or badge configuration described above or below. In some embodiments, such as the illustrated embodiments of FIGS. 14 and 15, the rear wall 414 comprising a nadir 445 can be combined with a badge 470 similar to badge 370, wherein the badge 470 does not substantially fill the rear cavity 460 and does not conceal the insert 440. In such embodiments, the thin badge 470 creates discretionary mass and provides the appearance of a club head 400 with high forgiveness. In other embodiments, the rear wall 414 comprising the nadir 445 can be combined with a badge similar to badge 170 or badge 270 that substantially fills the rear cavity 460, concealing the insert 440 and providing the appearance of a solidly constructed iron.

VIII. Club Head with Damping System and Insert Cavity Formed within a Badge

Figure 16:
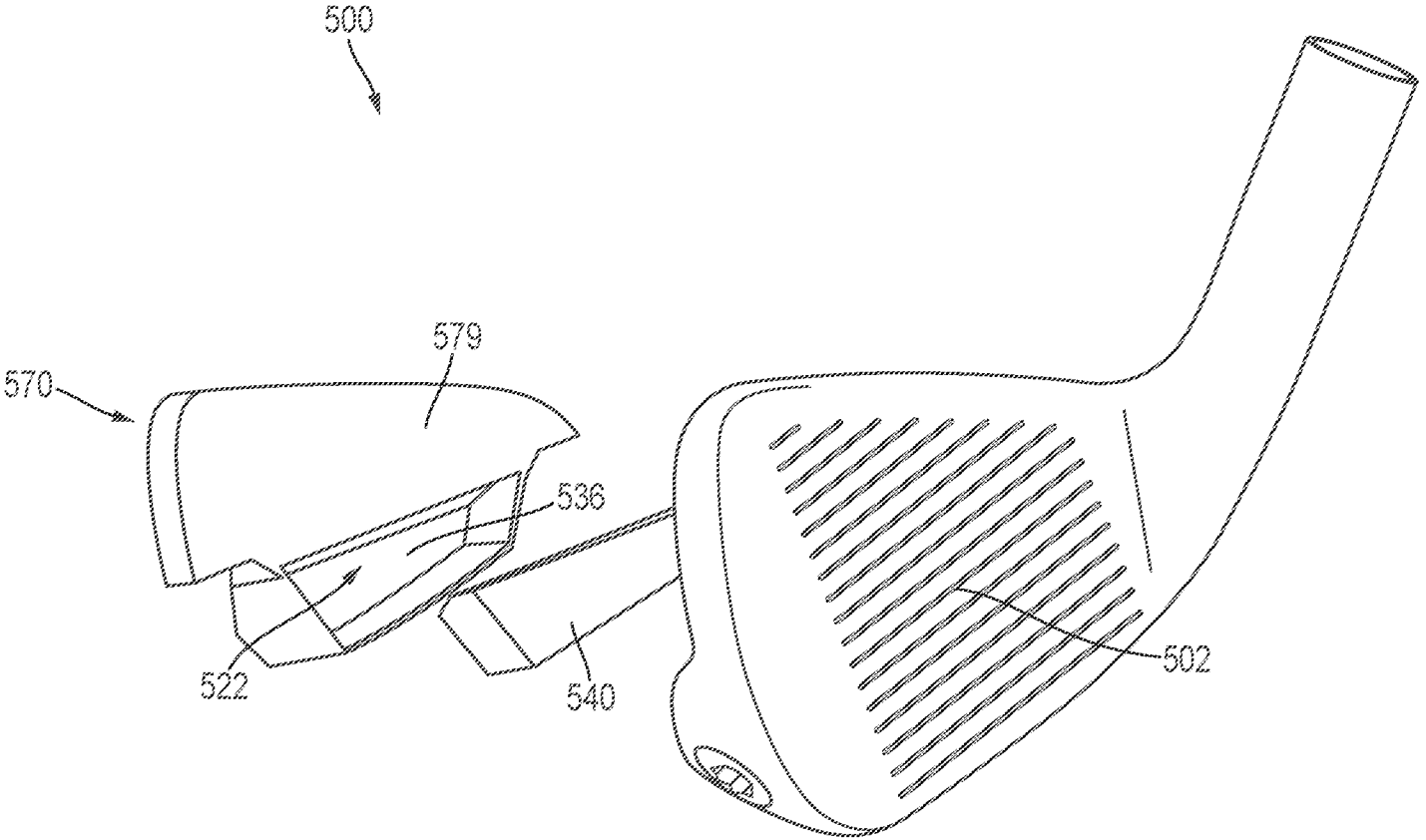
FIG. 16 illustrates an exploded view of a golf club head according to a fifth embodiment.
Figure 17:
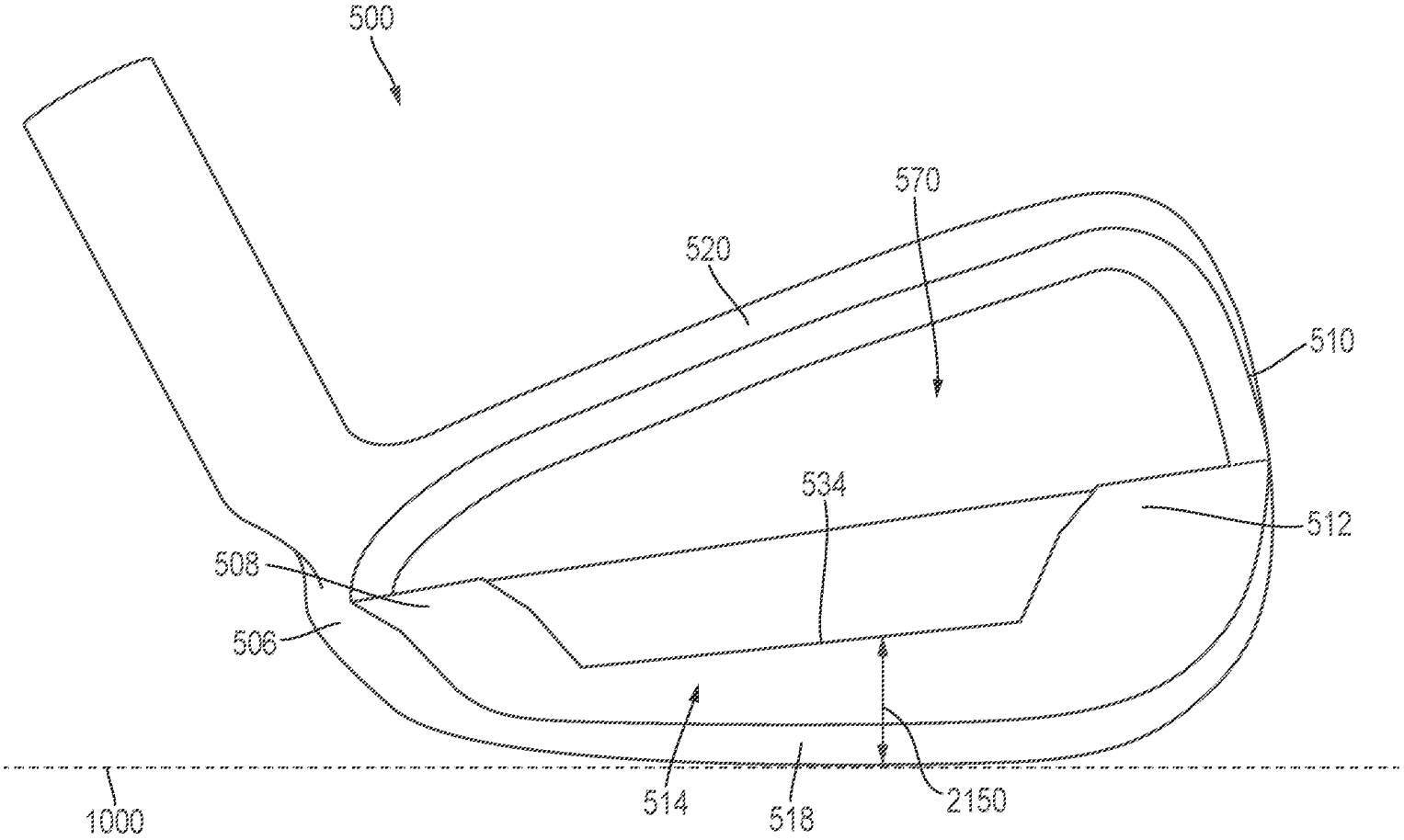
FIG. 17 illustrates a rear view of the golf club head of FIG. 16.
Figure 18:
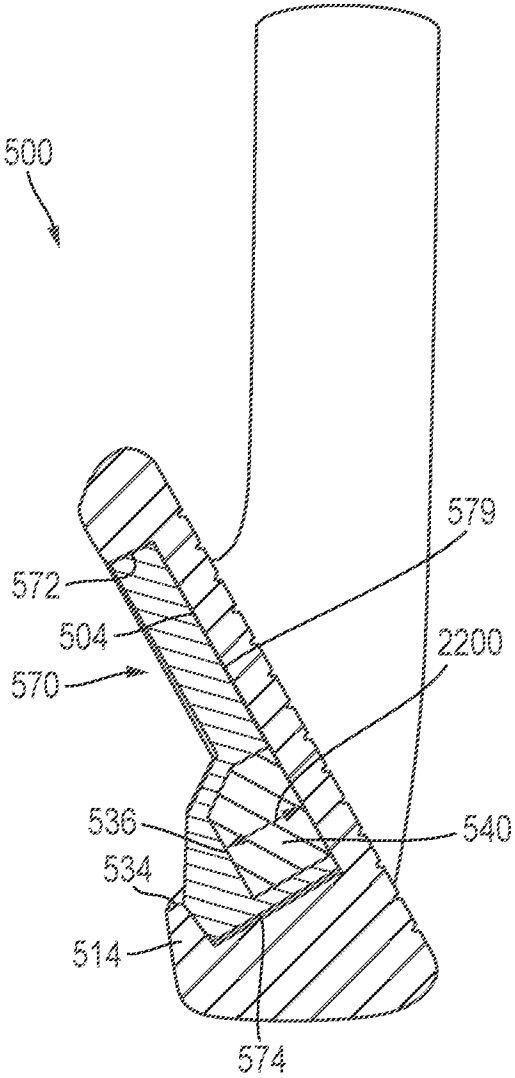
FIG. 18 illustrates a cross section view from the toe side of the golf club head of FIG. 16 comprising an insert cavity, an insert, a rear cavity, and a badge.

In some embodiments, referring to FIGS. 16-18, the club head 500 comprises an insert cavity 522 formed within a portion of the badge 570. In such embodiments, rather than the badge 570 and the insert 540 being separate, the insert 540 can be housed by the badge 570. The insert 540 can be secured within the insert cavity 522 of the badge 570 and the badge 570 and insert 540 can be coupled to the back face 504. Club head 500 can be substantially similar to club head 100, except for the differences described below, and like terms relating to club head 500 are numbered similar to those of club head 100, but with a 500 numbering scheme (e.g. club head 500 comprises a strike face 502, etc.).

As illustrated by FIG. 16, the badge 570 comprises a badge inner surface 579 configured to contact the back face 504. In many embodiments, the badge inner surface 579 is formed by the adhesive layer 576. The insert cavity 522 can be formed as a recess extending into the badge 570 from the badge inner surface 579 to an insert cavity base 536. Referring to FIG. 18, The insert cavity 522 can comprise a cavity depth 2200 measured from the badge inner surface 579 to the insert cavity base 536. In many embodiments, the insert cavity depth 2200 can range between 0.15 inch and 0.35 inch. In some embodiments, the insert cavity depth 2200 can range inclusively between 0.15 inch and 0.20 inch, 0.20 inch and 0.25 inch, 0.25 inch and 0.30 inch, or between 0.30 inch and 0.35 inch. The insert cavity depth 2200 can be approximately 0.15 inch, 0.20 inch, 0.25 inch, 0.30 inch, or approximately 0.35 inch. The insert 540 can be shaped complementarily to the insert cavity 522 such that the insert 540 substantially fills the volume of the insert cavity 522.

Housing the insert 540 within the badge 570 rather than within an insert cavity formed by the rear wall 514 of the club head 500 allows the rear wall 514 to be minimized. Referring to FIG. 17, rear wall height 2150 of club head 500 can be substantially shorter than the rear wall height 2150 of previous embodiments. In many embodiments, the rear wall height 2150 along at least a portion of the rear wall 514 of club head 500 can be less than 0.40 inch. In some embodiments, the rear wall height 2150 along at least a portion of the rear wall 514 of club head 500 can be less than 0.35 inch. In some embodiments, the rear wall height 2150 along at least a portion of the rear wall 514 of club head 500 can be less than 0.30 inch. In some embodiments, the rear wall height 2150 along at least a portion of the rear wall 514 of club head 500 can be less than 0.25 inch. In some embodiments, the rear wall height 2150 along at least a portion of the rear wall 514 of club head 500 can be less than 0.20 inch. In some embodiments, the rear wall height 2150 along at least a portion of the rear wall 514 of club head 500 can be less than 0.15 inch. Because the rear wall 514 does not form the insert cavity 522, the rear wall 514 does not require a certain rear wall height 2150 to be able to retain the insert 540.

Minimizing the rear wall 514 creates discretionary mass that can be allocated to other portions of the club head 500 to increase MOI, improve CG 599 position, or damp vibrations. For example, as illustrated in the embodiment of FIG. 17, discretionary mass created by reducing the rear wall height 2150 can be used to increase the perimeter of the club head 500 by providing a larger heel mass 508 and/or toe mass 512. As illustrated by FIG. 17, the rear wall height 2150 can be greater near the heel mass 508 and the toe mass 512 and lesser near the center in order to increase the perimeter weighting of the club head 500. In some embodiments, minimizing the rear wall 514 can also increase the area of the back face available surface 2400, which in turn allows for an increase in the damping system coverage area and an increase in vibration damping.

As illustrated by FIG. 18, the badge 570 and the insert 540 housed within combine to form a damping system. In many embodiments, when the insert 540 is housed within the insert cavity 522 formed within the badge 570, the insert top surface 542 can be flush with the badge inner surface 579. In many embodiments, the insert top surface 542 is not covered by any portion of the badge 570. The insert top surface 542 and the badge inner surface 579 can both be configured to contact the back face 504 to provide vibration damping benefit to the club head 500. As illustrated, in FIG. 18, there are no spaces or gaps in between the insert top surface 542 and the badge inner surface 579. Because of this, the damping system can cover a greater proportion of the available surface of the back face.

Figure 19:
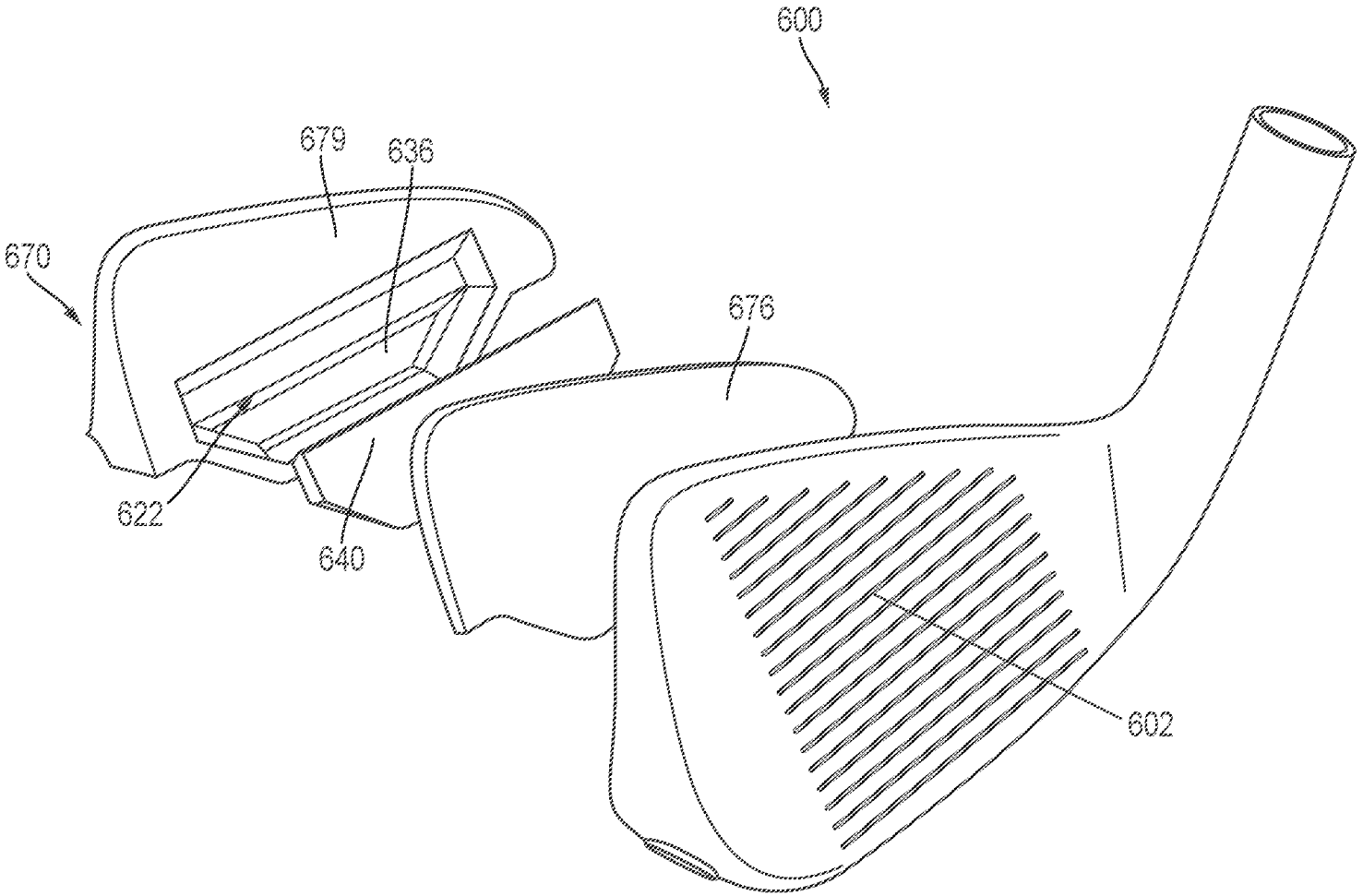
FIG. 19 illustrates an exploded view of a golf club head according to a sixth embodiment.
Figure 20:
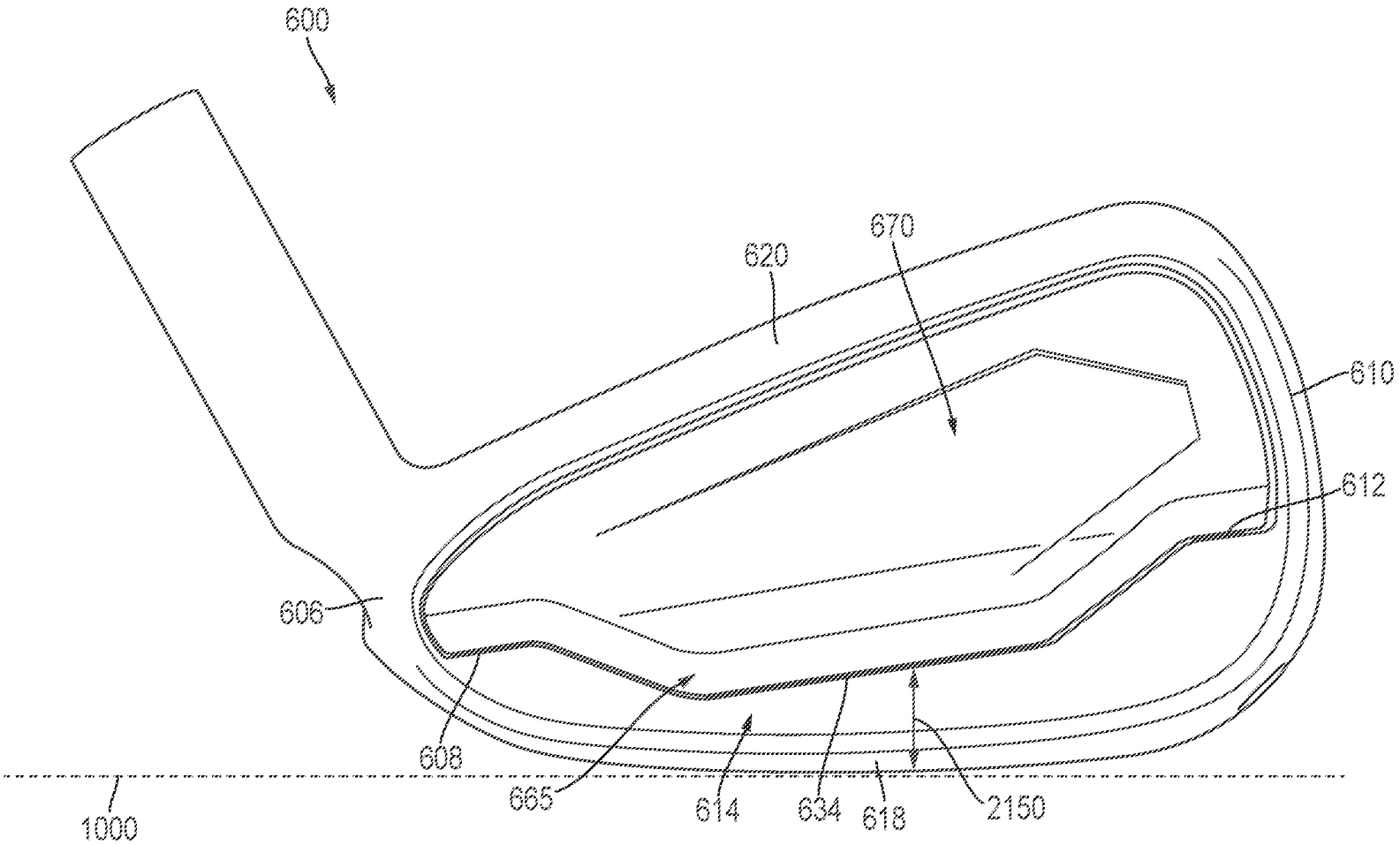
FIG. 20 illustrates a rear view of the golf club head of FIG. 19.
Figure 21:
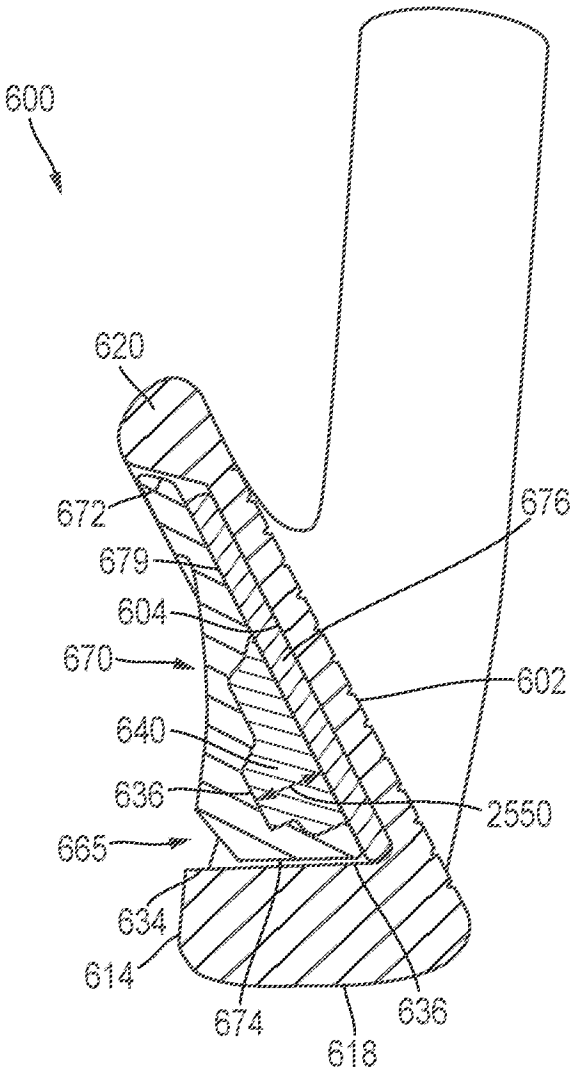
FIG. 21 illustrates a cross section view from the toe side of the golf club head of FIG. 19 comprising an insert cavity, an insert, a rear cavity, and a badge.

In some embodiments, referring to FIGS. 19-21, the club head 600 comprises an insert 640 entirely enclosed within the badge 670. The insert 640 and the badge 670 combine to form a damping system. In the embodiment of FIGS. 19-21, the insert cavity 622 is recessed into a front surface 679 of the badge inner surface 679 and extends to an insert cavity base 636. In many embodiments, the insert cavity 622 can be substantially similar to insert cavity 522 and can comprise an insert cavity depth 2200 substantially similar to the depth 2200 of insert cavity 522. Club head 600 can be substantially similar to club head 100, except for the differences described below, and like terms relating to club head 600 are numbered similar to those of club head 100, but with a 600 numbering scheme (e.g. club head 600 comprises a strike face 602, etc.).

In many embodiments, the insert 640 can be shaped complementarily to the insert cavity 622 such that the insert 640 substantially fills the volume of the insert cavity 622. Referring to FIGS. 19 and 21, the badge 670 can comprise an adhesive layer 676 that covers and conceals the insert 640 within the insert cavity 622. The adhesive layer 676 can be applied to the badge 670 after the insert 640 is inserted into the insert cavity 622 and can serve to secure the insert 640 within the insert cavity 622. In many embodiments, the adhesive layer 676 covers the front surface 679 and the insert top surface 642. In many embodiments, the adhesive layer 676 can form the entirety of the contact area between the damping system and the back face 604 (e.g. the adhesive layer 676 can form the entire damping system coverage area). Providing an adhesive layer 676 that forms the entire damping system coverage area provides the most secure connection possible between the damping system and the back face 604. In many embodiments, the damping system coverage area of club head 600 can be similar to the damping system coverage area of club head 500.

Similar to club head 500, the rear wall 614 of club head 600 can be minimized in comparison to a club head wherein the rear wall forms the insert cavity. The rear wall height 2150 of club head 600 can be similar to the rear wall height 2150 of club head 500. As discussed above, minimizing the rear wall 614 creates discretionary mass that can be allocated to other portions of the club head 600 to increase MOI, improve CG position 699, or damp vibrations. Minimizing the rear wall 614 can also increase the area of the back face available surface 2400.

IX. Golf Club Set with Damping System

In many embodiments, one or more of the club heads 100, 200, 300, 400, 500, 600 can be part of a set of club heads comprising two or more club heads having loft angles varying incrementally across the two or more club heads. In many embodiments, the set of club heads can comprise at least a first club head having a first loft angle and a second club head having a second loft angle greater than the first loft angle. In many embodiments, the set can be divided into a subset of "long irons" and a subset of "short irons." The long irons (e.g. 3-iron, 4-iron, and 5-iron) comprise club heads with relatively low loft angles and are configured to hit the golf ball long distances. The short irons (e.g. 6-iron, 7-iron, 8-iron, 9-iron, and/or any wedges) comprise club heads with relatively high loft angles and are configured to hit the golf ball shorter distances with greater accuracy.

The two or more club heads in the set can be any combination of club heads 100, 200, 300, 400, 500, 600. In many embodiments, the short irons can be provided similar to club head 100, wherein the rear wall 114 is flush with the sole rear edge 192, the rear cavity 160 is formed above the rear wall 114, and the badge 170 visually fills the rear cavity 160. In such embodiments, the short irons comprise the appearance of a muscle-back construction, inspiring confidence in the performance of the club head 100. In many embodiments, the long irons can be provided similar to club head 200, wherein the rear wall 214 is offset from the sole rear edge 292, the rear cavity 260 extends over the entire rear periphery of the club head 200, and the badge 270 only fills a portion of the rear cavity 260 located above the rear wall 214. In such embodiments, the long irons comprise increased perimeter weighting and forgiveness. In such embodiments, the long irons also comprise the appearance of a cavity-back construction, inspiring confidence in the forgiveness of said long irons. The increased forgiveness achieved by the cavity-back construction is particularly valuable in long irons, as long irons are typically more difficult to hit straight than short irons.

In many sets of golf clubs, one or more of the characteristics discussed above can vary across at least two individual club heads within the set. In many embodiments, the blade length of each individual club head can vary in at least two or more individual club heads. In particular, the blade length may increase across at least two club heads as the loft angle decreases. For example, the set can comprise a first club head having a first loft angle and a first blade length, and a second club head having a second loft angle and a second blade length, where the first loft angle is less than the second loft angle and the first blade length is greater than the second blade length.

Similarly, in many embodiments, the face height of each individual club head can vary in at least two or more individual club heads. In particular, the face height may increase across at least two club heads as the loft angle increases. For example, the set can comprise a first club head having a first loft angle and a first face height, and a second club head having a second loft angle and a second face height, where the first loft angle is less than the second loft angle and the first face height is less than the second face height.

Similarly, in many embodiments, the top rail thickness of each individual club head can vary in at least two or more individual club heads. In particular, the top rail thickness may increase across at least two club heads as the loft angle decreases. For example, the set can comprise a first club head having a first loft angle and a first top rail thickness, and a second club head having a second loft angle and a second top rail thickness, where the first loft angle is less than the second loft angle and the first top rail thickness is less than the second top rail thickness. In some embodiments, the top rail thickness may be consistent throughout the short irons of the set while the top rail thickness may increase throughout the long irons as the loft angle decreases. Because the lower-lofted club heads (e.g. the long irons) in the set have shorter face heights and the position of the insert relative to the geometric center of the face is higher, the long irons tend to experience more undesirable vibrations than the short irons. Increasing the top rail thickness in club heads with lower loft angles provides extra vibration damping in such low-lofted club heads. Increasing the top rail thickness of the long irons creates a consistent vibrational response throughout the set, wherein every club head in the set comprises a desirable sound and feel.

X. Club Head with Tightly Spaced Grooves

In many embodiments, the plurality of score lines 105 can be substantially tightly spaced together. The plurality of score lines 105 can define a spacing distance measured as the perpendicular distance between each adjacent score line 105. In many embodiments, the spacing distance can be consistent between each of the plurality of score lines 105. In other embodiments, the spacing distance can vary, such that the spacing distance between a first pair of score lines 105 is different than the spacing distance between a second pair of score lines 105. In many embodiments, the spacing distance between the plurality of score lines 105 ranges between 0.08 inch and 0.12 inch. In some embodiments, the spacing distance between the plurality of score lines 105 can be between 0.08 inch and 0.09 inch, between 0.09 inch and 0.10 inch, between 0.10 inch and 0.11 inch, or between 0.11 inch and 0.12 inch. In some embodiments, the spacing distance between the plurality of score lines 105 can be less than 0.12 inch, less than 0.11 inch, less than 0.10 inch, less than 0.09 inch, or less than 0.08 inch.

The tightly spaced plurality of score lines 105 can be applied to any club head 100, 200, 300, 400, 500, 600 detailed above and/or combined with any club head feature disclosed above according to the present invention, including a damping system comprising an insert and a badge. The tightly spaced plurality of score lines 105 can be applied to a club head comprising any rear wall geometry detailed above, including a rear wall flush with the rear periphery of the club head, a rear wall recessed with respect to the rear periphery, a rear wall comprising a constant height, a rear wall comprising an apex, a rear wall comprising a nadir, or any combination thereof. The tightly spaced plurality of score lines 105 can be applied to a club head comprising any damping system described in the various embodiments above, including a damping system comprising an insert contacting the back face lower portion 132 and a badge contacting the back face upper portion 162, a damping system comprising an insert housed within an insert cavity recessed into a badge, a damping system comprising an insert completely enclosed within a badge, or any combination thereof.

The tight spacing of the plurality of score lines 105 normalizes the performance of the club head in wet conditions. In many prior art club heads, the performance of the club head differs significantly in wet conditions as compared to dry conditions (also considered to be "normal" conditions). The difference in performance based on the dryness or wetness leads to unpredictable and inconsistent golf shots as weather conditions change. In many cases, certain club heads within a set, such as long irons, are affected by wet conditions differently than or club heads within the same set, such as short irons or wedges. For example, in long irons, wet conditions can increase spin rate, leading to shots that travel further than intended. In short irons and wedges, wet conditions can reduce spin rate, leading to shots that do not stop where intended and are more difficult to hold greens. The tight spacing of the plurality of score lines 105 can both decrease the spin rate of long irons in wet conditions and increase the spin rate of short irons and wedges in wet conditions. The tight spacing of the plurality of score lines 105 creates a club head that performs similarly in both wet conditions and dry conditions.

EXAMPLES

XI. Example 1: Exemplary Club Head Set with Damping System

Tables 1 and 2 display various properties and characteristics of an exemplary set of club heads according to the present invention. The set of club heads comprised a 3-iron through 9-iron, a pitching wedge (PW) and a utility wedge (UW). The short irons in the set were similar to club head 100 described above and included a rear cavity formed above the rear wall top edge and a rear wall that sits flush with the sole rear edge. The short irons in the set were similar to club head 200 described above and included a rear cavity extending over the entire rear periphery of the club head and a rear wall offset with respect to the sole rear edge. Each individual club head in the exemplary club head set comprised a damping system including a badge housed within a rear cavity and covering at least a portion of the back face upper portion and an insert housed within an insert cavity and covering at least a portion of the back face lower portion. Table 1 below illustrates various dimensions and mass properties of each individual club head within the set.

TABLE 1

| Club Head | Loft (degrees) | Ixx ($g*in^2$) | Iyy ($g*in^2$) | Izz ($g*in^2$) | Blade Length (in.) | Face Height (in.) | Top Rail Thickness (in.) |
|---|---|---|---|---|---|---|---|
| 3 | 19.0 | 82.3 | 377.3 | 38.2 | 2.766 | 1.860 | 0.305 |
| 4 | 22.5 | 87.65 | 386.6 | 41.0 | 2.766 | 1.910 | 0.300 |
| 5 | 26.0 | 92.2 | 391.9 | 42.4 | 2.760 | 1.960 | 0.295 |
| 6 | 29.5 | 98.9 | 406.4 | 45.5 | 2.748 | 2.015 | 0.290 |
| 7 | 33.0 | 104.4 | 413.8 | 50.3 | 2.720 | 2.040 | 0.280 |
| 8 | 37.0 | 115.7 | 422.6 | 52.8 | 2.715 | 2.145 | 0.280 |
| 9 | 41.0 | 121.6 | 433.9 | 56.3 | 2.713 | 2.170 | 0.280 |
| PW | 45.0 | 133.1 | 455.8 | 65.6 | 2.712 | 2.220 | 0.280 |
| UW | 50.0 | 136.3 | 470.0 | 71.6 | 2.712 | 2.230 | 0.280 |

As illustrated in Table 1, the blade length increases between each individual club head in the set as the loft angle increases, with the exception of the pitching wedge and the utility wedge having identical blade lengths, and the 3-iron and 4-iron having identical blade lengths. The face height decreases between each individual club head in the set as the loft angle increases. Further, the club head set comprises an increased top rail thickness in the long irons (3-iron, 4-iron, 5-iron, and 6-iron) in comparison to the wedges and short irons. As discussed above, the vibrational response of the long irons is typically more difficult to control, and the sound and feel of long irons are typically less desirable than the sound and feel of short irons. Increasing the top rail thickness of the long irons creates a club head set with a consistent vibrational response and a consistent sound and feel throughout the set.

Table 2 below illustrates the relationship between the damping system coverage area and the available rear surface area, the scoring area, and the total face surface area of each individual club head in the set.

TABLE 2

| Club Head | Loft (degrees) | Available Rear Surface Area ($in^2$) | Damping System Coverage Area ($in^2$) | Scoring Area | Total face area |
|---|---|---|---|---|---|
| 3 | 19.0 | 3.779 | 3.582 | 3.267 | 3.999 |
| 4 | 22.5 | 3.797 | 3.595 | 3.332 | 4.154 |
| 5 | 26.0 | 3.764 | 3.561 | 3.373 | 4.263 |
| 6 | 29.5 | 3.757 | 3.551 | 3.426 | 4.395 |
| 7 | 33.0 | 3.701 | 3.496 | 3.456 | 4.484 |
| 8 | 37.0 | 3.741 | 3.529 | 3.540 | 4.679 |
| 9 | 41.0 | 3.732 | 3.517 | 3.601 | 4.830 |
| PW | 45.0 | 3.746 | 3.526 | 3.672 | 5.001 |
| UW | 50.0 | 3.713 | 3.490 | 3.737 | 5.170 |

As illustrated in Table 7, the damping system coverage area of each club head is at least 3.49 $in^2$. In the present example, the damping system coverage area of each club head is between 94% and 95% of the available rear surface area. Further, the damping system coverage area of each club head is between 78% and 90% of the scoring area. Further, the damping system coverage area of each club head is between 70% and 87% of the total face surface area. The damping system covers a significant portion of the back face. This significant coverage leads to the sound and feel benefits detailed in the foregoing examples.

XII. Example 2: Modal Analysis

The vibrational response at impact of a club head according to the present invention (hereafter the "exemplary club head") was compared to a control club head. The exemplary club head was similar to club head 100 described above and included a damping system comprising an insert covering a lower portion of the back face and a badge covering an upper portion of the back face. The exemplary club head comprised a damping system coverage area of 3.50 $in^2$.

Figure 22B:
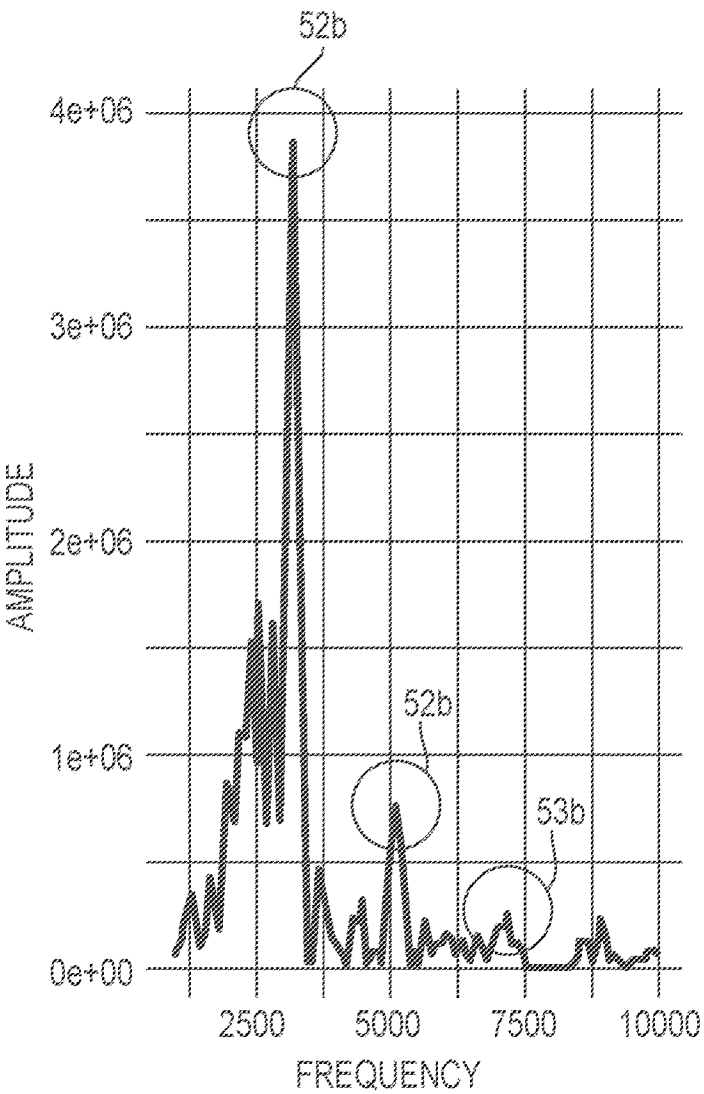
FIG. 22*b* illustrates a graphical representation of an amplitude and a frequency of an exemplary club head.
Figure 22A:
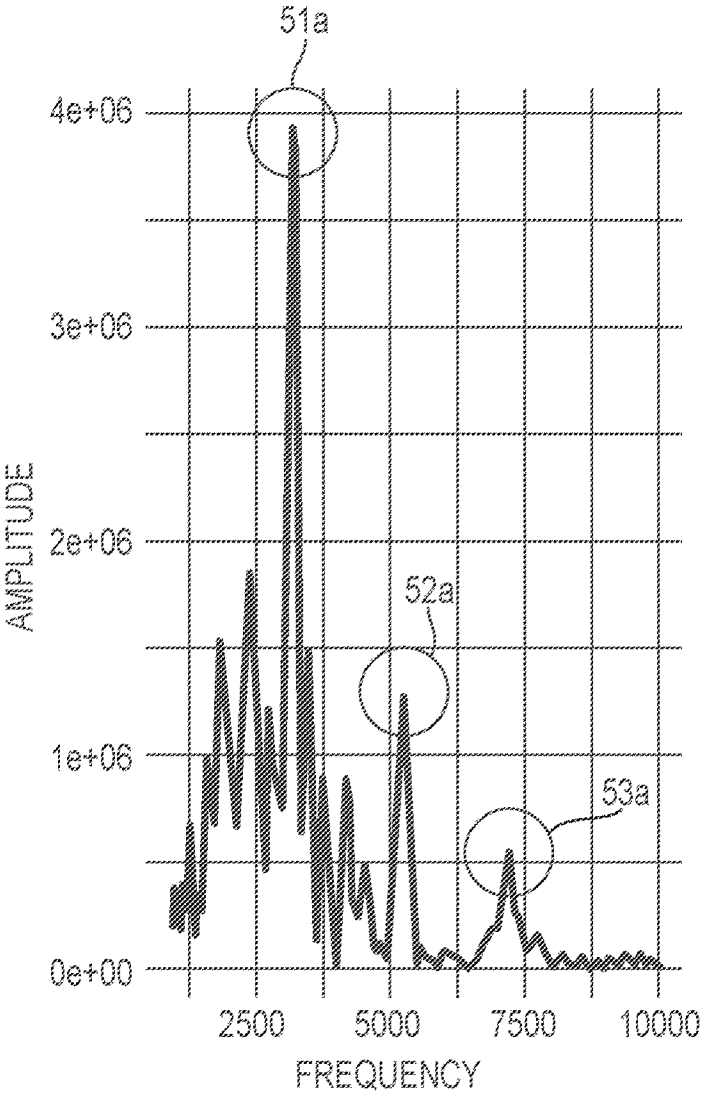
FIG. 22*a* illustrates a graphical representation an amplitude and a frequency of a control club head.

The control club head comprised a construction similar to the control club head, but with a different damping system. The control club head comprised an insert covering a lower portion of the back face but was devoid of a badge. The upper portion of the control club back face was uncovered. The damping system coverage area of the control club head was 1.55 $in^2$. As illustrated in FIGS. 22*a* and 22*b*, three dominant vibrations were observed in both the control club head and the exemplary club head. The exemplary club head and the control club head each exhibited a first peak 51*a*, 51*b* corresponding to impact and a second peak 52*a*, 52*b*, and third peak 53*a*, 53*b* corresponding to residual vibrations. Table 3 below illustrates the amplitude of each peak, as well as the frequency at which the peak occurred.

TABLE 3

| | Peak 1 | | Peak 2 | | Peak 3 | |
|---|---|---|---|---|---|---|
| Club | Frequency (Hz) | Amplitude | Frequency (Hz) | Amplitude | Frequency (Hz) | Amplitude |
| Control | 3228 | $3.95*10^6$ | 5248 | $1.3*10^6$ | 7214 | $6.0*10^5$ |
| Exemplary | 3202 | $3.95*10^6$ | 5094 | $7.8*10^5$ | 7207 | $2.5*10^5$ |

The first peak 51*b* amplitude of the exemplary club head and the first peak 51*a* amplitude of the control club head were identical. The exemplary club head comprised a second peak 52*b* amplitude damped by 40% in comparison to the second peak 52*a* amplitude of the control club head. The exemplary club head comprised a third peak 53*b* amplitude damped by 58% in comparison to the third peak 53*a* amplitude of the control club head. Further, the changes in frequency of the first peak 51*b*, the second peak 52*b*, and the third peak 53*b* of the exemplary club head in comparison to the corresponding peaks 51*a*, 52*a*, 53*a* of the control club head were negligible.

The damping system of the exemplary club head led to a significant damping of residual vibrations while maintaining the same amplitude of the vibrations associated with impact. Further, the exemplary club head and the control club head exhibited similar frequencies corresponding to each peak. The result is the exemplary club head exhibiting a similar pitch and sound at impact with less residual ringing and less overall vibration felt in the hands of the golfer. The sound and feel of the exemplary club head comprising a badge, an insert, and a greater damping system coverage area are improved over the control club head devoid of a badge and comprising a lesser damping system coverage area.

XIII Example 3: Qualitative Sound and Feel Player Test

Described herein is a player test that compared two iron-type club heads having different structures. The club heads were a cavity-back style iron having a similar shape but comprised different damping systems and different damping system coverage areas. The results compared the effect of the different structures on player satisfaction with regard to the sound and feel of the club head.

The first iron-type club head (hereafter referred to as the "exemplary club head") comprised a rear cavity, an insert cavity, a back surface, wherein the back surface comprised an upper back surface and a lower back surface, and a damping system. The upper back surface formed a wall of the rear cavity and the lower back surface formed a wall of the insert cavity. The damping system comprised an insert placed within the insert cavity and a badge was in the rear cavity. The insert covered most of the lower back surface and the badge covered most of the upper rear surface. The exemplary club head comprised a damping system coverage area of 3.50 $in^2$.

The second iron-type club head (hereafter referred to as the "control club head") was similar to the first and comprised a rear cavity, an insert cavity, an insert, a back surface, wherein the back surface comprised an upper back surface and a lower back surface. The upper back surface formed a wall of the rear cavity, and the lower back surface formed a wall of the insert cavity. Wherein, the insert was placed within the insert cavity and the insert covered most of the lower back surface. The upper back surface was exposed. The damping system coverage area of the control club head was 1.55 $in^2$.

A player test was conducted to compare the badge and the insert performance of the exemplary club head to the insert performance of the control club head. The player test involved twenty-two players who participated in a survey for the 4-iron test and the wedge test, and twenty-one players in the 7-iron test. The players compared their experiences with the exemplary club head, and the control club head. The players tested each club head under similar conditions, where the iron-type club heads included similar shaft lengths and similar loft angles. Further, the player test was conducted on a typical surface for striking a golf ball. The test involved striking a golf ball with a full swing with the control club head and the exemplary club head.

After testing, the participants compared the two club heads based on two parameters. The parameters included feel (or "feedback") and sound. Based on these parameters, the participants were asked to compare the feedback and sound of exemplary club head to the control club head on a scale from "Much Worse" to "Much Better." In between these choices, there was: "Somewhat Worse", "About the Same", and "Somewhat Better." "Much Worse" represented a decrease in satisfaction, "Somewhat Worse" represented a slight decrease in satisfaction, "About the Same" represented a neither an increase or decrease in satisfaction, "Somewhat Better" represented a moderate increase in satisfaction, and "Much Better" represented a substantial increase in satisfaction.

TABLE 4

| Feedback | | | | | | |
|---|---|---|---|---|---|---|
| | Much Worse | Somewhat Worse | About the Same | Somewhat Better | Much Better | Total Votes |
| 4 iron | 0 | 0 | 11 | 10 | 1 | 22 |
| 7 iron | 0 | 3 | 12 | 5 | 1 | 21 |
| Wedge | 0 | 1 | 19 | 0 | 2 | 22 |

TABLE 5

| Feedback | | | |
|---|---|---|---|
| | 4 iron | 7 iron | Wedge |
| Number of Participants who Voted Somewhat Better or Much Better | 11 | 6 | 2 |
| Number of Participants who Voted About the Same | 11 | 12 | 19 |
| Total Number Participants | 22 | 21 | 22 |
| Percentage of Participants who Voted Somewhat Better or Much Better | 50% | 29% | 9% |
| Percentage of Participants who Voted About the Same or Better | 100% | 86% | 95% |

Table 4 above illustrates the votes cast by the participants when comparing the exemplary club head to the control club head for feedback. Table 5 above illustrates the percentage of players who ranked the exemplary club head "About the Same", "Somewhat Better", or "Much Better" than the control club head for feedback. The exemplary club head was rated "About the Same", "Somewhat Better", or "Much Better" when compared to the control club head by 100% of the participants for the 4-iron, 86% of the participants for the 7-iron, and 95% of the participants for the Wedge. Further, the exemplary club head was rated "Somewhat Better", or "Much Better" when compared to the control club head by 50% of the participants for the 4-iron, 29% of the participants for the 7 iron, and 9% of the participants for the Wedge.

TABLE 6

| Sound | | | | | | |
|---|---|---|---|---|---|---|
| | Much Worse | Somewhat Worse | About the Same | Somewhat Better | Much Better | Total Votes |
| 4 iron | 0 | 1 | 7 | 11 | 3 | 22 |
| 7 iron | 0 | 3 | 8 | 9 | 1 | 21 |
| Wedge | 0 | 1 | 14 | 6 | 1 | 22 |

TABLE 7

| Sound | 4 iron | 7 iron | Wedge |
|---|---|---|---|
| Number of Participants who Voted Somewhat Better or Much Better | 14 | 10 | 7 |
| Number of Participants who Voted About the Same | 7 | 8 | 14 |
| Total Number Participants | 22 | 21 | 22 |
| Percentage of Participants who Voted Somewhat Better or Much Better | 64% | 48% | 32% |
| Percentage of Participants who Voted About the Same or Better | 95% | 86% | 95% |

Table 6 above illustrates the votes cast by the participants when comparing the exemplary club head to the control club head for sound. Table 7 above illustrates the percentage of players who ranked the exemplary club head "About the Same", "Somewhat Better", or "Much Better" than the control club head for sound. The exemplary club head was rated "About the Same", "Somewhat Better", or "Much Better" when compared to the control club head by 92% of the participants for the 4-iron, 86% of the participants for the 7-iron, and 95% of the participants for the Wedge. Further, the exemplary club head was rated "Somewhat Better", or "Much Better" when compared to the control club head by 64% of the participants for the 4-iron, 48% of the participants for the 7-iron, and 32% of the participants for the Wedge.

The test resulted in the exemplary club head outperforming the qualitative parameters of the control club head (e.g., feedback and sound). The participants in the player test felt the exemplary club head performed better than the control club head. The increased damping system coverage area in the exemplary club head provides advantages over the feedback and sound of the control club head. The exemplary club head included multiple components that each provided a function to the feedback and sound. The damping system of the exemplary club head covers both the lower back surface and the upper back surface, whereas the control club head leaves the upper back surface fully exposed. The inclusion of the badge increases the damping system coverage area and improves the feedback and sound of the exemplary club head by damping the unwanted vibration of the club head.

In particular, participants rated the 4-iron as having the greatest improvement in feedback and sound over the control club head. The improvement in the 4-iron is significant, as the vibrational response in long irons is typically difficult to control, and the sound and feel of the long irons is generally less desirable than that of the short irons. The result is a club head set wherein the sound and feel characteristics are consistent throughout the set.

XIV. Example 4: Ball Flight Performance

The ball flight characteristics of a plurality club heads according to the present invention (hereafter the "exemplary club head(s)") were compared to a plurality of control club heads. The exemplary club heads were similar to club head 100 and/or club head 200 described above and included a damping system comprising an insert covering a lower portion of the back face and a badge covering an upper portion of the back face. The exemplary club heads comprised a damping system coverage area of approximately 3.5 $in^2$.

The control club heads comprised a construction similar to the exemplary club heads, but with a different damping system. The control club heads comprised an insert covering a lower portion of the back face but was devoid of a badge. The control club heads comprised a damping system coverage area of approximately 1.55 $in^2$. The ball flight characteristics were compared between an exemplary 4-iron, an exemplary 7-iron, and an exemplary wedge and a control 4-iron, a control 7-iron, and a control wedge. The ball speed, launch angle, and spin rate of each club head were measured. The ball flight characteristics of each club are presented in Table 8 below.

TABLE 8

| | | Ball Speed (mph) | Launch Angle (degrees) | Spin Rate (rpm) |
|---|---|---|---|---|
| 4-iron | Exemplary | 132.7 | 11.3 | 4309 |
| | Control | 132.6 | 11.1 | 4412.2 |
| 7-iron | Exemplary | 118.5 | 16.3 | 6570.3 |
| | Control | 118.7 | 15.6 | 6639.8 |
| Wedge | Exemplary | 98.6 | 22.6 | 9024.4 |
| | Control | 98 | 23.4 | 8543.9 |

The exemplary club heads performed similarly to the control club heads with respect to each ball flight characteristic. With respect to the 4-iron, the exemplary club head exhibited a 0.1 mph increase (0.08% increase) in ball speed, a 0.2 degree increase (1.8% increase) in launch angle, and a 103 rpm reduction (2.3% decrease) in spin rate. With respect to the 7-iron, the exemplary club head exhibited a 0.2 mph decrease (0.17% decrease) in ball speed, a 0.7 degree increase (4.5% increase) in launch angle, and a 70 rpm reduction (1.0% decrease) in spin rate. Regarding the wedge, the exemplary club head exhibited a 0.6 mph increase (0.6% increase) in ball speed, a 0.8 degree decrease (3.4% decrease) in launch angle, and a 481 rpm increase (5.6% increase) in spin rate. In general, the differences between the ball flight characteristics of the exemplary club heads and the control club heads were negligible. Exceptions include the substantial increase in launch angle of the exemplary 7-iron over the control 7-iron, leading to an increase in carry distance and stopping power, and the substantial increase in spin rate of the exemplary wedge over the control wedge, resulting in increased stopping power.

The exemplary club heads comprise similar ball flight characteristics to the control club heads, leading to similar or slightly improved performance. Referring to the improved vibrational response exhibited in Example 2 and the qualitative improvements in sound and feel exhibited in Example 3, the inclusion of the damping system comprising a badge in combination with an insert produces a club head with improved sound and feel while retaining a high level of ball flight performance.

XV. Example 5: Badge Durability

Described herein is a durability test that compared two multi-material badges made from different materials. The objective of the test was to test the badge for the ability to retain adhesion to a golf club head and limit scratches, dents, and bends throughout the use of the badge.

The first badge (hereafter referred to as the "exemplary badge") was similar to badge 170. The exemplary badge comprised an adhesive layer, a filler layer, and a rigid layer. The rigid layer was made from 17-4 stainless steel.

The second badge (hereafter referred to as the "control badge") was similar to badge 170. The control badge comprised an adhesive layer, a filler layer, and a rigid layer. The rigid layer was made from 6061 aluminum.

A test was conducted to compare the durability of the exemplary badge and the control badge. The durability test consisted of affixing the test specimens in the appropriate orientation and then subjecting the badge to a steel shot media for a number of designated drops. Scans and photos were taken of each badge at specified intervals. The test apparatus consisted of a funnel positioned above the badge with a 36-inch guide tube. A steel shot was released and accelerated through the guide tube to impact the badge. The badge was adhered to a platform that was set at 45° relative to the path of the guide tube. The badge further was placed an inch from the end of the guide tube and secured. Once all parameters were confirmed the steel shot was released to impact the center of the badge. The process was repeated until the badge was damaged or for 30 repetitions, whichever condition was met first concluded the test. A damaged badge would mean the badge had a loss of adhesion to the platform or an excess in scratching, denting, or bending. The badge was inspected after each impact. The badge was 3D laser scanned after 0, 10, 15, 20, and 30 drops.

After testing the control badge withstood 3 repetitions before being damaged. The control badge deformed and lost adhesion to the platform. The 3 impacts caused the rigid layer to deform to such an extent that the adhesion to the platform failed and approximately 50% of the control badge lost adhesion to the platform.

Due to the control badge failing after 3 repetitions the exemplary badge underwent 3 repetitions to provide a fair comparison of durability between the exemplary badge and the control badge. The exemplary badge withstood 3 impacts and maintained adhesion to the platform. The exemplary control badge deformed 0.012 inches at the point of impact, considered an acceptable amount of deformation.

The test resulted in the exemplary badge outperforming the control badge based on durability. The control badge failed the test and deformed such that the control badge lost adhesion to the platform. If the control were to have been attached to a club head the badge would have detached from the club head. The exemplary badge maintained adhesion to the platform and deformed only slightly. The exemplary badge will maintain adhesion and limit scratches, dents, and bends throughout the use of the badge.

XVI. Example 6: Comparison in Performance in Wet Conditions and Dry Conditions The consistency of the performance in wet and dry conditions of an exemplary club head was compared to the consistency of the performance in wet and dry conditions of a control club head. The exemplary club head was a wedge-type club head of a similar construction to club head 100 and comprised a damping system including a badge covering an upper portion of the back face and an insert covering a lower portion of the back face. The exemplary club head comprised a spacing distance between a plurality of score lines, wherein the exemplary club head spacing distance was 0.104 inch.

The control club head comprised a construction similar to the exemplary club head, but devoid of a badge. The control club head further comprised a spacing distance between the plurality of score lines, wherein the control club head spacing distance was 0.140 inch.

The ball speed, launch angle, spin rate, and carry distance of each club head was measured both in dry conditions and wet conditions. The difference in performance of each club head between the dry conditions and the wet conditions was evaluated. Tables 9-12 below display the results of the comparison.

TABLE 9

Ball Speed Comparison

| | Control | Exemplary |
|---|---|---|
| Dry Ball Speed (mph) | 102.4 | 102.6 |
| Wet Ball Speed (mph) | 100.7 | 101.7 |
| Change in Ball Speed (mph) | −1.7 | −0.9 |

Table 9 above exhibits the ball speed of the control club head and the exemplary club head, each measured in both wet and dry conditions. The control club head exhibited a decrease in ball speed of 1.7 mph (1.6% decrease). The exemplary club head exhibited a decrease in ball speed of only 0.9 mph (0.9% decrease).

TABLE 10

Launch Angle Comparison

| | Control | Exemplary |
|---|---|---|
| Dry Launch Angle (Degrees) | 21.3 | 20.7 |
| Wet Launch Angle (Degrees) | 24.5 | 21.1 |
| Change in Launch Angle (Degrees) | 3.2 | 0.4 |

Table 10 above exhibits the launch angle of the control club head and the exemplary club head, each measured in both wet and dry conditions. The control club head exhibited an increase in launch angle of 3.2 degrees (15% increase). The exemplary club head exhibited an increase in launch angle of only 0.4 degrees (1.9% increase).

TABLE 11

Spin Rate Comparison

| | Control | Exemplary |
|---|---|---|
| Dry Spin Rate (rpm) | 9068.1 | 9321.2 |
| Wet Spin Rate (rpm) | 6902.9 | 9143.7 |
| Change in Spin Rate (rpm) | −2165.2 | −177.5 |

Table 11 above exhibits the spin rate of the control club head and the exemplary club head, each measured in both wet and dry conditions. The control club head exhibited a decrease in spin rate of 2165.2 rpm (23.9% decrease). The exemplary club head exhibited a decrease in spin rate of only 177.5 rpm (1.9% decrease).

TABLE 12

Carry Distance Comparison

| | Control | Exemplary |
|---|---|---|
| Dry Carry Distance (yds) | 132.2 | 132.1 |
| Wet Carry Distance (yds) | 134.2 | 130.8 |
| Change in Carry Distance (yds) | 2.0 | −1.3 |

Table 12 above exhibits the carry distance of the control club head and the exemplary club head, each measured in both wet and dry conditions. The control club head exhibited an increase in carry distance of 2.0 yards (1.5% increase). The exemplary club head exhibited a decrease in carry distance of only 1.3 yards (1.0% decrease).

The exemplary club head exhibited significantly more consistent performance between dry and wet conditions in comparison to the performance of the control club head. The exemplary club head exhibited slightly reduced variability in wet and dry performance with respect to ball speed (0.8 mph less variability) and carry distance (0.7 yards less variability). Further, the exemplary club head exhibited significantly reduced variability in wet and dry performance with respect to launch angle (2.8 degrees less variability) and spin rate (1988 rpm less variability). The tighter spacing of the score lines of the exemplary club head resulted in more consistent performance in dry and wet conditions. The result of the tighter spacing of the score lines is a club head whose performance is more predictable in all weather conditions.

CLAUSES

Clause 1. An iron-type golf club head comprising: a strike face comprising a geometric center and a back face opposite the strike face; a heel portion; a toe portion opposite the heel portion; a top rail; a sole opposite the top rail; a rear wall extending upward from the sole at least partially towards the top rail; wherein the rear wall comprises a rear wall top edge; an insert cavity formed by at least an inner surface of the rear wall and a lower portion of the back face; wherein the insert cavity comprises an insert cavity opening extending between the rear wall top edge and the lower portion of the back face; wherein the insert cavity comprises an insert cavity base formed by an inner surface of the sole; a damping system comprising: an insert disposed within the insert cavity; a badge attached to an upper portion of the back face; wherein the damping system defines a damping system coverage area measured as a combined surface area of the back face contacted by the insert and the badge; wherein the damping system coverage area is greater than 3.0 $in^2$; and wherein the damping system coverage area is greater than 85% of an available surface area of the back face.

Clause 2. The iron-type golf club head of clause 1, wherein the strike face comprises a plurality of grooves extending in a heel-to-toe direction; and wherein the club head comprises a blade length measured as a heel-to-toe distance between a heel-most extent of the plurality of grooves and a toe-most extent of the strike face.

Clause 3. The iron-type golf club head of clause 2, further comprising a ground plane tangent to the sole at an address position and a coordinate system; wherein the coordinate system comprises: an X-axis extending in a heel-to-toe direction parallel to the ground plane; a Y-axis orthogonal to the X-axis and extending in a top rail-to-sole direction; a Z-axis orthogonal to the X-axis and the Y-axis and extending in a front-to-back direction; wherein the club head further comprises an Iyy moment of inertia measured about the Y-axis; wherein the Iyy moment of inertia is greater than 390 $g \cdot in^2$; and wherein a ratio between the Iyy moment of inertia and the blade length is greater than 100 g·in.

Clause 4. The iron-type golf club head of clause 1, further comprising a rear cavity bounded, at least partially, by the top rail, the heel portion, the toe portion, and the rear wall; wherein the top rail forms a top rail rear edge, the heel portion forms a heel rear edge, and the toe portion forms a toe rear edge; wherein the top rail rear edge, the heel rear edge, the toe rear edge, and the rear wall top edge form a rear cavity opening; and wherein the rear cavity extends from the rear cavity opening to the upper portion of the back face.

Clause 5. The iron-type golf club head of clause 4, wherein the badge fills between 75% and 99% of a volume of the rear cavity.

Clause 6. The iron-type golf club head of clause 1, wherein the insert comprises an insert bottom surface abutting the insert cavity base and an insert top surface proximate the insert cavity opening; and wherein the insert top surface is below the geometric center of the strike face.

Clause 7. The iron-type golf club head of clause 1, wherein the badge comprises badge top edge and a badge bottom edge; and wherein a thickness of the badge increases from the badge top edge to the badge bottom edge.

Clause 8. The iron-type golf club head of clause 7, wherein the badge bottom edge entirely covers the insert cavity opening.

Clause 9. The iron-type golf club head of clause 1, wherein the badge comprises an adhesive layer coupled to the back face and a rigid layer exposed to an exterior of the club head.

Clause 10. The iron-type golf club head of clause 9, wherein the adhesive layer comprises a viscoelastic material.

Clause 11. The iron-type golf club head of clause 1, wherein the available surface area of the back face is greater than 3.0 $in^2$.

Clause 12. An iron-type golf club head comprising: a strike face and a back face opposite the strike face; a heel portion; a toe portion opposite the heel portion; a top rail; a sole opposite the top rail; a rear wall extending upward from the sole at least partially towards the top rail; wherein the strike face comprises a strike face perimeter and a plurality of score lines extending in a heel-to-toe direction; wherein the rear wall comprises a rear wall top edge; an insert cavity formed by at least an inner surface of the rear wall and a lower portion of the back face; wherein the insert cavity comprises an insert cavity opening extending between the rear wall top edge and the lower portion of the back face; wherein the insert cavity comprises an insert cavity base formed by an inner surface of the sole; a damping system comprising: an insert disposed within the insert cavity; a badge attached to an upper portion of the back face; wherein the damping system defines a damping system coverage area measured as a combined surface area of the back face contacted by the insert and the badge; wherein the damping system coverage area is greater than 3.0 $in^2$; and wherein the strike face defines a scoring area extending from the strike face perimeter near the top rail to the strike face perimeter near the sole; wherein the scoring area comprises a scoring area heel boundary defined by a line connecting a heel-most extent of the plurality of score lines and a scoring area toe boundary defined by a line connecting a toe-most extent of the plurality of score lines; wherein the back face defines a projection corresponding to a location of the scoring area; and wherein a portion of the damping system coverage area that overlaps the projection is greater than 75% of a surface area of the scoring area.

Clause 13. The iron-type golf club head of clause 12, wherein the club head comprises a blade length measured as a heel-to-toe distance between a heel-most extent of the plurality of score lines and a toe-most extent of the strike face.

Clause 14. The iron-type golf club head of clause 12, wherein the badge comprises an adhesive layer in contact with the upper portion of the back face, a rigid layer opposite the adhesive layer and exposed to a rear exterior of the club head, and a filler layer disposed between the adhesive layer and the rigid layer.

Clause 15 The iron-type golf club head of clause 14, wherein the adhesive layer comprises a thickness between 0.02 inch and 0.08 inch.

Clause 16. The iron-type golf club head of clause 14, wherein the adhesive layer comprises a viscoelastic material.

Clause 17 The iron-type golf club head of clause 14, wherein the rigid layer of the badge comprises a hardness greater than 80 HRB.

Clause 18. The iron-type golf club head of clause 12, wherein the plurality of score lines comprise a spacing distance less than 0.12 inch.

Clause 19. An iron-type golf club head comprising: a strike face and a back face opposite the strike face; a heel portion; a toe portion opposite the heel portion; a top rail; a sole opposite the top rail; a rear wall extending upward from the sole at least partially towards the top rail; wherein the rear wall comprises a rear wall top edge; an insert cavity formed by at least an inner surface of the rear wall and a lower portion of the back face; wherein the insert cavity comprises an insert cavity opening extending between the rear wall top edge and the lower portion of the back face; wherein the insert cavity comprises an insert cavity base formed by an inner surface of the sole; a damping system comprising: an insert disposed within the insert cavity; a badge attached to an upper portion of the back face; wherein the damping system defines a damping system coverage area measured as a combined surface area of the back face contacted by the insert and the badge; wherein the damping system coverage area is greater than 3.0 $in^2$; and wherein the damping system coverage area is between 60% and 85% of a total surface area of the strike face.

Clause 20. The iron-type golf club head of clause 19, wherein the top rail comprises a top rail thickness between 0.15 inch and 0.30 inch.

Clause 21. The iron-type golf club head of clause 19, further comprises a rear perimeter comprising a top rail rear edge, a heel portion rear edge, a toe portion rear edge, and a sole rear edge.

Clause 22. The iron-type golf club head of clause 19, wherein the rear wall is recessed with respect to the rear perimeter.

Clause 23. The iron-type golf club head of clause 22, wherein the rear wall forms a lip proximate the rear wall top edge, and wherein a gap is formed between the lip and the badge.

Clause 24. The iron-type golf club head of clause 23, wherein an exterior surface of the badge is recessed with respect to the rear perimeter.

Clause 25. An iron-type golf club head comprising: a strike face comprising a front face and a back face opposite the front face; a heel portion; a toe portion opposite the heel portion; a top rail; a sole opposite the top rail; a rear wall extending upward from the sole at least partially towards the top rail; a damping system comprising: a badge affixed to the back face; the badge comprising a badge inner surface in contact with the back face; wherein the badge forms an insert cavity recessed into the badge inner surface; wherein the insert cavity extends from the badge inner surface to an insert cavity base; an insert secured within the insert cavity; wherein the insert comprises an insert top surface that is flush with the badge inner surface; a damping system coverage area defined as a combined surface area of the back face contacted by the insert and the badge; wherein the damping system coverage area is greater than 3.0 in2; and wherein the damping system coverage area is greater than 85% of an available surface area of the back face.

Clause 26. The iron-type golf club head of clause 25, wherein the insert cavity comprises an insert cavity depth measured from the badge inner surface to the insert cavity base; and wherein the insert cavity depth is between 0.15 inch and 0.35 inch.

Clause 27. The iron-type golf club head of clause 25, wherein the insert is shaped complementarily to the insert cavity.

Clause 28. The iron-type golf club head of clause 25, further comprising a ground plane tangent to the sole; wherein the rear wall further comprises a rear wall top edge; wherein the rear wall comprises a rear wall height measured vertically between the ground plane and the rear wall top edge; and wherein the rear wall height is less than 0.40 inch.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. An iron-type golf club head comprising:
- a strike face comprising a geometric center and a back face opposite the strike face;
- a heel portion;
- a toe portion opposite the heel portion;
- a top rail;
- a sole opposite the top rail;
- a rear wall extending upward from the sole at least partially towards the top rail;
- wherein the rear wall comprises a rear wall top edge;
- an insert cavity formed by at least an inner surface of the rear wall and a lower portion of the back face;
- wherein the insert cavity comprises an insert cavity opening extending between the rear wall top edge and the lower portion of the back face;
- wherein the insert cavity comprises an insert cavity base formed by an inner surface of the sole;
- a damping system comprising:
  - an insert disposed within the insert cavity;
  - a badge attached to an upper portion of the back face;
  - wherein the insert and the badge are in contact with back face;
  - wherein the damping system defines a damping system coverage area measured as a combined surface area of the back face contacted by the insert and the badge;
  - wherein the damping system coverage area is greater than 3.0 $in^2$; and
  - wherein the damping system coverage area is greater than 85% of an available surface area of the back face.

2. The iron-type golf club head of claim 1, wherein the strike face comprises a plurality of grooves extending in a heel-to-toe direction; and wherein the club head comprises a blade length measured as a heel-to-toe distance between a heel-most extent of the plurality of grooves and a toe-most extent of the strike face.

3. The iron-type golf club head of claim 2, further comprising a ground plane tangent to the sole at an address position and a coordinate system;

wherein the coordinate system comprises:

an X-axis extending in a heel-to-toe direction parallel to the ground plane;

a Y-axis orthogonal to the X-axis and extending in a top rail-to-sole direction;

a Z-axis orthogonal to the X-axis and the Y-axis and extending in a front-to-back direction;

wherein the club head further comprises an Iyy moment of inertia measured about the Y-axis;

wherein the Iyy moment of inertia is greater than 390 $g \cdot in^2$; and wherein a ratio between the Iyy moment of inertia and the blade length is greater than 100 g·in.

4. The iron-type golf club head of claim 1, further comprising a rear cavity bounded, at least partially, by the top rail, the heel portion, the toe portion, and the rear wall;

wherein the top rail forms a top rail rear edge, the heel portion forms a heel rear edge, and the toe portion forms a toe rear edge;

wherein the top rail rear edge, the heel rear edge, the toe rear edge, and the rear wall top edge form a rear cavity opening; and wherein the rear cavity extends from the rear cavity opening to the upper portion of the back face.

5. The iron-type golf club head of claim 4, wherein the badge fills between 75% and 99% of a volume of the rear cavity.

6. The iron-type golf club head of claim 1, wherein the insert comprises an insert bottom surface abutting the insert cavity base and an insert top surface proximate the insert cavity opening; and wherein the insert top surface is below the geometric center of the strike face.

7. The iron-type golf club head of claim 1, wherein the badge comprises badge top edge and a badge bottom edge; and wherein a thickness of the badge increases from the badge top edge to the badge bottom edge.

8. The iron-type golf club head of claim 7, wherein the badge bottom edge entirely covers the insert cavity opening.

9. The iron-type golf club head of claim 1, wherein the badge comprises an adhesive layer coupled to the back face and a rigid layer exposed to an exterior of the club head.

10. The iron-type golf club head of claim 9, wherein the adhesive layer comprises a viscoelastic material.

11. The iron-type golf club head of claim 1, wherein the available surface area of the back face is greater than 3.0 $in^2$.

12. An iron-type golf club head comprising:

a strike face and a back face opposite the strike face;

a heel portion;

a toe portion opposite the heel portion;

a top rail;

a sole opposite the top rail;

a rear wall extending upward from the sole at least partially towards the top rail;

wherein the strike face comprises a strike face perimeter and a plurality of score lines extending in a heel-to-toe direction;

wherein the rear wall comprises a rear wall top edge;

an insert cavity formed by at least an inner surface of the rear wall and a lower portion of the back face;

wherein the insert cavity comprises an insert cavity opening extending between the rear wall top edge and the lower portion of the back face;

wherein the insert cavity comprises an insert cavity base formed by an inner surface of the sole;

a damping system comprising:

an insert disposed within the insert cavity;

a badge attached to an upper portion of the back face;

wherein the insert and the badge are in contact with back face;

wherein the damping system defines a damping system coverage area measured as a combined surface area of the back face contacted by the insert and the badge;

wherein the damping system coverage area is greater than 3.0 $in^2$; and wherein the strike face defines a scoring area extending from the strike face perimeter near the top rail to the strike face perimeter near the sole;

wherein the scoring area comprises a scoring area heel boundary defined by a line connecting a heel-most extent of the plurality of score lines and a scoring area toe boundary defined by a line connecting a toe-most extent of the plurality of score lines;

wherein the back face defines a projection corresponding to a location of the scoring area; and wherein a portion of the damping system coverage area that overlaps the projection is greater than 75% of a surface area of the scoring area.

13. The iron-type golf club head of claim 12, wherein the club head comprises a blade length measured as a heel-to-toe distance between a heel-most extent of the plurality of score lines and a toe-most extent of the strike face.

14. The iron-type golf club head of claim 12, wherein the badge comprises an adhesive layer in contact with the upper portion of the back face, a rigid layer opposite the adhesive layer and exposed to a rear exterior of the club head, and a filler layer disposed between the adhesive layer and the rigid layer.

15. The iron-type golf club head of claim 14, wherein the rigid layer of the badge comprises a hardness greater than 80 HRB.

16. The iron-type golf club head of claim 12, wherein the plurality of score lines comprise a spacing distance less than 0.12 inch.

17. An iron-type golf club head comprising:

a strike face and a back face opposite the strike face;

a heel portion;

a toe portion opposite the heel portion;

a top rail;

a sole opposite the top rail;

a rear wall extending upward from the sole at least partially towards the top rail;

wherein the rear wall comprises a rear wall top edge;

an insert cavity formed by at least an inner surface of the rear wall and a lower portion of the back face;

wherein the insert cavity comprises an insert cavity opening extending between the rear wall top edge and the lower portion of the back face;

wherein the insert cavity comprises an insert cavity base formed by an inner surface of the sole;

a damping system comprising:

an insert disposed within the insert cavity;

a badge attached to an upper portion of the back face;

wherein the insert and the badge are in contact with back face;

wherein the damping system defines a damping system coverage area measured as a combined surface area of the back face contacted by the insert and the badge;

wherein the damping system coverage area is greater than 3.0 $in^2$; and wherein the damping system coverage area is between 60% and 85% of a total surface area of the strike face.

18. The iron-type golf club head of claim 17, wherein the top rail comprises a top rail thickness, measured as a perpendicular distance between the strike face and a top rail rear edge, between 0.15 inch and 0.30 inch.

19. The iron-type golf club head of claim 17, further comprises a rear perimeter comprising a top rail rear edge, a heel portion rear edge, a toe portion rear edge, and a sole rear edge.

20. The iron-type golf club head of claim 19, wherein the rear wall is recessed with respect to the rear perimeter.

* * * * *